US006617772B1

(12) United States Patent
Barton et al.

(10) Patent No.: US 6,617,772 B1
(45) Date of Patent: Sep. 9, 2003

(54) FLAT-PANEL DISPLAY HAVING SPACER WITH ROUGH FACE FOR INHIBITING SECONDARY ELECTRON ESCAPE

(75) Inventors: Roger W. Barton, Tofte, MN (US); Kollengode S. Narayanan, Cupertino, CA (US); Bob L. Mackey, San Jose, CA (US); John M. Macaulay, Mountain View, CA (US); George B. Hopple, Palo Alto, CA (US); Donald R. Schropp, Jr., San Jose, CA (US); Michael J. Nystrom, San Jose, CA (US); Sudhakar Gopalakrishnan, San Jose, CA (US); Shiyou Pei, San Jose, CA (US); Xueping Xu, Stamford, CT (US)

(73) Assignees: Candescent Technologies Corporation, San Jose, CA (US); Candescent Intellectual Property Services, Inc., San Jose, CA (US); Advanced Technology Materials, Inc, San Jose, CA (US)

( * ) Notice: Subject to any disclaimer, the term of this patent is extended or adjusted under 35 U.S.C. 154(b) by 0 days.

(21) Appl. No.: 09/210,085

(22) Filed: Dec. 11, 1998

(51) Int. Cl.[7] ..... H01J 1/88
(52) U.S. Cl. ..... 313/292; 313/495; 445/24
(58) Field of Search ..... 445/24; 313/282, 313/283, 289, 292, 309, 495, 496, 497

(56) References Cited

U.S. PATENT DOCUMENTS

| | | | | |
|---|---|---|---|---|
| 4,652,467 A | | 3/1987 | Brinker et al. | 427/246 |
| 5,103,288 A | | 4/1992 | Sakamoto et al. | 357/71 |
| 5,227,691 A | | 7/1993 | Murai et al. | 313/422 |
| 5,494,858 A | | 2/1996 | Gnade et al. | 437/231 |
| 5,523,615 A | | 6/1996 | Cho et al. | 257/632 |
| 5,541,473 A | | 7/1996 | Duboc, Jr. et al. | 313/422 |
| 5,548,181 A | | 8/1996 | Jones | 313/309 |
| 5,561,318 A | | 10/1996 | Gnade et al. | 257/638 |
| 5,564,959 A | | 10/1996 | Spindt et al. | 445/24 |
| 5,598,056 A | | 1/1997 | Jin et al. | 313/495 |
| 5,614,781 A | | 3/1997 | Spindt et al. | 313/422 |
| 5,675,212 A | | 10/1997 | Schmid et al. | 313/422 |
| 5,726,529 A | | 3/1998 | Dean et al. | 313/495 |
| 5,731,660 A | | 3/1998 | Jaskie et al. | 313/495 |
| 5,760,538 A | | 6/1998 | Mitsutake et al. | 313/422 |
| 5,859,502 A | | 1/1999 | Spindt et al. | 315/169.3 |
| 5,872,424 A | | 2/1999 | Spindt et al. | 313/495 |
| 5,936,343 A | | 8/1999 | Fushimi et al. | 313/495 |
| 5,939,822 A | | 8/1999 | Alderson | 313/493 |
| 5,985,067 A | | 11/1999 | Schmid et al. | 313/495 |
| 5,990,614 A | | 11/1999 | Spindt | 313/495 |
| 6,013,981 A | | 1/2000 | Spindt et al. | 313/495 |
| 6,153,973 A | * | 11/2000 | Shibata et al. | 313/495 |
| 6,222,313 B1 | | 4/2001 | Smith et al. | 313/495 |

FOREIGN PATENT DOCUMENTS

| | | |
|---|---|---|
| JP | 8-7811 | 1/1996 |

OTHER PUBLICATIONS

Hoffman, "Inorganic membrane filter for analytical separations," *American Laboratory*, Aug. 1989, pp. 70–73.

(List continued on next page.)

*Primary Examiner*—Vip Patel
*Assistant Examiner*—Joseph Williams

(57) ABSTRACT

A flat-panel display contains a pair of plate structure (20 and 22) separated by a spacer (24) having a rough face (54 or 56). When electrons strike the spacer, the roughness in the spacer's face causes the number of secondary electrons that escape the spacer to be reduced, thereby alleviating positive charge buildup on the spacer. As a result, the image produced by the display is improved. The spacer facial roughness can be achieved in various ways such as depressions (60, 62, 64, 66, 70, 74, or 80) or/and protuberances (82, 84, 88, and 92). Various techniques are presented for manufacturing the display, including the rough-faced spacer.

182 Claims, 17 Drawing Sheets

OTHER PUBLICATIONS

Rittenmyer et al, "Piezoelectric 3–3 Composites," *Ferroelectrics*, vol. 41, 1982, pp. 189–195.
Saggio–Woyansky et al, "Processing of Porous Ceramics," *American Ceramic Technology Society Bulletin*, Nov. 1992, pp. 1674–1682.
Brinker et al, "Sol–Gel Thin Film Formation," *J. Cer. Soc. Japan, Cent. Mem. Iss.*, vol. 99, No. 10, 1991, pp. 862–877 no month.
Brinker, "Sol–Gel Derived Thin Films: Critical Issues," *Sandia National Laboratories*, Nat'l Tech. Info. Serv., 1986, 26 pages no month.
Croitoru et al, "Effect of Composition and Structure Modification of $SnO_x$ Films on the Electron Secondary Emission," *Thin Solid Films*, vol. 116, 1984, pp. 327–339 no month.
Croitoru et al, "Electrical Conductivity, Physical Density and Secondary Electron Emission of Transparent Conductors," *Thin Solid Films*, vol. 125, 1985, pp. 113–117 no month.
Furneaux et al, "The formation of controlled–porosity membranes from anodically oxidized aluminum," *Letters to Nature*, vol. 337, No. 12, Jan. 1989, pp. 147–149 no month.
Hart, *Organic Chemistry, A Short Course* (6th ed., Houghton Mifflin Co.), 1983, pp. 15–17 no month.
Hench et al, "The Sol–Gel Process," *Chem. Rev.*, vol. 90, No. 1, pp. 33–72 no month.
Ballenende et al, "High–Voltage Stability Coatings in the Zeus Panel," *Philips J. Res.*, vol. 50, No. 314, 1996, pp. 407–419 no month.
Brinker et al, "Review of sol–gel thin film formation," *J. Non–Crystaline Solids*, vols. 147 and 148, 1992, pp. 424–436 no month.
Brinker et al, *Sol–Gel Science: The Physics and Chemistry of Sol–Gel Processing* (Academic Press), 1990, pp. 787–837 no month.
Seiler, "Secondary Electron Emission," *Electron Beam Interactions With Solids*, 1982, pp. 33–42 no month.
Sherman et al, "Refractory Ceramic Foams: A Novel, New High–Temperature Structure," *Ceramic Bulletin*, vol. 70, No. 6, 1991, pp. 1025–1029 no month.
Thomas, "Optical coatings by the sol–gel process," *Optics News*, Aug. 1986, pp. 18–22 no month.
"Work Function & Secondary Emission," *AIP Handbook* (3d ed., McGraw–Hill), 1972, pp. 9–183 no month.

* cited by examiner

FLAT-PANEL DISPLAY HAVING SPACER WITH ROUGH FACE FOR INHIBITING SECONDARY ELECTRON ESCAPE

FIELD OF USE

This invention relates to flat-panel displays of the cathode-ray tube ("CRT") type, including the fabrication of flat-panel CRT displays.

BACKGROUND

A flat-panel CRT display basically consists of an electron-emitting component and a light-emitting component. The electron-emitting component, commonly referred to as a cathode, contains electron-emissive regions that emit electrons over a relatively wide area. The emitted electrons are suitably directed towards light-emissive elements distributed over a corresponding area in the light-emitting component. Upon being struck by the electrons, the light-emissive elements emit light that produces an image on the display's viewing surface.

The electron-emitting and light-emitting components are connected together to form a sealed enclosure normally maintained at a pressure much less than 1 atm. The exterior-to-interior pressure differential across the display is typically in the vicinity of 1 atm. In a flat-panel CRT display of significant viewing area, e.g., at least 10 $cm^2$, the electron-emitting and light-emitting components are normally incapable of resisting the exterior-to-interior pressure differential on their own. Accordingly, a spacer (or support) system is conventionally provided inside the sealed enclosure to prevent air pressure and other external forces from collapsing the display.

The spacer system typically consists of a group of laterally separated spacers positioned so as to not be directly visible on the viewing surface. The presence of the spacer system can adversely affect the flow of electrons through the display. For example, electrons coming from various sources occasionally strike the spacer system, causing it to become electrically charged. The electric potential field in the vicinity of the spacer system changes. The trajectories of electrons emitted by the electron-emitting device are thereby affected, often leading to degradation in the image produced on the viewing surface.

More particularly, electrons that strike a body, such as a spacer system in a flat-panel display, are conventionally referred to as primary electrons. When the body is struck by primary electrons of high energy, e.g., greater than 100 eV, the body normally emits secondary electrons of relatively low energy. More than one secondary electron is, on the average, typically emitted by the body in response to each high-energy primary electron striking the body. Although electrons are often supplied to the body from one or more other sources, the fact that the number of outgoing (secondary) electrons exceeds the number of incoming (primary) electrons commonly results in a net positive charge building up on the body.

It is desirable to reduce the amount of positive charge buildup on a spacer system in a flat-panel CRT display. Jin et al, U.S. Pat. No. 5,598,056, describes one technique for doing so. In Jin et al, each spacer in the display's spacer system is a pillar consisting of multiple layers that extend laterally relative to the electron-emitting and light-emitting components. The layers in each spacer pillar alternate between an electrically insulating layer and an electrically conductive layer. The insulating layers are recessed with respect to the conductive layers so as to form grooves. When secondary electrons are emitted by the spacers in Jin et al, the grooves trap some of the secondary electrons and prevent them from escaping the spacers. Because fewer secondary electrons escape the spacers than what would occur if the grooves were absent, the amount of positive charge buildup on the spacers is reduced.

The technique employed in Jin et al to reduce positive charge buildup is creative. However, the spacers in Jin et al are relatively complex and pose significant concerns in dimensional tolerance and, therefore, in reliability. Manufacturing the spacers in Jin et al could be problemsome. It is desirable to have a relatively simple technique, including a simple spacer design, for reducing charge buildup on a spacer system of a flat-panel CRT display.

GENERAL DISCLOSURE OF THE INVENTION

The present invention furnishes a flat-panel display in which a spacer situated between a pair of plate structures has a rough face. An image is supplied by one of the plate structures in response to electrons provided from the other plate structure. Somewhat similar to what occurs in Jin et al, the roughness in the face of the present spacer prevents some secondary electrons emitted by the spacer from escaping the spacer. Accordingly, positive charge buildup on the spacer is normally reduced. The image is thereby improved.

In particular, secondary electrons emitted by the present spacer as a result of being struck by primary electrons are, on the average, normally of significantly lower energy than the primary electrons. Due to the roughness in the spacer's face, the lower-energy secondary electrons are more prone to impact the spacer and be captured by it than what would occur if the spacer's face were smooth. The lower-energy secondary electrons captured by the spacer cause relatively little further secondary electron emission from the spacer.

Roughness in the face of a body being struck by primary electrons may sometimes itself cause the body to emit an increased number of secondary electrons, especially when the energy of the primary electrons is quite high. This increase in the secondary electron emission is offset by the number of secondary electrons captured by the body due to its facial roughness. In the present flat-panel display, the primary electron energy, while high, is normally sufficiently low that the roughness in the spacer's face leads to a reduction in the overall number of secondary electrons that escape the spacer.

To the extent that the spacer used in the present flat-panel display has multiple levels of spacer material, the levels typically extend vertically relative to the electron-emitting and light-emitting components rather than laterally as in Jin et al. A spacer with vertically extending spacer-material levels is generally simpler in design, and can be fabricated to high tolerances more easily, than a spacer having laterally extending spacer-material levels. When the present spacer has multiple vertically extending levels of spacer material, reliability concerns associated with the spacer design are considerably less severe than those that arise with the spacer design of Jin et al. When the spacer used in the present display has only a single level of spacer material, the display essentially avoids the reliability concerns that arise in Jin et al. The net result is a substantial improvement over Jin et al.

A flat-panel display that employs the teachings of the invention is generally configured in the following way. The display contains a first plate structure, a second plate structure situated opposite the first plate structure, and a spacer situated between the plate structures. The first plate structure emits electrons. The second plate structure emits light to produce an image upon receiving electrons emitted by the first plate structure. The spacer has a rough face that extends at least partway from either plate structure to the other plate structure.

Primary electrons which strike the spacer include electrons that follow trajectories directly from the first plate structure to the spacer as well as electrons that reflect off the second plate structure after having traveled from the first plate structure to the second plate structure. The reflected electrons are generally referred to as "backscattered" electrons. While the flat-panel display can normally be controlled so that only a small fraction of the electrons emitted by the first plate structure directly strike the spacer, the backscattered electrons travel in a broad distribution of directions as they leave the second plate structure. As a result, electron backscattering off the second plate structure is difficult to control direction-wise.

By inhibiting secondary electrons emitted by the present spacer from escaping the spacer, the roughness in the spacer's face also reduces spacer charging that would otherwise result from backscattered primary electrons striking the spacer. In certain embodiments of the present display, the spacer facial roughness is provided with a directional roughness characteristic that enhances the ability of the spacer's rough face to prevent secondary electrons, especially those caused by backscattered primary electrons, from escaping the spacer.

In one aspect of the invention, the present spacer is implemented as a spacer wall. The roughness in the face of the spacer wall is adjustable according to the average strength $E_{AV}$ of the electric field directed from the second plate structure to the first plate structure during operation of the display. The roughness in the wall's face can take various forms such as depressions or/and protuberances. The depressions can, for example, be implemented as pores, trenches, or/and notches. The depressions can be rounded three-dimensionally, typically to have portions of roughly constant radius of curvature. When the wall's face is defined by grains, the depressions can be formed by valleys between adjoining grains. The protuberances can take the form of ridges, particles, pillars, or/and spires.

Regardless of the actual form of the roughness in the face of the spacer wall, the facial roughness can be approximated by identical cylindrical pores of pore diameter $d_p$. The representation of the wall's facial roughness using identical pores ideally has the same total electron yield coefficient that occurs with the actual roughness in the wall's face. In this representation, the wall's facial roughness corresponds to a wall porosity of at least 10% along the wall's face and a pore height $h_p$ of at least 15% of pore height parameter $h_{MD}$. Parameter $h_{MD}$ is given by the following relationship as a function of average electric field strength $E_{AV}$ and pore diameter $d_p$:

$$h_{MD}=\sqrt{2d_p\epsilon_{2DMD}/eE_{AV}}$$

where e is the electron charge, and $\epsilon_{2DMD}$ is the median energy of secondary electrons as they depart from (leave) the spacer wall. By using this relationship, the characteristics of the identical pores that approximate the actual roughness in the wall's face can be suitably adjusted, as electric field strength $E_{AV}$ changes, to reduce the number of secondary electrons that escape the spacer wall.

Magnetic material may be present in the spacer wall along its face. The magnetic material causes the trajectories of secondary electrons emitted by the wall to be altered in a way that further inhibits them from escaping the wall.

In another aspect of the invention, the spacer contains a main spacer body having a rough face. The main body of the spacer is typically shaped like a wall but can have other shapes. The roughness in the main body's face is achieved with pores that extend into the main body along its face. The pores have an average diameter of 1–1,000 nm and provide a porosity of at least 10% along the main body's face.

The main body of the spacer in this aspect of the invention can be internally configured in various ways. As one example, the main body can be implemented simply as a porous electrically non-conductive substrate. The term "electrically non-conductive" here generally means electrically insulating or electrically resistive. A coating may overlie the substrate in a generally conformal manner. With the pores acting to inhibit secondary electrons from escaping the main body, the coating preferably contains material, such as carbon, that itself emits a relatively low level of secondary electrons.

As another example, the main body of the spacer can be implemented with a substrate and a porous layer that overlies the substrate. The porous layer normally has an average electrical resistivity of $10^8$–$10^{14}$ ohm-cm, preferably $10^9$–$10^{13}$ ohm-cm, at 25° C. The porous layer is preferably of at least ten times greater resistance per unit length than the substrate. By implementing the main body in this way, the substrate largely determines the non-emissive electrical characteristics of the main body, while the pores largely determine the secondary electron escape characteristics of the main body. Separating these two types of spacer characteristics in this way makes it easier to design the spacer. A generally conformal coating, which typically emits a relatively low level of secondary electrons, may overlie the porous layer.

Various techniques are suitable for manufacturing the present flat-panel display, especially the spacer, in accordance with the invention. For instance, the spacer can be fabricated by a procedure that entails furnishing a composite in which support material and further material are interspersed with each other. At least of part of the further material is removed from the composite to convert it into a porous body. Depending on whether the porous body is larger than, or of approximately the same size as, the main body of the spacer, part or all of the porous body is utilized as at least part of the spacer.

The support material of the composite may be ceramic, while the further material is organic material consisting of carbon and non-carbon material. The porous body is created by removing at least part of the non-carbon material from the composite. Alternatively, the composite can be a gel or open network of solid material, while the further material is liquid. The porous body is then created by removing at least part of the liquid without causing the support material to completely fill the space previously occupied by the removed liquid.

The composite can be created according to a process in which a liquidous body is formed from a composition of the support material, the further material, and liquid. In the liquidous body, the further material may be in the form of discrete particles, typically roughly spherical in shape. The liquid is removed to transform the liquidous body into a solid composite. Alternatively, a layer of discrete particles can be formed, after which the support material is introduced into spaces between the particles. A layer of support material may also be provided below the particle layer. In either case, at least a portion of the particles are later removed from the solid composite to form the porous body.

In another technique for fabricating the present flat-panel display, an initial face of a primary body is roughened to form a rough face. The primary body may, or may not, be porous (or otherwise facially roughened) prior to the roughening step. The roughening step typically entails etching the primary body. The etching step can be performed in such a way as to impose the above-mentioned directional roughness characteristic on the primary body's face, especially when the initial face of the primary body is defined by grains.

Alternatively, protuberances can be provided over a primary body to furnish the body with a rough face. Regardless of which of the preceding techniques is employed, part or all of the primary body forms at least part of the spacer.

When carbon is employed in the conformal coating that emits secondary electrons at a relatively low level, the carbon can be provided by chemical vapor deposition. The carbon can also be provided by thermally decomposing carbon-containing material over an underlying body that forms at least part of the spacer. This can be done subsequent to forming the underlying body or during an anneal operation used in creating the underlying body.

In short, the rough-faced spacer utilized in the present flat-panel display typically reduces the number of secondary electrons that escape the spacer, thereby reducing positive charge buildup on the spacer. The present spacer is of relatively simple configuration and can be manufactured according to readily controllable manufacturing techniques. The invention thus provides a large advance over the prior art.

BRIEF DESCRIPTION OF THE DRAWINGS

FIGS. 16*a*–6*c* are cross-sectional side views representing a fourth set of steps in manufacturing a main wall, such as that of FIG. 3*f*, for a spacer according to the invention.

Figure 1:
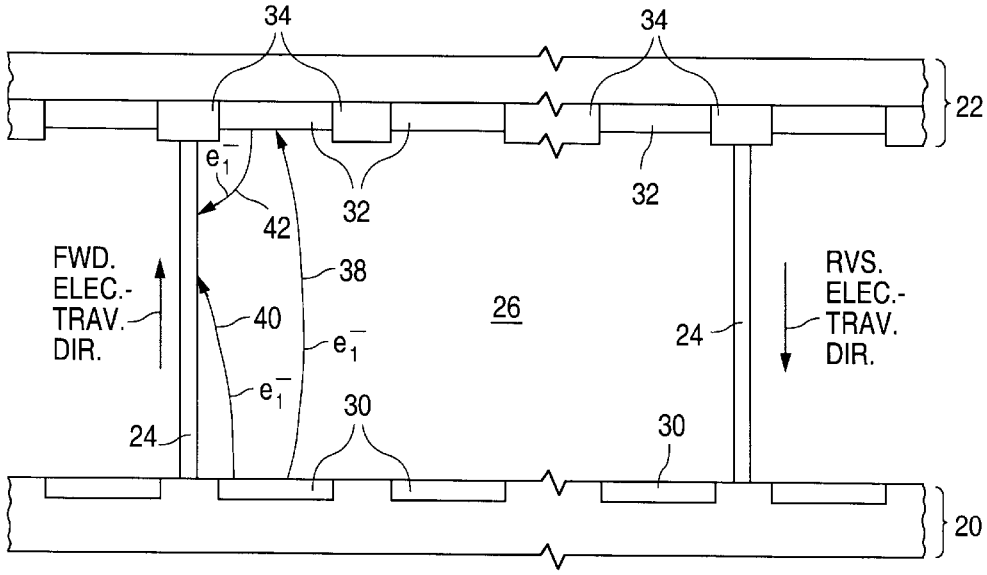
FIG. 1 is a general cross-sectional side view of a flat-panel CRT display having a spacer system configured according to the invention.

The symbol "$e_1^-$" in the drawings represents a primary electron. The symbol "$e_2^-$" in the drawings represents a secondary electron.

Like reference symbols are employed in the drawings and in the description of the preferred embodiments to represent the same, or very similar, item or items.

DESCRIPTION OF THE PREFERRED EMBODIMENTS

General Display Configuration

An internal spacer system for a flat-panel CRT display configured and fabricated according to the invention is formed with spacers that have rough faces for reducing spacer charging during display operation. Primary electron emission in the present flat-panel CRT display typically occurs according to field-emission principles. A field-emission flat-panel CRT display (often referred to as a field-emission display) having a spacer system configured according to the invention can serve as a flat-panel television or a flat-panel video monitor for a personal computer, a lap-top computer, or a workstation.

In the following description, the term "electrically insulating" (or "dielectric") generally applies to materials having an electrical resistivity greater than $10^{12}$ ohm-cm at 25° C. The term "electrically non-insulating" thus refers to materials having an electrical resistivity of up to $10^{12}$ ohm-cm at 25° C. Electrically non-insulating materials are divided into (a) electrically conductive materials for which the electrical resistivity is less than 1 ohm-cm at 25° C. and (b) electrically resistive materials for which the electrical resistivity is in the range of 1 ohm-cm to $10^{12}$ ohm-cm at 25° C. Similarly, the term "electrically non-conductive" refers to materials having an electrical resistivity of at least 1 ohm-cm at 25° C., and includes electrically resistive and electrically insulating materials. These categories are determined at an electric field of no more than 10 volts/$\mu$m.

FIG. 1 illustrates a field-emission display ("FED") configured in accordance with the invention. The FED of FIG. 1 contains an electron-emitting backplate structure 20, a light-emitting faceplate structure 22, and a spacer system situated between plate structures 20 and 22. The spacer system resists external forces exerted on the display and maintains a largely constant spacing between structures 20 and 22.

In the FED of FIG. 1, the spacer system consists of a group of laterally separated largely identical rough-faced spacers 24 generally shaped as relatively flat walls. FIG. 1 is presented at too large a scale to conveniently depict the rough facing of spacer walls 24. The spacer wall facial roughness is pictorially illustrated in certain of the later drawings, starting with FIG. 2. Returning to FIG. 1, each spacer wall 24 extends generally perpendicular to the plane of the figure. Plate structures 20 and 22 are connected together through an annular peripheral outer wall (not shown) to form a high-vacuum sealed enclosure 26 in which spacer walls 24 are situated.

Backplate structure 20 contains an array of rows and columns of laterally separated electron-emissive regions 30 that face enclosure 26. Electron-emissive regions 30 overlie an electrically insulating backplate (not separately shown) of plate structure 20. Each electron-emissive region 30 normally consists of a large number of electron-emissive elements shaped in various ways such as cones, filaments, or randomly shaped particles. Plate structure 20 also includes a system (also not separately shown) for focusing electrons emitted by regions 30.

FIG. 1 depicts a column of electron-emissive regions 30. The row direction extends into the plane of FIG. 1. Each spacer wall 24 contacts backplate structure 20 between a pair of rows of regions 30. Each consecutive pair of walls 24 is separated by multiple rows of regions 30.

Faceplate structure 22 contains an array of rows and columns of laterally separated light-emissive elements 32 formed with light-emissive material such as phosphor. Light-emissive elements 32 overlie a transparent electrically insulating faceplate (not separately shown) of plate structure 22. Each electron-emissive element 32 is situated directly opposite a corresponding one of electron-emissive regions 30. The light emitted by elements 32 forms an image on the display's viewing surface at the exterior surface of faceplate structure 22.

The FED of FIG. 1 may be a black-and-white or color display. Each light-emissive element 32 and corresponding electron-emissive region 30 form a pixel in the black-and-white case, and a sub-pixel in the color case. A color pixel typically consists of three sub-pixels, one for red, another for green, and a third for blue.

A border region 34 of dark, typically black, material laterally surrounds each of light-emissive elements 32 above the faceplate. Border region 34, referred to here as a black matrix, is typically raised relative to light-emissive elements 32. In view of this and to assist in pictorially distinguishing elements 32 from black matrix 34, FIG. 1 illustrates black matrix 34 as extending further towards backplate structure 20 than elements 32. Compared to elements 32, black matrix 34 is substantially non-emissive of light when struck by electrons emitted from regions 30 in backplate structure 20.

In addition to components 32 and 34, faceplate structure 22 contains an anode (not separately shown) situated over or under components 32 and 34. During display operation, the anode is furnished with a potential that attracts electrons to light-emissive elements 32.

During FED operation, electron-emissive regions 30 are controlled to emit primary electrons that selectively move toward faceplate structure 22. The electrons so emitted by each region 30 preferably strike corresponding target light-emissive element 32, causing it to emit light. Item 38 in FIG. 1 represents the trajectory of a typical primary electron traveling from one of regions 30 to corresponding element 32. The forward electron-travel direction is thus from backplate structure 20 to faceplate structure 22 generally parallel to spacer walls 24 and thus generally perpendicular to plate structure 20 or 22.

Some of the primary electrons emitted by each region 30 invariably strike parts of the display other than corresponding target light-emissive element 32. To the extent that the emitted primary electrons are off-target, the control provided by the electron-focusing system and any other electron trajectory-control components of the FED display is normally of such a nature that the large majority of the off-target primary electrons strike black matrix 34. However, off-target primary electrons occasionally follow trajectories directly from an electron-emissive element 30 to nearest spacer wall 24 as represented by electron trajectory 40 in FIG. 1. Such off-target primary electrons that strike spacer walls 24 are often of sufficiently high energy to cause walls 24 to emit secondary electrons.

Also, some of the primary electrons that travel from an electron-emissive region 30 to faceplate structure 22 are scattered backward off plate structure 22 rather than directly causing light emission. The reverse electron-travel direction is from faceplate structure 22 to backplate structure 20 generally parallel to spacer walls 24. While the FED is normally controlled so that the vast majority of primary electrons emitted by each region 30 impact directly on or close to its target light-emissive element 32, electrons scattered backward off faceplate structure 22 move initially in a broad distribution of directions. A substantial fraction of the backscattered electrons strike spacer walls 24. Item 42 in FIG. 1 represents the trajectory of a backscattered primary electron as it travels from a light-emissive element 32 to nearest spacer wall 24. Backscattered primary electrons that strike spacer walls 24 are normally of sufficiently high energy to cause walls 24 to emit secondary electrons. Some of the backscattered electrons return to faceplate structure 22 and cause light emission or are further backscattered.

Figure 2:
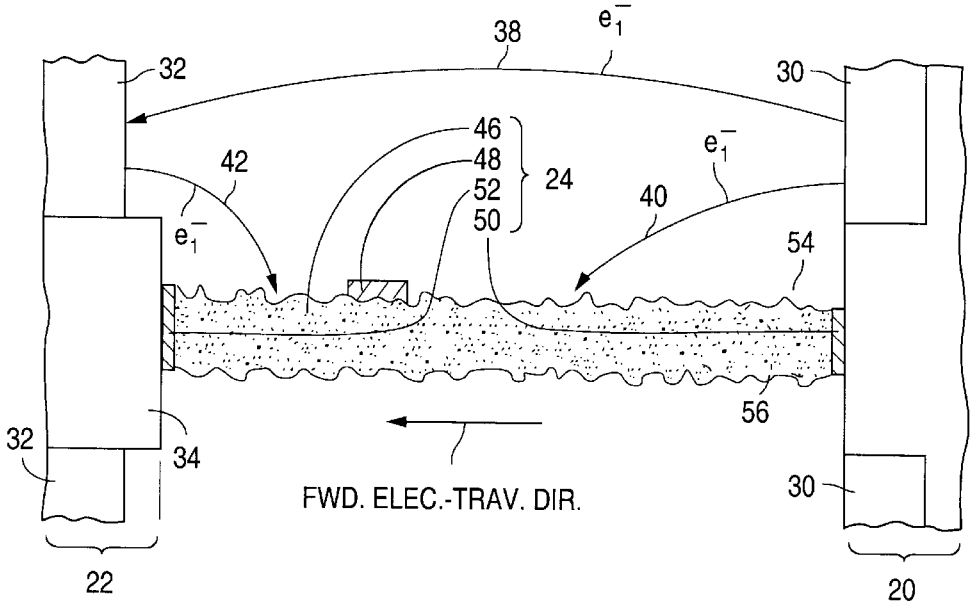
FIG. 2 is an exploded cross-sectional view of a portion of the flat-panel display of FIG. 1 centered around one of the wall-shaped spacers in the spacer system.

FIG. 2 presents an exploded view of one spacer wall 24, including adjoining portions of plate structures 20 and 22. The cross section of FIG. 2 is rotated 90° C. counterclockwise to that of FIG. 1. With reference to FIG. 2, each spacer wall 24 consists of a rough-faced generally wall-shaped electrically non-conductive main spacer body 46 and one or more adjoining electrically non-insulating spacer wall electrodes represented here as electrodes 48, 50, and 52. Although FIG. 2 illustrates main spacer wall 46 as fully underlying spacer electrodes 48, 50, and 52, one or more thin portions of main wall 46 may partially or fully overlie one or more of electrodes 48, 50, and 52.

Main wall 46 has a pair of opposing rough faces 54 and 56. The roughness in main wall faces 54 and 56 is typically present along largely all of each face 54 or 56. Also, the facial roughness is shown qualitatively in FIG. 2. Specific examples of the roughness in faces 54 and 56 are presented below in connection with FIGS. 3*a*–3*l* and 4*a*–4*g*.

Some of the primary electrons that strike a spacer wall 24 occasionally hit electrodes 48, 50, and 52, primarily electrode 48. However, as represented in FIG. 2 where electron trajectories 40 and 42 terminate on rough face 54, the large majority of these primary electrons strike face 54 or 56.

Spacer wall electrodes 48, 50, and 52 preferably consist of electrically conductive material, typically metal such as aluminum, chromium, nickel, or gold, including a metallic alloy such as a nickel-vanadium alloy, or a combination of two or more of these metals. In any event, electrodes 48, 50, and 52 are of considerably lower average electrical resistivity than main wall 46. Electrode 48 is a face electrode situated on wall face 54. Another such face electrode (not shown) may be situated on wall face 56 opposite face electrode 48. Electrodes 50 and 52 are end (or edge) electrodes situated on opposite ends (or edges) of main wall 46 so as to respectively contact plate structures 20 and 22.

Wall electrodes 48, 50, and 52 cooperate with the electron-focusing system in controlling the movement of electrons from backplate structure 20 through sealed enclosure 26 to faceplate structure 22. Further examples of how spacer wall electrodes, such as electrodes 48, 50, and 52, function to control the forward electron movement are presented in Spindt et al, U.S. patent application Ser. No. 09/008,129, filed Jan. 16, 1998, now U.S. Pat. No. 6,049,165, and Spindt et al, U.S. patent application Ser. No. 09/053,247, filed Mar. 31, 1998, now U.S. Pat. No. 6,107,731. The contents of application Ser. Nos. 09/008,129 and 09/053,247 are incorporated by reference herein. Alternative implementations for electrodes 48, 50, and 52 are also presented in application Ser. Nos. 09/008,129 and 09/053,247.

Types of Spacer Facial Roughness

FIGS. 3*a*–3*l* present twelve cross-sectional examples of how the roughness in spacer wall faces 54 and 56 is achieved. Each of FIGS. 3*a*–3*l* specifically depicts a portion of main wall 46 along face 54 at a location spaced apart from wall electrodes 48, 50, and 52. FIGS. 4*a*–4*g* illustrate plan views of the cross sections in FIGS. 3*a*, 3*d*, and 3*g*–3*l*.

The spacer facial roughness can be achieved in two basic ways: (a) depressions in main wall 46 along faces 54 and 56 and (b) protuberances, i.e., raised portions, of wall 46 along faces 54 and 56. In most of FIGS. 3*a*–3*j* and 4*a*–4*g*, the spacer facial roughness can be clearly classified as either depressions or protuberances. The dividing line between depressions and protuberances is somewhat hazy in certain cases, e.g., between FIGS. 3*h* and 4*d*, on one hand, and FIGS. 3*a* and 4*e*, on the other hand. In such cases, depressions and protuberances are essentially alternative ways of describing the same phenomenon. With this in mind, FIGS. 3*a*–3*h* and 4*a*–4*d* illustrate depression examples of the spacer facial roughness. FIGS. 3*a*–3*l* and 4*e*–4*g* illustrate protuberance examples of the spacer facial roughness.

One general type of depressions can be characterized as pores. See FIGS. 3*a* and 4*a*, 3*b*, and 3*c*. The characteristics and arrangement of the pores can be quite regular as in FIGS. 3*a* and 4*a*, or considerably varied as in FIGS. 3*b* and 3*c*. In either case, the pores inhibit secondary electrons emitted by main spacer wall 46 from escaping wall 46.

Figure 3A:
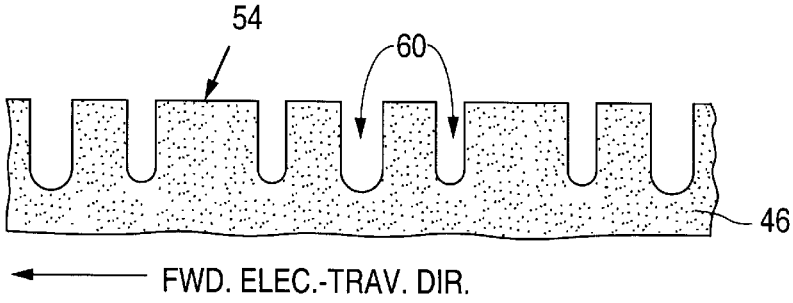
FIGS. 3*a*–3*l* are cross-sectional side views of facial portions of twelve general variations of the spacer wall in the display portion of FIG. 2.
Figure 4A:
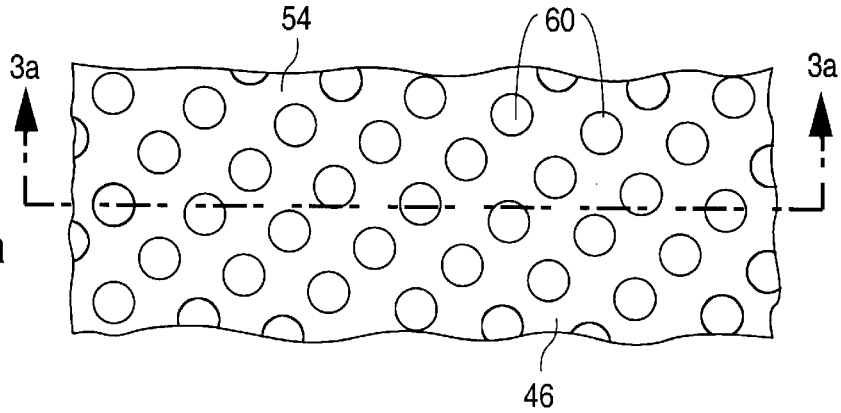
FIGS. 4*a*–4*g* are plan views of the facial wall portions in FIGS. 3*a*, 3*d*, and 3*g*–3*k*. The cross sections of FIGS. 3*a*, 3*d*, and 3*g*–3*k* are respectively taken through planes 3*a*—3*a*, 3*d*—3*d*, 3*g*—3*g*, 3*h*—3*h*, 3*i*—3*i*, 3*j*—3*j*, and 3*k*—3*k* *in FIGS. 4a–4g.*

In FIGS. 3*a* and 4*a*, generally straight pores 60 are present along face 54 of main wall 46. Pores 60 extend generally parallel to one another and approximately perpendicular to an imaginary plane (not shown) extending generally along wall face 54. In addition, pores 60 are quite similar to one another. They are all cylindrical, of approximately the same diameter, and extend to approximately the same depth into wall 46. As indicated in FIG. 4*a*, pores 60 are distributed across face 54 in a relatively regular pattern.

Figure 3B:
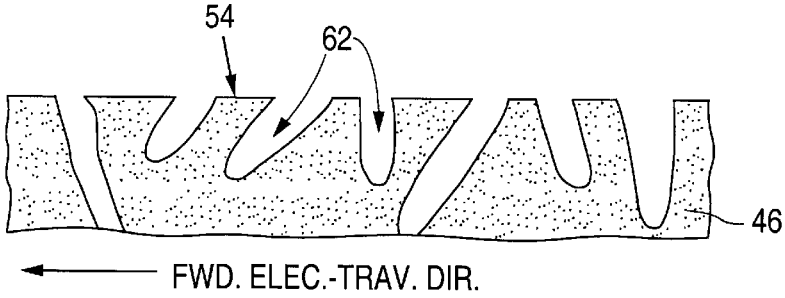

FIG. 3*b* presents an example in which generally straight pores 62 are present along wall face 54. In contrast to FIGS. 3*a* and 4*a*, pores 62 extend into main wall 46 to various depths and at various angles relative to an imaginary plane (not shown) running generally along face 54. Some of pores 62 may intersect one another below face 54. Also, some of pores 62 may lie fully below face 54. Although FIG. 3*b* depicts pores 62 as being of roughly the same diameter, the diameters of pore 62 can vary considerably. Pores 62 are situated at generally random locations along face 54.

Figure 3C:
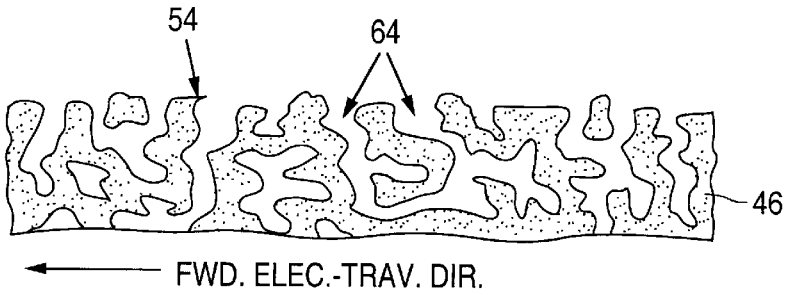

In FIG. 3*c*, main wall 46 has irregular pores 64, some of which are present along wall face 54. Pores 64 are of various shapes and sizes. Many of pores 64 intersect one another below an imaginary plane (not shown) running along the top of face 54. Some of pores 64 do not reach face 54. Pores 64 are distributed in a generally random manner along face 54 and in the underlying material of wall 46. In general, pores 64 are similar to pores in a sponge.

The term "porosity" is employed here in characterizing rough faces 54 and 56 of main wall 46. Porosity results from openings that are shaped like pores as well as other types of openings. The volume porosity of a porous body is the percentage of the body's volume occupied by the pores or/and other openings in the porous body. The porosity of wall 46 along face 54 or 56, variously referred to here as the main wall facial porosity or as the main wall porosity along face 54 or 56, is therefore the percentage of area occupied by the pores or other openings along an imaginary plane running generally through face 54 or 56 along the tops of the openings. If the pores or other openings along face 54 or 56 are of such a nature that this definition of main wall facial porosity is inappropriate or difficult to apply, the main wall porosity along face 54 or 56 is equivalently the percentage of area occupied by the openings along an imaginary smooth reference surface located a short reference distance below an imaginary plane running generally through face 54 or 56 along the tops of the openings. When the spacer facial roughness is formed by depressions, the reference distance is typically one half the average depression depth.

Main wall 46 normally has a porosity of at least 10% along each of wall faces 54 and 56. The minimum main wall facial porosity of 10% applies to pores 60, 62, and 64 and to other implementations of pores along face 54 or 56. The main wall porosity along face 54 or 56 is preferably at least 20%, more preferably at least 40%. The main wall facial porosity is typically 60% or more, often up to 80% or more. In some embodiments, especially when main wall 46 contains irregular pores such as pores 64 in FIG. 3*c*, the main wall porosity along face 54 or 56 can reach 90% or more.

The pores, whether implemented with any of pores 60, 62, and 64 or/and implemented in other ways, normally have an average pore diameter in the range of 1–1,000 nm. The average pore diameter subranges of 1–20 nm and 5–1,000 nm are of particular interest. When main wall 46 is provided with pores 60 in FIGS. 3*a* and 4*a* using anodic oxidation of metal, typically aluminum, to form pores 60, an average pore diameter of 1–20 nm, typically 10 nm, can readily be obtained. The average pore diameter subrange of 5–1,000 nm is particularly appropriate when main wall 46 is like a sponge having pores 64 in FIG. 3*c*.

Figure 3D:
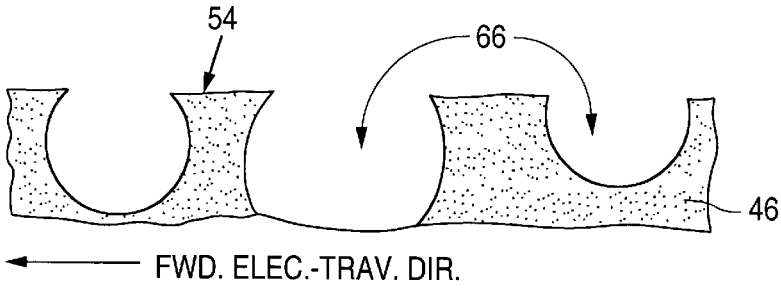
Figure 4B:
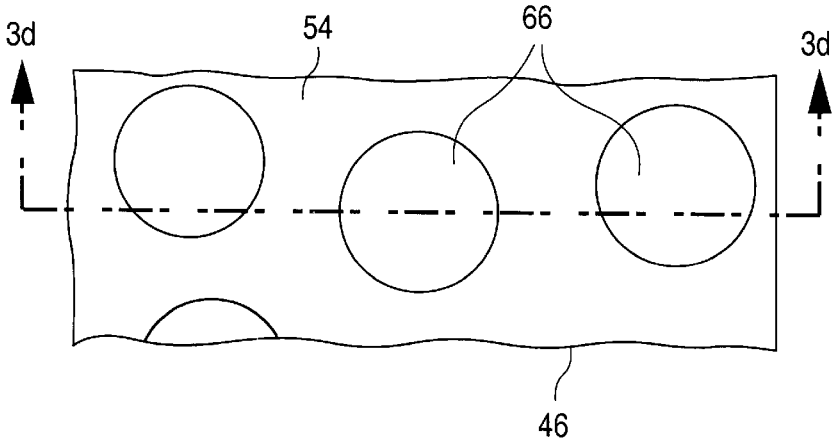

FIGS. 3*d* and 4*b* depict an embodiment in which the depressions in main wall 46 are implemented with three-dimensionally rounded recessions 66 along wall face 54.

The large majority of rounded recessions 66 have portions of roughly constant radius of curvature. In particular, each such recession 66 is generally shaped roughly like at least one open sphere with part of its volume cut off. The average diameter of recessions 66 is normally 10–1,000 nm, preferably 50–500 nm, typically 150 nm. Recessions 66 may be viewed as pores of generally low height-to-width aspect ratio. In light of this, main wall 46 in FIGS. 3*d* and 4*b* has the same spacer facial porosity characteristics as in the earlier-described embodiments of wall 46.

Rounded recessions 66 are formed with only a monolayer of open spheres in the example of FIG. 3*d*. Alternatively, recessions 66 may be formed with more than a monolayer of open spheres. In that case, lower open spheres variously connect to upper open spheres. An example of the more-than-a-monolayer case is presented below in connection with the fabrication process sequence of FIGS. 15*a*–15*f*.

Figure 3E:
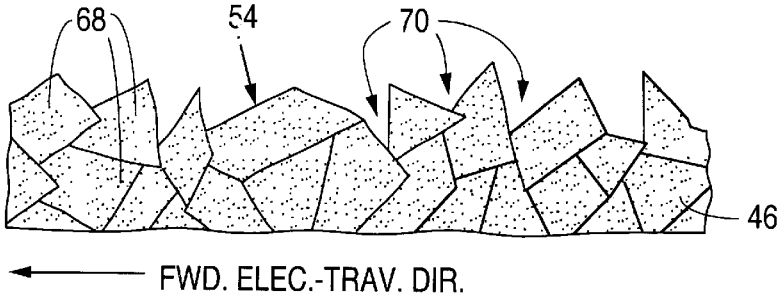

In FIG. 3*e*, main wall 46 is a relatively grainy structure, at least along face 54. The grainy structure consists of grains 68. Face 54 is formed with the outer, i.e., exposed, surfaces of outer ones of grain 68. The depressions in face 54 consists of valleys 70 formed by intersecting outer grain surfaces of adjoining ones of outer grains 68. Along face 54, grains 68 have an average diameter of 2–10 $\mu$m. Using the second-mentioned approach for determining main wall facial porosity with the reference distance being approximately one half the average depth of valleys 70, the main wall porosity along face 54 is in the vicinity of 70–80%.

Figure 3F:
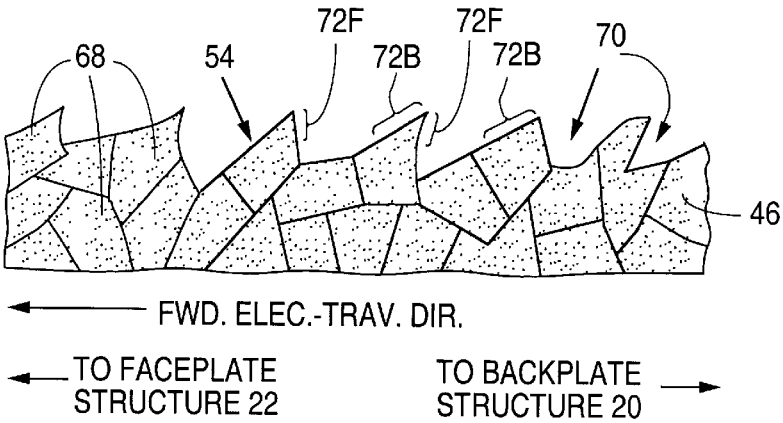

FIG. 3*f* depicts a variation of main wall 46 in FIG. 3*e* for which the outer surfaces of outer grains 68 are configured to provide face 54 with a directional roughness characteristic which improves the ability to prevent secondary electrons from escaping wall 46. The directional roughness characteristic is implemented by appropriately tailoring the steepness of the outer grain surfaces that form face 54. In particular, the outer grain surfaces that form each valley 70 can be divided into two portions, one portion closest to backplate structure 20, and the other portion closest to faceplate structure 22. The two portions of the outer grain surfaces of each valley 70 are continuous with each other outside the plane of FIG. 3*f*. For each valley 70, item 72B is the upper half of the outer grain surface portion closest to backplate surface 20, while item 72F is the upper half of the outer grain surface portion closest to faceplate structure 22.

The directional roughness characteristic along face 54 in FIG. 3*f* entails having outer-grain upper-half surfaces 72F be, on the average, steeper than outer-grain upper-half surfaces 72B. With reference to the locations of plate structures 20 and 22, the directional roughness characteristic can be expressed by the statement that, along upper halves 72B and 72F of the outer grain surfaces, the outer grain surfaces generally visible from backplate structure 20 are of greater average steepness than the outer grain surfaces generally visible from faceplate structure 22. In the orientation of FIG. 3*f*, backplate structure 20 is situated to the right of the illustrated portion of main wall 46, while faceplate structure 22 is situated to the left of the illustrated portion of wall 46. Consequently, outer-grain upper-half surfaces 72F seen from the location of backplate structure 20 to the right of the illustrated portion of wall 46 are of greater average steepness than outer-grain upper-half surfaces 72B seen from the location of faceplate structure 22 to the left of the illustrated portion of wall 46.

As discussed further below, the electric field in sealed enclosure 26 is directed from faceplate structure 22 to backplate structure 20. Since electrons are negatively charged particles, the electric field in enclosure 26 causes electrons in enclosure 26 to be accelerated towards faceplate structure 22. This applies to both primary electrons and secondary electrons in enclosure 26. Because the electric field attracts electrons towards faceplate structure 22, the directional roughness characteristic causes secondary electrons emitted by main wall 46 to be more prone to strike steepened outer-grain upper-half surfaces 72F and be captured by wall 46 than what would occur in the absence of the directional roughness characteristic. Consequently, a reduced number of secondary electrons normally escape wall 46.

High-energy primary electrons backscattered off faceplate structure 22 slow down due to the electric field in enclosure 26. The reduced speed and correspondingly modified trajectories of these backscattered electrons cause them, on the average, to penetrate deeper into depressions, such as valleys 70, along rough face 54 then high-energy primary electrons that follow trajectories directly from backplate structure 20 to main wall 46. In turn, the deeper penetration of backscattered primary electrons into valleys 70 normally leads to an increase in the fraction of resulting secondary electrons captured by wall 46. Since the ability to capture secondary electrons is enhanced by the directional roughness characteristic provided to face 54 in FIG. 3*f*, the net effect of the directional roughness characteristic is normally to further reduce positive spacer charging due to backscattered primary electrons that strike spacer walls 24.

Figure 3G:
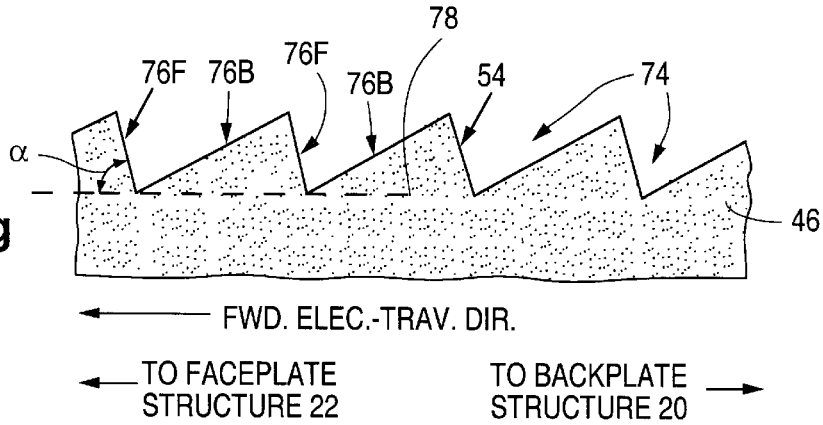
Figure 4C:
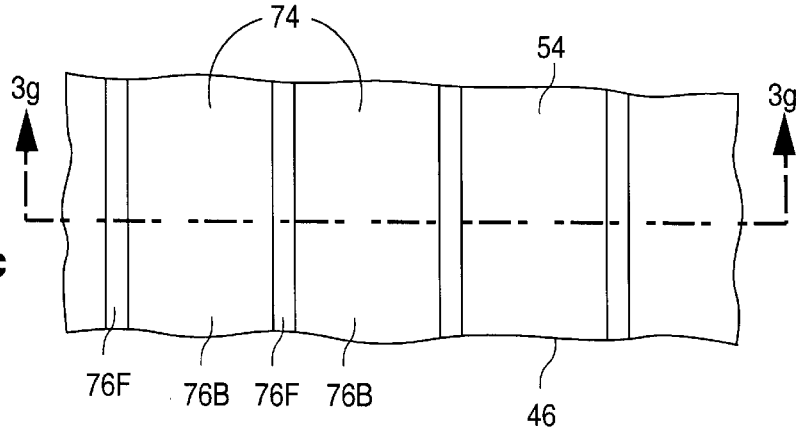

Another way of providing wall face 54 with a directional roughness characteristic that reduces the number of secondary electrons which escape main wall 46 is illustrated in FIGS. 3*g* and 4*c*. The depressions along face 54 are implemented with notches (or serrations) 74 in FIGS. 3*g* and 4*c*. Notches 74 typically adjoin one another. Again using the second-mentioned approach for determining the porosity along face 54 or 56 with the reference distance being approximately one half the average depth of notches 74, the facial porosity of wall 46 in FIGS. 3*g* and 4*c* is in the vicinity of 50%. Alternatively, notches 74 can be variously spaced apart from one another. In this case, the main wall facial porosity is normally less than 50%.

Notches 74 are typically straight and extend approximately parallel to one another, as illustrated in the example of FIG. 4*c*. Notches 74 also typically extend parallel to plate structure 20 or 22. However, notches 74 can be angled relative to structure 20 or 22. If so, the average angle between each notch 74 and structure 20 or 22 is normally no more than 45° . When at least part of notches 74 are laterally separated from one another, notches 74 can variously extend at angles relative to one another. In addition, notches 74 can be curved in various ways.

In the example of FIGS. 3*g* and 4*c*, notches 74 are illustrated as being largely identical. Alternatively, notches 74 can vary in shape from one to another. For example, notches 74 can extend to different depths into main wall 46 or/and be of different widths. Each notch 74 extends fully across the portion of wall 46 shown in FIG. 4*c*. However, each notch 74 need not extend fully across the dimension of wall 46 perpendicular to the plane of FIG. 3*g*. Two or more laterally separated notches can replace a notch 74 that extends fully across wall 46.

Each notch 74 is defined by a pair of notch surfaces 76B and 76F along face 54. For notch surfaces 76B and 76F of each notch 74, surface 76B is closest to backplate structure 20, while surface 76F is closest to faceplate structure 22. Although notch surfaces 76B and 76F are illustrated as generally being flat in the profile of FIG. 3*g*, surfaces 76B and 76F can be curved somewhat.

The directional roughness characteristic in FIGS. 3*g* and 4*c* is achieved by having notch surface 76F of each notch 74 be locally steeper than notch surface 76B of that notch 74 along an imaginary plane, such as plane 3*g*–3*g* in FIG. 4*c*, extending generally perpendicular to plate structure 20 or 22 and thus also extending generally perpendicular to face 54. For the illustrated example in which notches 74 extend approximately parallel to either structure 20 or 22 (and thus approximately parallel to one another) and in which notch surfaces 74B and 74F are largely flat, this simplifies to the statement that notch surface 74F is steeper than notch surface 74B.

Each notch surface 76F is at an angle $\alpha$ to an imaginary plane 78 extending generally parallel to wall face 54. Plane 78 is indicated in dashed line in FIG. 3*g*. Angle $\alpha$ is normally in the range of 50–100°, typically 90°. An a value greater than 90° C. means that notch surface 76F is tilted in the reverse manner from the exemplary tilt illustrated in FIG. 3*g*, i.e., that notch surface 76F is slanted from lower left to upper right. Notches 74 typically have an average width (measured horizontally in FIG. 3*g* or 4*c*) of 5–100 $\mu$m and an average depth of 0.5–10 $\mu$m.

The directional roughness characteristic for wall face 54 in FIGS. 3*g* and 4*c* functions in largely the same manner as the directional roughness characteristic for face 54 in FIG. 3*f*. In FIGS. 3*g* and 4*c*, the directional roughness characteristic causes secondary electrons emitted by main wall 46 to be more prone to strike notch surfaces 76F than what would occur if notch surfaces 76F and 76B were of the same steepness. The number of secondary electrons that escape main wall 46 is thereby normally reduced. As with valleys 70 in FIG. 3*f*, primary electrons scattered backward off faceplate structure 22 penetrate deeper into notches 74 than primary electrons that travel directly from backplate structure 20 to wall 46. The directional roughness characteristic provided to face 54 in FIGS. 3*g* and 4*c* thus particularly alleviates positive-charge buildup on spacer wall 24 due to electron backscattering off faceplate structure 22.

Figure 3H:
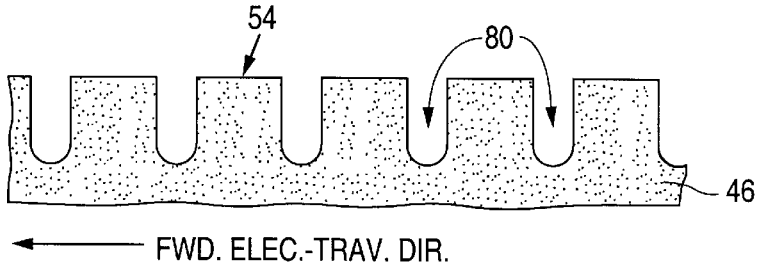
Figure 4D:
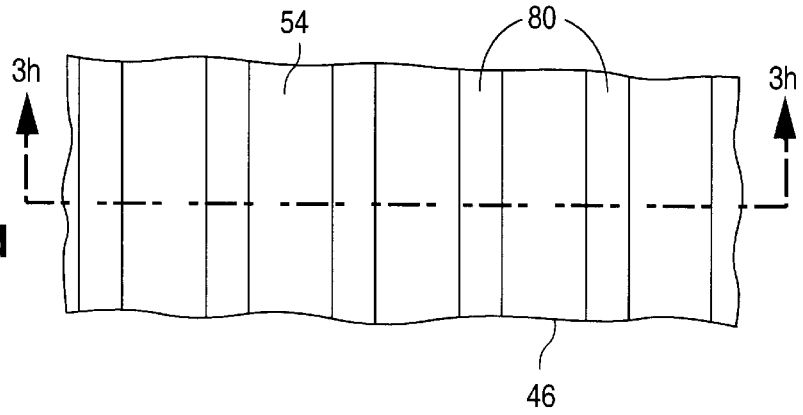
Figure 3I:
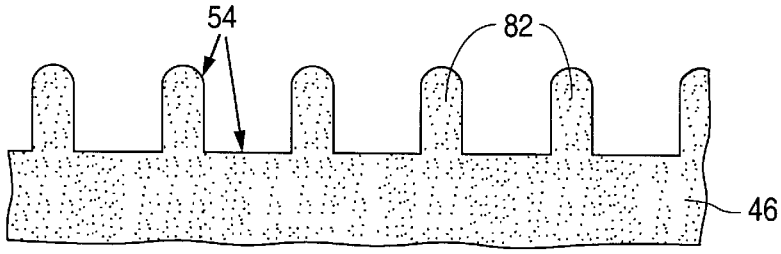

In FIGS. 3*h* and 4*d*, the depressions in main wall 46 consists of trenches 80 along wall face 54. Each trench 80 is of considerably greater, normally at least two times greater, length (measured vertically in FIG. 4*d*) than width (measured horizontally in FIG. 3*h* or 4*d*). The main wall facial porosity that results from trenches 80 is determined using the approach first mentioned above. Similar to the porosity that arises when the depressions are pores, the main wall porosity along face 54 in FIGS. 3*h* and 4*d* is normally at least 10%, preferably at least 20%, and more preferably at least 40%. As discussed further below, a trenched spacer-wall structure is considered to be a ridged structure when the main wall facial porosity becomes greater than approximately 50%.

Similar to notches 74, trenches 80 are typically straight and extend approximately parallel to one another. Likewise, trenches 80 also typically extend approximately parallel to plate structure 20 or 22. However, trenches 80 can be angled relative to structure 20 or 22. The angle between each trench 80 and structure 20 or 22 is normally no more than 15°. In addition, trenches 80 can be angled relative to each other or/and curved in various ways. Trenches 80 can also variously intersect one another. For example, trenches 80 can be configured in an array of rows and columns.

Trenches 80 are depicted as being largely identical in the example of FIGS. 3*h* and 4*d*. Again similar to notches 74, trenches 80 can vary in shape from one to the other. Specifically, trenches 80 can extend to different depths into main wall 46 or/and be of different widths. Although each trench 80 extends fully across the portion of main wall 46 depicted in FIG. 4*d*, each trench 80 need not extend fully across the dimension of wall 46 perpendicular to the plane of FIG. 3*h*. For example, two or more laterally separated trenches can replace a trench 80 that extends fully across wall 46.

Trenches 80 are depicted as being largely identical in the example of FIGS. 3*h* and 4*d*. Again similar to notches 74, trenches 80 can vary in shape from one to the other. Specifically, trenches 80 can extend to different depths into main wall 46 or/and be of different widths. Although each trench 80 extends fully across the portion of main wall 46 depicted in FIG. 4*d*, each trench 80 need not extend fully across the dimension of wall 46 perpendicular to the plane of FIG. 3*h*. For example, two or more laterally separated trenches can replace a trench 80 that extends fully across wall 46.

Figure 4E:
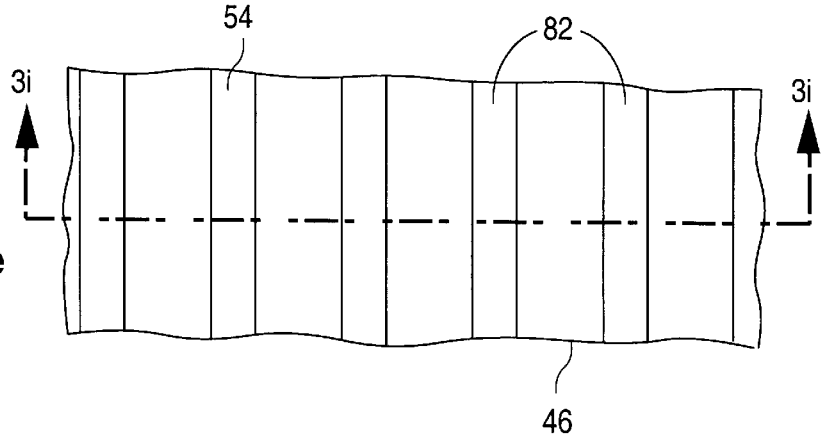

FIGS. 3*a* and 4*e* illustrate the first of four examples in which the spacer facial roughness is achieved with protuberances along wall face 54. In FIGS. 3*a* and 4*e*, the protuberances are implemented with electrically non-conductive ridges 82 along face 54. Each ridge 82 is of considerably greater, normally at least two times greater, length (measured vertically in FIG. 4*e*) than width (measured horizontally in FIG. 3*a* or 4*e*).

Ridges 82 can be created (a) according to a procedure that entails removing material from a precursor to main wall 46 at the locations between the desired locations for ridges 82 or (b) according to procedure that entails depositing electrically non-conductive material on a generally flat portion of wall 46 at the desired locations for ridges 82. Aside from the fact that creating ridges 82 according to the second-mentioned procedure may result in ridges 82 consisting of material totally different from the material underlying ridges 82, ridges 82 are essentially the complement of trenches 80 in FIGS. 3*h* and 4*d*. All the trench-configuration remarks made above about trenches 80 apply in reverse to ridges 82.

In particular, ridges 82 can be straight and extend approximately parallel to each other and to plate structure 20 or 22. Alternatively, ridges 82 can variously extend at angles relative to one another or/and can be variously curved. Ridges 82 can also variously intersect one another, e.g., to form an array of rows and columns. Ridges 82 can be largely identical to, or variously different from, one another.

As the average width of ridges 82 increases relative to the average spacing between consecutive ones of ridges 82 in the example of FIGS. 3*a* and 4*e*, the ridged spacer-wall structure transforms into the trenched structure of FIGS. 3*h* and 4*d*. This transformation is considered to occur when the average ridge width equals the average ridge-to-ridge spacing. In light of this, the porosity along wall face 54 in FIGS. 3*a* and 4*e* normally has a minimum in the vicinity of 50%. The main wall facial porosity in FIGS. 3*a* and 4*e* is readily adjusted to 60% or more up to at least 80% or more and even up to at least 90%. The main wall porosity along face 54 is determined according to the first-mentioned or second-mentioned approach described above with the spaces between ridges 82 being viewed as openings for determining the spacer facial porosity.

Figure 3J:
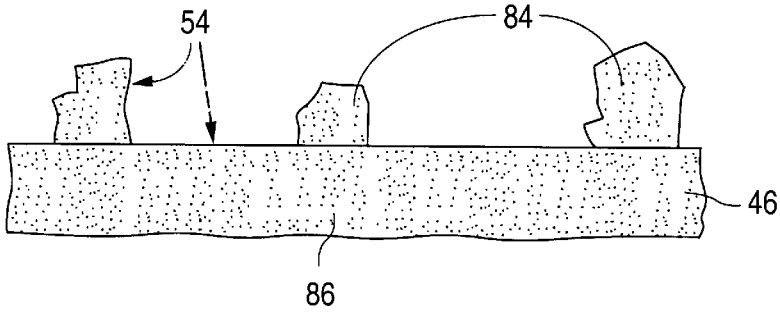
Figure 4F:
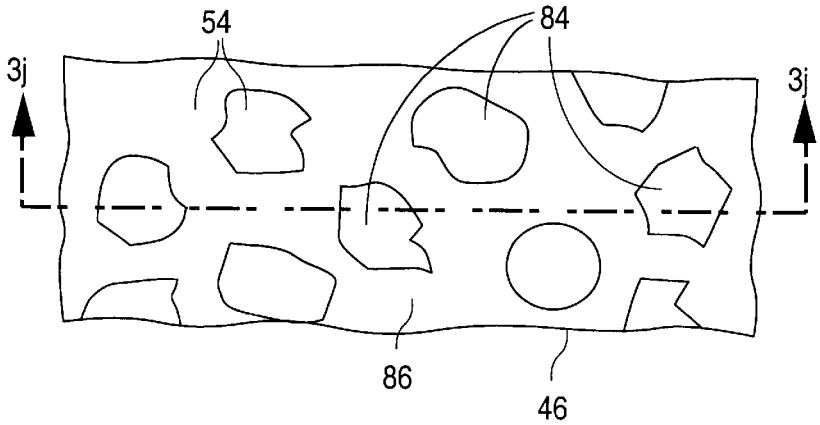

In FIGS. 3*j* and 4*f*, generalized electrically non-conductive protuberances 84 are situated on a smooth, generally flat portion 86 of main wall 46 along rough face 54. Protuberances 84 may have various shapes, as shown in the example of FIGS. 3*j* and 4*f*. Alternatively, protuberances 84 may have largely the same shape. Protuberances 84 are typically located at substantially random locations relative to one another. In a typical implementation, protuberances 84 consist of particles, including coated particles.

Protuberances 84 are typically created according to a procedure that entails providing suitable particles on a generally flat portion 86 of main wall 46, or on a generally flat portion of a precursor to wall 46. While protuberances 84 may consist of largely the same material as that underlying protuberances 84 along flat portion 86, protuberances 84 typically consist primarily of material of different chemical composition than the directly underlying material.

The space between protuberances 84 is considered to be an opening for determining the main wall facial porosity. With this in mind, the main wall porosity along face 54 in FIGS. 3*j* and 4*f* is determined according to the second approach mentioned above with the reference distance being approximately one half the average height of protuberances 84 above flat portion 86. The main wall facial porosity in FIGS. 3*j* and 4*f* can be readily adjusted from as little as 10% to 90% or more.

Figure 3K:
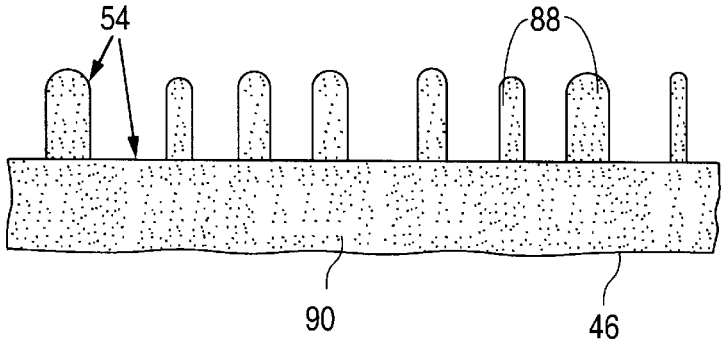
Figure 4G:
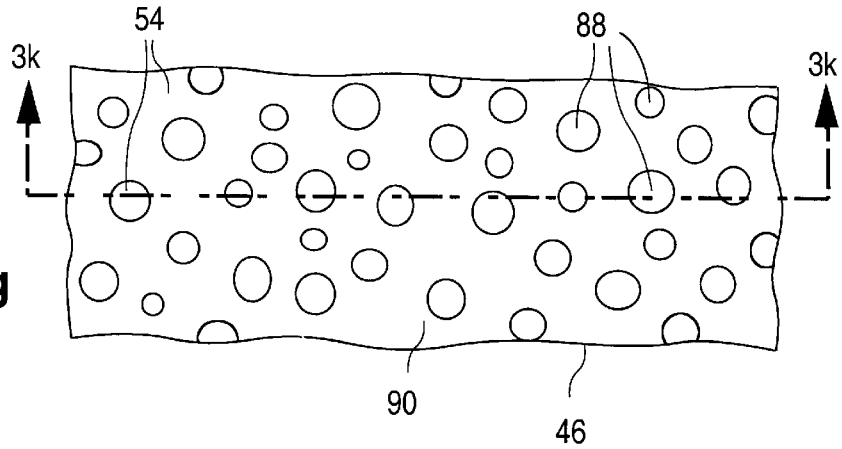

FIGS. 3*k* and 4*g* depict an embodiment in which the protuberances in main wall 46 are formed with pillars 88 situated on a smooth, generally flat portion 90 of wall 46. Pillars 88 are normally situated at largely random locations relative to one another and extend approximately perpendicular to the upper surface of flat wall portion 90. Each pillar 88 is normally roughly cylindrical in shape along most of its height. That is, as viewed vertically (perpendicular to the upper surface of wall portion 90), each pillar 88 is normally of approximately constant cross section along most of its height. The heights of pillars 88 are normally relatively uniform from one pillar 88 to another.

The cross section of each pillar 88 is typically roughly circular as viewed vertically but can be shaped differently. The diameters of pillars 88 can be roughly the same from one pillar 88 to another pillar 88, or can vary somewhat from one pillar 88 to another. The variation in the diameters of pillars 88 is typically comparable to the variation in their heights. FIG. 4*g* illustrates an example in which pillars 88 are roughly circular in cross section as viewed vertically and in which there is approximately a two-fold variation in pillar diameter.

Similar to what was said about protuberances 84 in FIGS. 3*j* and 4*f*, the space between pillars 88 is considered to be an opening for determining the main wall porosity along face 54. The main wall facial porosity in FIGS. 3*k* and 4*g* is determined according to the second of the above-mentioned approaches with the reference distance being a small-to-large fraction of the average height of pillars 88, typically one half their average height. As in the protuberant embodiment of FIGS. 3*j* and 4*f*, the main wall facial porosity in FIGS. 3*k* and 4*g* can be readily adjusted from 10% to 90% or more.

Figure 3L:
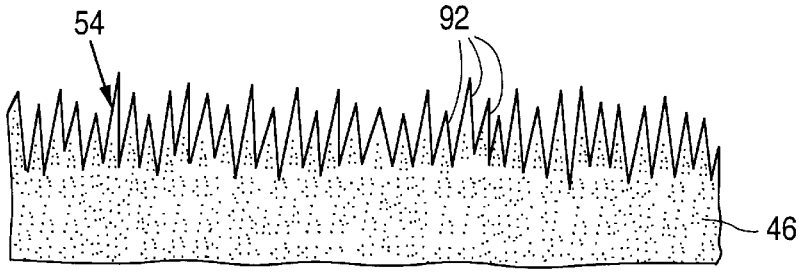

In FIG. 31, microscopic peaks 92 generally shaped like spires form the protuberances in main wall 46. Spires 92 are located randomly relative to one another and normally extend approximately perpendicular to an imaginary plane (not shown) running approximately along the spire tips. Spires 92 typically largely adjoin one another along their bottoms, as depicted in FIG. 3*l*, but can be spaced apart.

The aspect ratio of height to average diameter of spires 92 is typically in the vicinity of 2–10. The heights of spires 92 vary somewhat from one spire 92 to another. The same applies to the locations of the bottoms of spires 92. FIG. 3*l* illustrates an example in which spires 92 are sharply pointed. The tips of spires 92 can also be somewhat blunted.

The space that separates spires 92 above their bottoms is considered to be an opening for determining the main wall facial porosity. Using the second approach mentioned above for determining the main wall facial porosity with the reference distance being approximately one half the average height of spires 92, the main wall porosity along face 54 in FIG. 3*l* is typically in the vicinity of 70–80% when spires 92 adjoin one another along their bottoms. Somewhat similar to grains 68 in FIG. 3*e* or 3*f*, the space between spires 92 can also be viewed as valleys. The structure of FIG. 3*l* can thus alternatively be classified with the examples in which the main wall facial porosity results from depressions.

The fraction of secondary electrons captured by main wall 46 may sometimes be increased when two or more of the types of wall roughness shown in FIGS. 3*a*–3*l* and 4*a*–4*g* are utilized in different parts of wall 46. The fraction of captured secondary electrons may also increase when two or more of these types of wall roughness are employed in the same part of wall 46. As one example, pores, especially irregular pores 64, could be utilized with trenches 80 or ridges 82. In any event, the preceding types of spacer wall roughness can be combined in various ways.

Effect of Facial Roughness on Electron Escape

Figure 5:
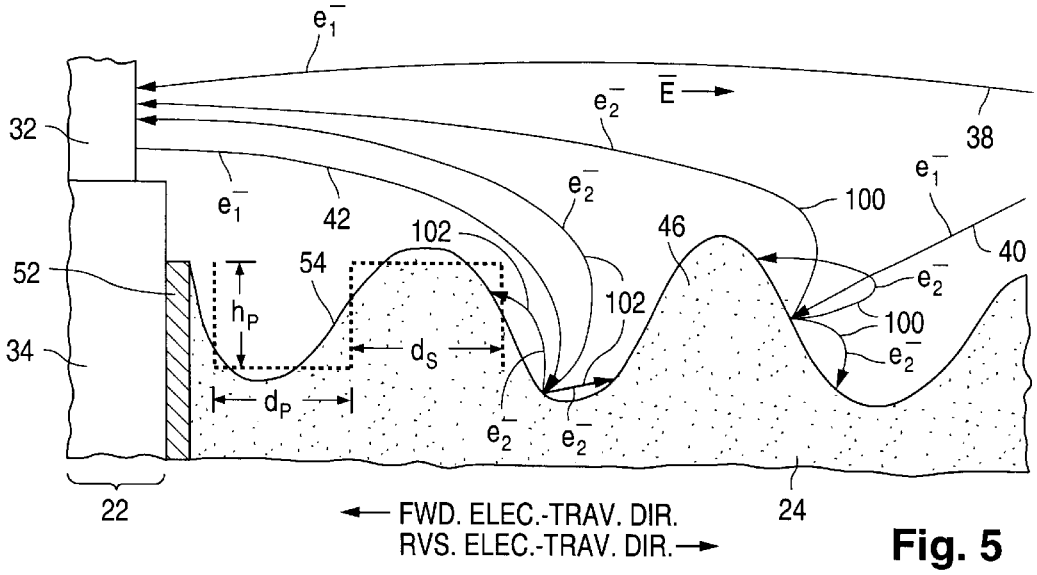
FIG. 5 is a cross-sectional view of a section of the display portion in FIG. 2.
Figure 6:
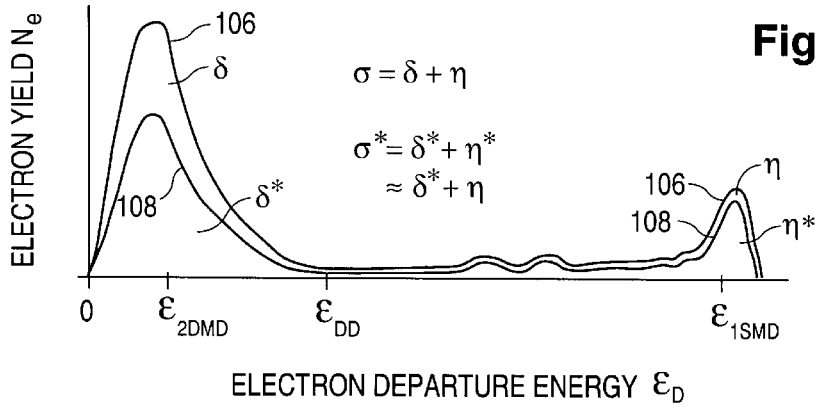
FIG. 6 is a general graph of electron yield as a function of electron departure energy, largely secondary-electron departure energy, for a spacer wall in the spacer system of the flat-panel display in FIG. 1

An understanding of how the roughness in wall faces 54 and 56 reduces the fraction, and normally the number, of secondary electrons that escape main spacer wall 46 is facilitated with the assistance of FIGS. 5 and 6. FIG. 5 depicts a portion of spacer wall 24 along face 54, and an adjoining portion of faceplate structure 22. The roughness in face 54 is depicted qualitatively in FIG. 5 in order to represent various types of spacer facial roughness. The recessed areas along face 54 in FIG. 5 represent, for example, the depressions along face 54 in FIGS. 3*a*–3*h* or the areas between the protuberances along face 54 in FIGS. 3*a*–3*l*. FIG. 6 illustrates how the number of electrons that escape a surface upon being struck by high-energy primary electrons of median striking (incident) energy $\epsilon_{1SMD}$ varies with the energy $\epsilon_D$ of the escaping electrons just as they depart from the surface. The number of electrons that escape a unit area of a smooth surface, or a projected unit area of a rough surface, at any value of electron departure energy $\epsilon_D$ is the electron yield $N_e$. The vast majority of the electrons that escape such a surface are secondary electrons. Consequently, electron departure energy $\epsilon_D$ is largely the departure energy of the escaping secondary electrons.

Referring to FIG. 5, secondary electrons are emitted by main wall 46 upon being struck by high-energy primary electrons traveling directly from backplate structure 20, as represented by electron trajectory 40, and by high-energy primary electrons backscattered off faceplate structure 22, as represented by electron trajectory 42, after traveling from backplate structure 20 to faceplate structure 22. In FIG. 5, primary electron trajectories 40 and 42 terminate at recessed points along wall face 54.

Items 100 in FIG. 5 indicate examples of trajectories followed by secondary electrons emitted from one recessed point along rough face 54 when main wall 46 is struck by a primary electron that follows trajectory 40 to that recessed point. Items 102 indicate examples of trajectories followed by secondary electrons emitted from a second recessed point along face 54 when wall 46 is struck by a primary electron following trajectory 42 to the second recessed point. As indicated by multiple secondary electron trajectories 100 or 102 for each primary electron trajectory 40 or 42, the number of secondary electrons caused by each primary electron typically averages more than one.

An electric field $\overline{E}$ of average strength $E_{AV}$ is directed generally from faceplate structure 22 to backplate structure 20. Electric field $\overline{E}$ is the principal force that acts on secondary electrons emitted by main wall 46. To a first approximation, trajectories 100 and 102 followed by the secondary electrons are roughly parabolic, at least in the immediate vicinity of wall 46. Since electrons are negatively charged, trajectories 100 and 102 bend towards faceplate structure 22 as electric field $\overline{E}$ causes the secondary electrons to be accelerated towards faceplate structure 22.

The initial directions of secondary electrons that follow trajectories such as trajectories 100 and 102 are largely random. Some of the secondary electrons rapidly strike other recessed points along wall face 54. Other secondary electrons strike recessed points along wall 54 after their trajectories 100 or/and 102 bend significantly towards faceplate structure 22. Yet other secondary electrons escape spacer wall 24 and follow trajectories 100 and 102 towards faceplate structure 22.

A large majority of the electrons that return to main wall 46 impact wall 46 close to where they were emitted from wall 46 and therefore are of relatively low energy at impact. Consequently, these secondary electrons are largely captured by wall 46. Because their energy is relatively low at impact, they also do not cause significant further secondary electron emission from wall 46.

Whether a secondary electron is captured by, or escapes from, main wall 46 depends on a number of factors, including (a) the secondary electron's emission departure direction, (b) departure energy $\epsilon_{2D}$ and thus the departure speed of the secondary electron, (c) where the primary electron strikes wall face 54 and therefore where the secondary electron is emitted from face 54, (d) the characteristics of the roughness in face 54, and (e) the magnitude of $E_{AV}$, the average strength electric field $\overline{E}$ between plate structures 20 and 22.

The recessed areas in face 54 tend to trap secondary electrons by providing them with surfaces to hit and thereby be captured. Since a secondary electron is emitted from largely the point at which a primary electron strikes face 54, the average probability of capturing a secondary electron emitted from a recessed area along face 54 normally increases as the emission-causing primary electron penetrates deeper into the recessed area. The so-emitted secondary electron has increased distance to travel and, on the average, greater likelihood of traveling in an initial direction which results in the electron striking a point in the recessed area than a secondary electron emitted from a shallower point in the recessed area. In contrast, secondary electrons emitted from high points on face 54 have few places to contact face 54 and have low probabilities of being captured by face 54.

If a completely smooth face were substituted for rough face 54, there would be no recessed areas for secondary electrons to strike. A very high fraction of the secondary electrons emitted by the body having the smooth face would escape the body. Hence, the roughness in faces 54 and 56 causes the fraction of emitted secondary electrons that escape main wall 46 to be less than the fraction of emitted secondary electrons that escape the smooth reference surface.

On the other hand, roughness in a surface appears to cause the number of secondary electrons to increase, at least for certain types of surface roughness. The increase in the number of secondary electrons emitted from such a rough surface varies with the energies of the primary electrons as they strike the rough surface and typically increases with increasing primary electron striking energy $\epsilon_{1SMD}$ greater than approximately 1,000 eV. Whether the roughness in the surface leads to an increase or decrease in the total number of secondary electrons that actually escape the rough surface thus depends on the magnitudes of the incident energies of the primary electrons. In the FED that contains spacer wall 24, the primary electrons strike wall face 54 or 56 with energies which, although high compared to median secondary-electron departure energy $\epsilon_{2DMD}$, are sufficiently low that the roughness in face 54 or 56 causes a reduction in the total number of secondary electrons that escape main wall 46 and, accordingly, that escape spacer wall 24.

Electric field $\overline{E}$ causes backscattered primary electrons moving away from faceplate structure 22 to slow down. More specifically, the backscattered electrons lose velocity in the reverse electron-travel direction. To a first approximation, the backscattered electrons maintain the components of their velocity parallel to plate structure 22 or 20 . As a result, the backscattered electrons are more likely to penetrate deeper into the recessed areas along wall face 54 than electrons traveling directly from backplate structure 20 to main wall 46. Due to the deeper penetration of the backscattered primary electrons into the recessed areas along face 54, the resulting secondary electrons emitted by wall 46 are more prone to be captured by wall 46 than the secondary electrons caused by primary electrons traveling directly from backplate structure 20 to wall 46. The roughness in wall faces 54 and 56 thereby especially reduces positive spacer charging due to electron backscattering off faceplate structure 22.

Two curves 106 and 108 are shown in FIG. 6. Curve 106 represents the yield $N_e$ of electrons which escape a unit area of a flat smooth reference surface formed with material of the same chemical composition as the material that forms rough wall face 54 while high-energy primary electrons of median striking energy $\epsilon_{1SMD}$ impact the smooth reference surface. This yield, referred to here as the "natural" electron yield, is normally determined for primary electrons that impinge perpendicularly on the reference surface. Curve 108 represents the yield $N_e$ of electrons that escape rough face 54 along a projected unit area of face 54, i.e., along a unit area of an imaginary plane running through the top of face 54, while high-energy primary electrons of median striking energy $\epsilon_{1SMD}$ impact face 54. The electron yield represented by curve 108 is referred to here as the "roughness-modified" electron yield.

The secondary electrons emitted by rough face 54 or the reference surface upon being struck by primary electrons of median striking energy $\epsilon_{1SMD}$ have a median energy $\epsilon_{2DMD}$ as they are emitted from, and therefore start to depart from, face 54 or the reference surface. Energy $\epsilon_{2DMD}$ is referred to here as the median secondary-electron departure energy.

Each of curves 106 and 108 has two peaked portions as a function of electron departure energy $\epsilon_D$: a low-energy left-hand peak and a high-energy right-hand peak. In some cases, the left-hand peaks of curves 106 and 108 occur at, or essentially at, the vertical axis where electron departure energy $\epsilon_D$ is zero. The left-hand peak of each of curves 106 and 108 tails off relatively slowly with increasing electron departure energy $\epsilon_D$. The end of the tail of each of the left-hand peaks occurs approximately at a dividing electron energy $\epsilon_{DD}$ between median secondary-electron departure energy $\epsilon_{2DMD}$ and primary-electron striking energy $\epsilon_{1SMD}$.

The right-hand peaks of curves 106 and 108 are much closer to each other than the left-hand peaks are to each other.

The low-energy left-hand peak of curve 106 largely represents the yield of secondary electrons that are emitted by, and escape from, the smooth reference surface as a function of electron departure energy $\epsilon_D$.

Integration of the left-hand peak of curve 106 from zero to dividing energy $\epsilon_{DD}$ largely gives the total natural secondary electron yield, i.e., the total number of electrons that escape a unit area of the reference surface. The ratio of the total natural secondary-electron yield to the total number of primary electrons that strike a unit area of the reference surface is the natural secondary electron yield coefficient $\delta$.

The low-energy left-hand peak of curve 108 largely represents the yield of secondary electrons that actually escape main wall 46 along rough face 54. Since some of the secondary electrons emitted from face 54 are subsequently captured by face 54 due to the spacer facial roughness, the left-hand peak of curve 108 is largely the difference, per projected unit area of face 54, between the number of secondary emitted by face 54 and the number of secondary electrons captured by face 54 as a function of electron departure energy $\epsilon_D$. The left-hand peak of curve 108 is lower than the left-hand peak of curve 106 because primary electrons strike both (a) face 54 in the present FED and (b) the smooth reference surface with median primary-electron striking energy $\epsilon_{1SMD}$ which, while generally high, is sufficiently low that the total number of secondary electrons which escape face 54 is less than the total number of secondary electrons which escape the reference surface.

Integration of the left-hand peak of curve 108 from zero to dividing energy $\epsilon_{DD}$ largely gives the total roughness-modified secondary electron yield. The ratio of the total roughness-modified secondary electron yield to the total number of primary electrons that pass through a projected unit area of face 54 is the roughness-modified secondary electron yield coefficient $\delta^*$. Since (a) face 54 captures some of the emitted secondary electrons and (b) primary-electron striking energy $\epsilon_{1SMD}$ is sufficiently low in the present FED , roughness-modified secondary electron yield coefficient $\delta^*$ of face 54 is less than natural secondary electron yield coefficient $\delta$ of the (type of) material that forms face 54.

Some of the high-energy primary electrons that strike rough face 54 or the smooth reference surface are reflected, or scattered, rather than causing secondary electron emission. The high-energy right-hand peaks of curves 106 and 108 largely represent primary electrons that scatter off face 54 or the reference surface and escape face 54 or the reference surface. Some of the primary electrons scattered off face 54 strike face 54 elsewhere, largely due to the spacer facial roughness, and cause secondary electron emission there. The effect of primary electrons that scatter off face 54 but do not escape face 54 is included within the roughness-modified secondary electron yield. Because secondary electrons emitted from face 54 are of lower departure energy $\epsilon_D$ than primary electrons scattered off face 54, the fraction of secondary electrons captured by face 54 is normally considerably greater than the fraction of scattered primary electrons captured by face 54.

Electrons are emitted from rough face 54 or the smooth reference surface due to phenomena other than high-energy primary electrons striking face 54 or the reference surface. In FIG. 6, the number of electrons that escape face 54 or the reference surface as a result of other such phenomena is represented largely by the relatively low-level curve portion between the left-hand and right-hand peaks of corresponding curve 108 or 106.

Integration of curve 106 from dividing energy $\epsilon_{DD}$ to the right-hand edge of the right-hand peak gives the total natural non-secondary electron yield, i.e., the total number of scattered primary electrons and other non-secondary electrons that escape a unit area of the reference surface. The ratio of the total natural non-secondary electron yield to the total number of primary electrons that strike a unit area of reference surface is the natural non-secondary electron yield coefficient $\eta$. Similarly, integration of curve 108 from dividing energy $\epsilon_{DD}$ to the right-hand end of the right-hand peak gives the total roughness-modified non-secondary electron yield. The ratio of the total roughness-modified non-secondary electron yield to the total number of electrons that pass through a projected unit area of face 54 is the roughness-modified non-secondary electron yield coefficient $\eta^*$.

Curves 106 and 108 are quite close to each other across the integration range above dividing energy $\epsilon_{DD}$, curve 108 typically being no greater than curve 106 across this range. Hence, roughness-modified non-secondary electron yield coefficient $\eta^*$ is close to natural non-secondary electron yield coefficient $\eta$ and, in any event, is no more than coefficient $\eta$.

The sum of natural secondary electron yield coefficient $\delta$ and natural non-secondary electron yield coefficient $\eta$ is the total natural electron yield coefficient $\sigma$ for the reference surface. Likewise, the sum of roughness-modified secondary electron yield coefficient $\delta^*$ and roughness-modified non-secondary electron yield coefficient $\eta^*$ is the total roughness-modified electron yield coefficient $\sigma^*$ for rough face 54. As mentioned above, coefficient $\delta^*$ is less than coefficient $\delta$ at the magnitude of median primary-electron striking energy $\epsilon_{1SMD}$ typically present in the Fed of the invention. Since coefficient $\eta^*$ is no more than coefficient $\eta$, total roughness-modified electron yield coefficient $\sigma^*$ of face 54 is less than natural electron yield coefficient $\sigma$ of the material that forms face 54 at the $\epsilon_{1SMD}$ magnitude which typically occurs in the present FED.

Natural coefficients $\sigma$, $\delta$, and $\eta$, although determined for a smooth surface at specific primary electron impingement conditions (i.e., normal to the smooth surface), are generally considered to be properties of the material that forms the smooth surface. In the present situation, coefficients $\sigma$, $\delta$, and $\eta$ are properties of the material that forms wall face 54 without regard to the roughness in face 54.

Spacer Facial Roughness Model

Figure 7:
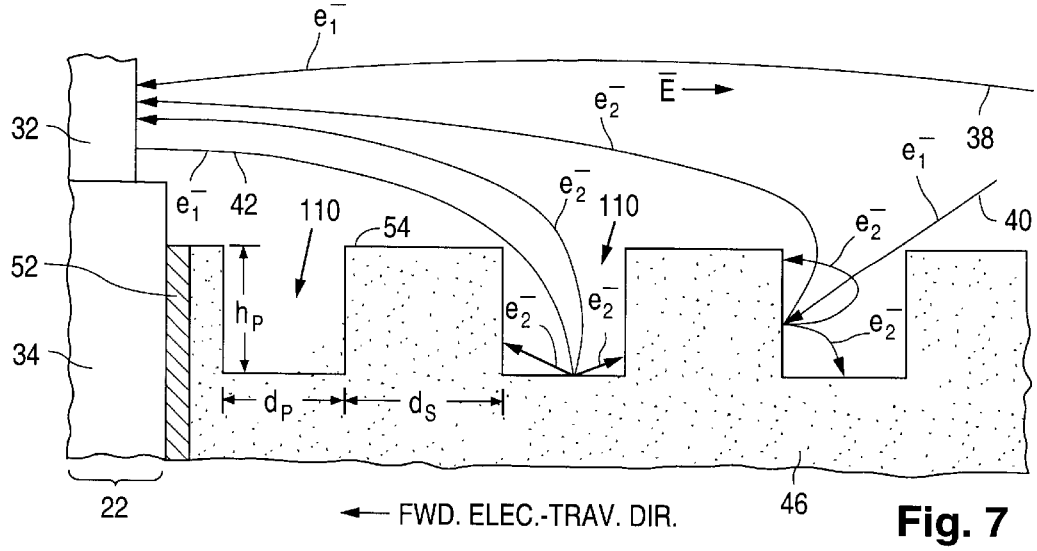
FIG. 7 is a cross-sectional view of a simplified model of the display section in FIG. 5.

To help assess how the various types of spacer facial roughness impact FED performance, the roughness in wall face 54 of FIG. 2 or 5 can be generally approximated by a model. FIG. 7 illustrates the model employed for this purpose. In the model of FIG. 7, the roughness in face 54 is approximated by identical circular cylindrical pores 110 of height $h_p$ and depth $d_p$. Pore height $h_p$ is the depth to which identical pores 110 extend into main wall 46 along face 54.

Pores 110 are arranged in a regular pattern along wall face 54. In the forward (or reverse) electron-travel direction, consecutive ones of pores 110 are laterally separated from each other by a constant spacing $d_S$. Although not evident from FIG. 7, pores 110 are configured in a rectangular array of rows and columns, each column of pores 110 extending in the forward (or reverse) electron-travel direction. Consecutive pores 110 in each row are also separated by spacing $d_S$.

The porosity P along wall face 54 is generally given as:

$$P=n_p A_{PAV} \quad (1)$$

where $n_p$ is the pore density along face 54, and $A_{PAV}$ is the average cross-sectional area of a pore as viewed perpendicular to an imaginary plane (not shown) extending through the pores located along face 54. Pore density $n_p$ is the number of pores per unit projected area along face 54.

For the model of FIG. 7, average pore area $A_{PAV}$ is:

$$A_{PAV} = \frac{\pi d_P^2}{4} \quad (2)$$

Inasmuch as each pore 110 in FIG. 7 is, on the average, situated in a projected area $(d_p+d_S)^2$, pore density $n_p$ for the model of FIG. 7 is:

$$n_P = \frac{1}{(d_P + d_S)^2} \quad (3)$$

Upon combining Eqs. 1–3, porosity P along face 54 in the model of FIG. 7 is given as:

$$P = \frac{\pi d_P^2}{4(d_P + d_S)^2} \quad (4)$$

Using Eq. 4, the spacing-to-diameter ratio $d_S/d_p$. is adjusted to achieve a desired value of main wall facial porosity P. Consistent with what is described above, wall facial porosity P can be as small as 10 %, the value arising from Eq. 4 when ratio $d_s/d_p$ is approximately 1.8. The maximum value of wall facial porosity P attainable with the model of FIG. 7 is slightly under 80 %, the value that arises when ratio $d_s/d_p$ is zero. However, a higher maximum value of wall facial porosity P can be attained by arranging pores 110 in a hexagonal (rather than rectangular) array or by modeling pores 110 as square cylinders.

Modeling parameters $h_p$, $d_p$, and $d_s$ are appropriately adjusted to represent any particular type of roughness in wall face 54. The adjustment of parameters $h_p$, $d_p$, and $d_s$ is governed by the constraint that the modeled representation of the roughness by identical pores 110 have the same value of total roughness-modified electron yield coefficient σ that actually arises with the roughness being modeled. This broad constraint, which is normally applied at a representative value of average electric field strength $E_{AV}$, is largely achieved when the facial roughness represented by pores 110 has the same value of roughness-modified secondary electron emission yield coefficient 67* that arises with the actual facial roughness.

Preferably, the adjustment of modeling parameters $h_p$, $d_p$, and $d_s$is governed by the tighter constraint that the identical cylindrical pore representation of the roughness in wall face 54 have the same total electron yield as a function of electron departure energy $\epsilon_D$ as occurs with the actual roughness in face 54. The tighter constraint is likewise normally applied at a representative value of field strength $E_{AV}$ . Similar to the broad modeling constraint, the tighter constraint is largely achieved when the identical cylindrical pore roughness representation has the same secondary electron emission yield as a function of electron departure energy $\epsilon_D$ as the actual facial roughness.

The foregoing constraints are ideal ones. While these constraints can be achieved nearly exactly for some types of roughness in wall face 54, the ideal constraints can be approximately achieved in various ways. For instance, appropriate computer modeling can be developed for the actual spacer facial roughness and then utilized to adjust modeling parameters $h_p$, $d_p$, and $d_s$. Alternatively, the electron yield characteristics for the actual roughness in face 54 can be experimentally measured and then employed in adjusting parameters $h_p$, $d_p$, and $d_s$.

If there is any constraint on the main wall facial porosity available with the roughness being modeled, Eq. 4 places further constraint on the adjustment of parameters $d_p$ and $d_s$. If not, Eq. 4 simply gives the resulting value of modeled main wall facial porosity P. Note that the value of modeled porosity P may differ from the actual porosity along wall face 54 for the roughness being modeled.

An example is helpful in understanding how the model of FIG. 7 is utilized to approximate the roughness in wall face 54. Referring to FIG. 5, the dotted line in this figure illustrates how the actual roughness in face 54 is approximated by pores 110 in FIG. 7. Pore height $h_p$ and pore diameter $d_s$ are respectively modeled as approximately the average depth and average diameter of the recessed areas along face 54 in FIG. 5. Pore-to-pore spacing $d_s$is modeled as approximately the average distance between the recessed areas in FIG. 5 in the forward (or reverse) electron-travel direction and in the lateral direction perpendicular to the forward electron-travel direction. Similar modeling is performed for other types of spacer facial roughness, such as that depicted in FIGS. 3*a*–3*l* and 4*a*–4*g*, with the appropriate electron yield constraint being used to attain model accuracy.

In the model of FIG. 7, a primary electron that enters a pore 110 can strike the bottom or sidewall of that pore 110 and cause secondary electron emission. Since electric field $\overline{E}$ causes electrons to be accelerated in the forward electron-travel direction, primary electrons backscattered off faceplate structure 22 are more likely to strike the bottoms of pores 110 than the occasional primary electrons traveling directly from backplate structure 20 to main wall 46.

Figure 8A:
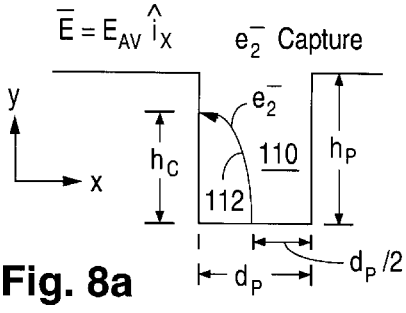
FIGS. 8*a* and 8*b* are cross-sectional views that form a secondary electron emission model of a typical pore for the respective situations of secondary electron capture and secondary electron escape.
Figure 8B:
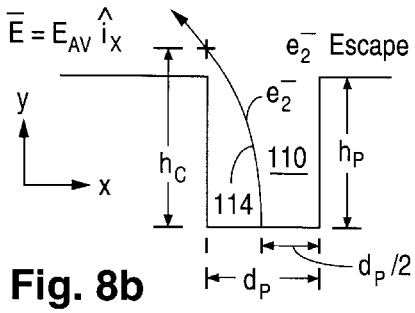

A suitable modeling example for assessing the effect of parameters such as secondary-electron departure energy $\epsilon_{2D}$, average electric field strength $E_{AV}$, and pore characteristics $h_p$ and $d_p$ on the capture or escape of secondary electrons is the situation in which secondary electrons are emitted from the center of the bottom of a pore 110 and initially move directly out of that pore 110. FIGS. 8*a* and 8*d* model this situation. The model of FIGS. 8*a* and 8*b* is represented with respect to an xy coordinate system in which the x direction is the reverse electron-travel direction and in which the y direction is parallel to the vertical sidewall of illustrated pore 110. Electric field $\overline{E}$ equals $E_{AV}\hat{i}_x$, where $\hat{i}_X$ is the unit vector in the x direction.

Items 112 and 114 in FIGS. 8*a* and 8*b* respectively indicate trajectories of two secondary electrons which are emitted at the center of the bottom of illustrated pore 110 and which initially move in the y direction directly out of pore 110. The secondary electron following trajectory 112 strikes the sidewall of pore 110 to the left in FIG. 8*a* and is captured. The secondary electron following trajectory 114 travels out of pore 110 in FIG. 8*b* and escapes main wall 46.

Parameter $h_C$ in FIGS. 8*a* and 8*b* is the critical distance that a secondary electron travels in the y direction when the electron's movement in the x direction places the electron on an imaginary line running along the left-most part of illustrated pore 110. If critical distance $h_C$ is less than pore height $h_p$, the secondary electron strikes the sidewall of pore 110 and is captured as depicted in FIG. 8*a*. If critical distance $h_C$ is greater than pore height $h_p$, the secondary electron avoids hitting the sidewall of pore 110 and escapes as shown in FIG. 8*b*.

At the instants that secondary electrons are emitted from the center of the bottom of pore 110 in FIG. 8*a* or 8*b* and move initially in the y direction, the departure energy $\epsilon_{2D}$ of each secondary electron is:

$$\varepsilon_{2D} = \frac{m_e V_y^2}{2} \tag{5}$$

where $m_e$ is the electron's mass, and $V_y$ is the initial velocity of the secondary electron in the y direction. Solving Eq. 5 for velocity $V_y$ results in:

$$V_y = \sqrt{\frac{2\varepsilon_{2D}}{m_e}} \tag{6}$$

No forces act on the secondary electron in the y direction. Velocity $V_y$ is thus constant in the model. Accordingly, critical distance $h_C$ is given as:

$$h_C = V_y t_C = t_C \sqrt{\frac{2\varepsilon_{2D}}{m_e}} \tag{7}$$

where $t_C$ is the critical time that the secondary electron takes to travel distance $h_C$ in the y direction.

In the x direction, a force $F_x$ produced by average electric field $E_{AV}\hat{i}_x$ acts on each secondary electron in the x direction according to:

$$F_x = m_e a_x = -eE_{AV} \tag{8}$$

where $a_x$ is the acceleration of the electron in the x direction, and e is the electron charge. Integrating Eq. 8 results in the following expression for the velocity $V_x$ of the secondary electron in the x direction as a function of time t:

$$V_x = \frac{-eE_{AV}t}{m_e} \tag{9}$$

In turn, integrating Eq. 9 leads to the following expression for the distance $d_x$ that the secondary electron travels in the x direction:

$$d_x = \frac{-eE_{AV}t^2}{2m_e} \tag{10}$$

At critical time $t_c$, distance $d_x$ equals $-d_p/2$. Consequently:

$$d_P = \frac{eE_{AV}t_C^2}{m_e} \tag{11}$$

combining Eqs. 7 and 11 to eliminate critical time $t_C$ yields:

$$h_C = \sqrt{\frac{2d_P\varepsilon_{2D}}{eE_{AV}}} \tag{12}$$

Critical distance $h_c$ thus increases with increasing pore depth $d_p$ or secondary-electron departure energy $\epsilon_{2D}$, but decreases with increasing electric field strength $E_{AV}$. As mentioned above, a secondary electron is captured when critical distance $h_c$ is less than $h_p$, and escapes when critical distance $h_c$ is greater than $h_p$.

Secondary-electron departure energy $\epsilon_{2D}$ can vary somewhat as indicated earlier by the left-hand peaked portions in FIG. 6. Typical median values $\epsilon_{2DMD}$ for secondary-electron departure energy $\epsilon_{2D}$ range from 5 eV to 15 eV.

Figure 9:
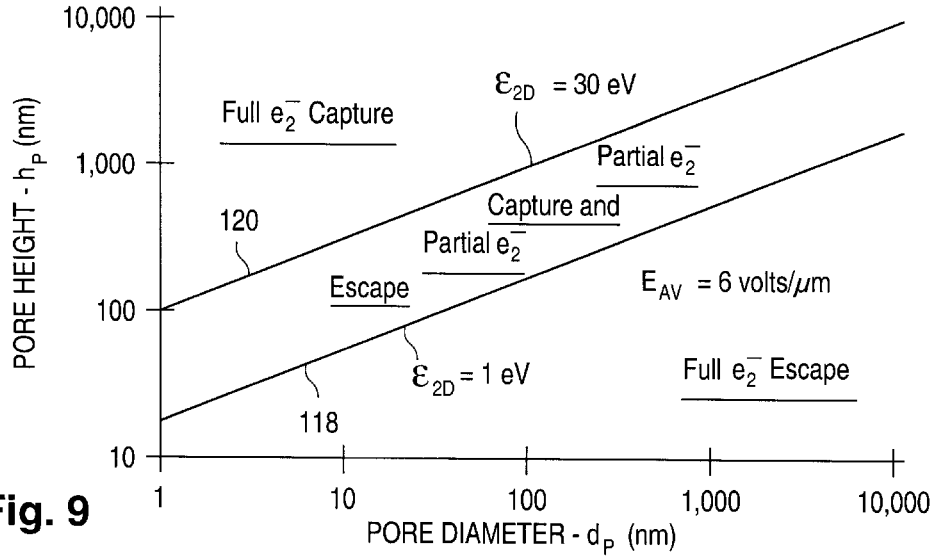
FIG. 9 is a graph of pore height as a function of pore diameter for the secondary electron emission model of FIGS. 8*a* and 8*b*.

FIG. 9 graphically illustrates the capture/escape determination established by Eq. 12 for the situation in which the minimum and maximum values of secondary-electron departure energy $\epsilon_{2D}$ are taken respectively to be 1 and 30 eV. Lines 118 and 120 respectively represent Eq. 12 for the $\epsilon_{2D}$ values of 1 and 30 eV. A fixed value of 6 volts/$\mu$m is employed in FIG. 9 for average field strength $E_{AV}$.

When pore height $h_p$ and pore diameter $d_p$ are of such values as to be in the region above line 120, all the secondary electrons emitted in the y direction from the centers of the bottoms of pores 110 with departure energy $\epsilon_{2D}$ less than 30 eV are captured. All the secondary electrons emitted in the y direction from the centers of the pore bottoms with departure energy $\epsilon_{2D}$ greater than 1 eV escape when parameters $h_p$ and $d_p$ are of such values to be in the region below line 118. Between lines 118 and 120, some of so-emitted secondary electrons with departure energy $\epsilon_{2D}$ between 1 and 30 eV are captured and others escape. Starting from a point in the region below line 118 where all such secondary electrons escape, pore height $h_p$ must be increased and/or pore diameter $d_p$ must be decreased to reach the region above line 120 where all such secondary electrons are captured.

It is helpful to access the capture/escape situation in terms of pore aspect ratio $h_p/d_p$. For this purpose, critical distance $h_c$ in Eq. 12 is divided by pore diameter $d_p$ to produce:

$$\frac{h_C}{d_P} = \sqrt{\frac{2\varepsilon_{2D}}{ed_PE_{AV}}} \tag{13}$$

Figure 10:
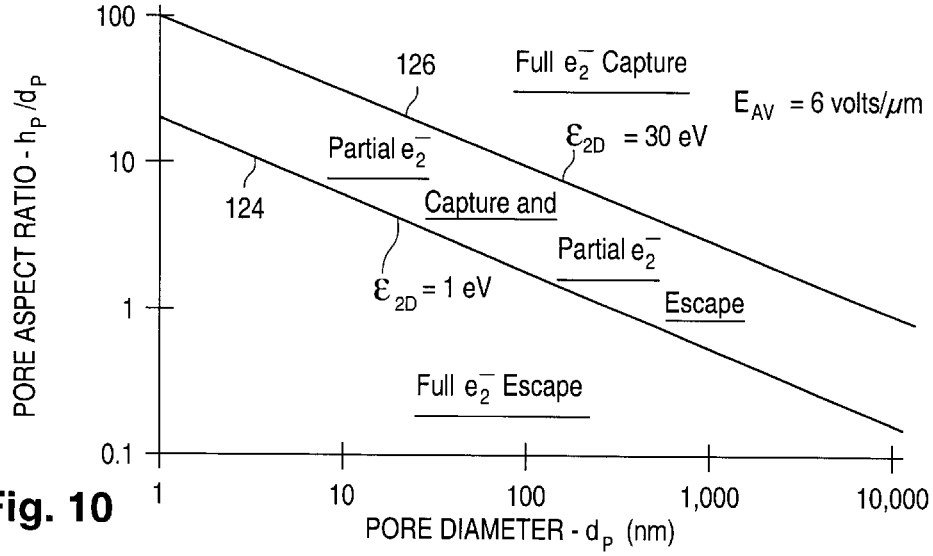
FIG. 10 is a graph of pore aspect ratio as a function of pore diameter for the secondary electron emission model of FIGS. 8*a* and 8*b*.

The capture/escape situation established by Eq. 13 is graphically illustrated in FIG. 10 in terms of pore aspect ratio $h_pd_p$ for the conditions utilized in FIG. 9. Lines 124 and 126 in FIG. 10 respectively represent Eq. 13 for the extreme $\epsilon_{2D}$ values of 1 and 30 eV. In this case, starting from a point in the region below line 124 where all the secondary electrons emitted in the y direction from the centers of the bottoms of pores 110 with departure energy $\epsilon_{2D}$ less than 30 eV escape, pore aspect ratio $h_p/d_p$ and/or pore diameter $d_p$ must be increased to reach the region above line 126 where all the secondary electrons emitted in the y direction from the centers of the pore bottoms with departure energy $\epsilon_{2D}$ greater than 1 eV are captured.

It is not necessary that all secondary electrons emitted in the y direction from the centers of the bottoms of pores 110 be captured. An adequate reduction in positive charge buildup on spacer wall 24 can be achieved when only part of these secondary electrons are captured. Also, the capture/escape criteria for secondary electrons emitted in other directions and from other locations in pores 110 are different from those modeled in FIGS. 8*a* and 8*b*. Nonetheless, the value of critical distance $h_c$ determined from Eq. 12 is a useful modeling parameter.

More particularly, pore height parameter $h_{MD}$ is the value of critical distance $h_c$ when secondary-electron departure energy $\epsilon_{2D}$ equals median secondary-electron departure energy $\epsilon_{2DMD}$. That is:

$$h_{MD} = \sqrt{\frac{2d_P\varepsilon_{2DMD}}{eE_{AV}}} \tag{14}$$

Provided that main wall facial porosity P is at least 10%, an adequate reduction in the number of secondary electrons that escape main wall 46 is achieved in the model of FIG. 7 when pore height $h_p$ is at least 15% of pore height parameter $h_{MD}$. Pore height $h_p$ is preferably at least 50%, more preferably at least 90%, of parameter $h_{MD}$. Median secondary-electron departure energy $\epsilon_{2IMD}$ is normally in the range of 5–15 eV.

For given values of pore density $n_p$ and median primary-electron striking energy $\epsilon_{1SMD}$, increasing the main wall facial porosity generally leads to a reduction in the number of secondary electrons that escape rough face 54. Consistent with the porosity levels described above for the examples of FIGS. 3*a*–3*l* and 4*a*–4*g*, main wall facial porosity P in the model of FIG. 7 is preferably at least 20%, more preferably at least 40%. Porosity P is typically 60% or more up to nearly 80%. By substituting square cylindrical pores for circular cylindrical pores 110, porosity P can be 90% or more.

Electrical Characteristics, Constituency, and Internal Configuration of Main Spacer Body Main wall-shaped spacer body 46 normally has a sheet resistance of $10^8$–$10^{16}$ ohms/sq. The sheet resistance of main wall 46 is preferably $10^{10}$–$10^{14}$ ohms/sq., typically $10^{11}$–$10^{12}$ ohms/sq. Wall 46 normally has a breakdown voltage of at least 1 volt/$\mu$m. The wall breakdown voltage is preferably greater than 4 volts/$\mu$m, typically greater than 6 volts/$\mu$m.

Main wall 46 may consist of various materials along rough faces 54 and 56. Subject to achieving the preceding electrical characteristics and dependent on the internal configuration of main wall 46, candidates for the materials that form faces 54 and 56 include (a) carbon (b) compositions of carbon and one or more of silicon, nitrogen, and hydrogen, especially compositions of carbon and silicon, (c) compositions of boron and one or more of carbon, silicon, nitrogen, and hydrogen, especially compositions of boron and nitrogen, (d) compositions of silicon and nitrogen, (e) oxides of one or more cation elements in Groups 2a, 3b, 4b, 5b, 6b, 7b, 8, 1b, 2b, 3a, and 4a of Periods 2–6 of the Periodic Table, including the lanthanides, (f) hydroxides of one or more cation elements in Groups 2a, 3b, 4b, 5b, 6b, 7b, 8, 1b, 2b, 3a, and 4a of Periods 2–6 of the Periodic Table, including the lanthanides, (g) nitrides of one or more cation elements in Groups 3b, 4b, 5b, 6b, 7b, 8, 1b, 2b, 3a, and 4a of Periods 2–6 of the Periodic Table, including the lanthanides, and (h) carbides of one or more non-carbon cation elements in Groups 3b, 4b, 5b, 6b, 7b, 8, 1b, 2b, 3a, and 4a of Periods 2–6 of the Periodic Table, including the lanthanides.

Multiple ones of the preceding candidate materials may be present along rough face 54 or 56. More particularly, the phrase "or more" as used in describing cation elements contained in candidate materials for a body means that two or more of the identified cation elements, e.g., the elements in Groups 2a, 3b, 4b, 5b, 6b, 7b, 8, 1b, 2b, 3a, and 4a of Periods 2–6 of the Periodic Table for the oxide or hydroxide case, may be present in the identified body, e.g., the material that forms face 54 or 56 here.

The candidate materials may be in mixed form, such as a solid solution, a multi-phase mixture, a multi-phase mixture of solid solutions, and so on, with respect to the cation elements. For example, in the case of a solid solution of binary mixed oxide and/or binary mixed hydroxide, the body contains $L_uM_vO_w$ and/or $L_xM_y(OH)_{z2}$, where L and M are different ones of the identified cation elements, e.g., the elements in Groups 2a, 3b, 4b, 5b, 6b, 7b, 8, 1b, 2b, 3a, and 4a of Periods 2–6 of the Periodic Table, u, v, w, x, y, and z are numbers, O is oxygen, and H is hydrogen. For a multi-phase mixture of binary mixed oxide and/or binary mixed hydroxide, the body contains $L_uO_{w1}.M_vO_{w2}$ and/or $L_x(OH)_{z1}.M_y(OH)_{z2}$, where w1, w2, z1, and z2 are numbers. Similarly, for a multi-phase mixture of solid solutions of binary mixed oxide and/or binary mixed hydroxide, the body contains $L_{u1}M_{v1}O_{w1}.L_{u2}M_{v2}O_{w2}$ and/or $L_{x1}M_{y1}(OH)_{z1}.L_{x2}M_{y2}(OH)_{z2}$, where u1, v1, u2, v2, x1, y1, x2, and y2 are numbers.

Particularly attractive oxides and hydroxides are those of beryllium, carbon, magnesium, aluminum, silicon, titanium, vanadium, chromium, manganese, iron, yttrium, niobium, molybdenum, lanthanum, cerium, praseodymium, neodymium, europium, and tungsten, including mixed oxide and/or hydroxide of two or more of these elements. Rather than being in the form of carbon dioxide, an oxide of carbon is typically in the form of carbon terminated with oxygen. Similarly, a hydroxide of carbon is typically in the form of carbon terminated with a hydroxyl group ($OH^-$). Non-carbon oxides are ceramic. Non-carbon hydroxide is often present in the ceramic with non-carbon oxide. Except for beryllium, carbon, magnesium, aluminum, and silicon, all of the particularly attractive oxides and hydroxides are oxides and hydroxides of transition metals. Particularly attractive nitrides are those of boron, aluminum, silicon, and titanium. Particularly attractive carbides are those of boron and silicon.

Main wall 46 may be internally configured in various ways. FIGS. 11*a*–11*d* illustrate four basic internal configurations for wall 46. Each functionally different layer, coating, or other component in each configuration of FIGS. 11*b*–11*d* may consist of two or more layers, coatings, or other components that provide the indicated function. Wall 46 may also include one or more components that provide functions besides those described below. Such additional components may be located above, between, or below the layers, coatings, and other components described below.

Figure 11A:
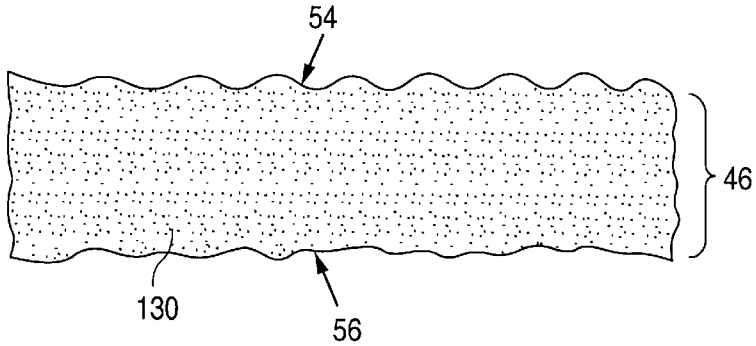
FIGS. 11*a*–11*d* are cross-sectional side views of four general embodiments of the main wall of the wall-shaped spacer in FIG. 2.

In FIG. 11*a*, main wall 46 consists simply of a rough-faced wall-shaped electrically non-conductive primary substrate 130 that provides mechanical strength. The roughness along faces 54 and 56 of primary substrate 130 can be achieved in various ways, including all the ways illustrated in FIGS. 3*a*–3*l* and 4*a*–4*g*. When the spacer facial roughness is formed with pores, substrate 130 is simply a porous substrate. The pores may be present throughout substrate 130, especially when the pores are implemented with randomly located irregular pores 64 of FIG. 3*c*. When substrate 130 is a porous body, the porosity can vary from the center of substrate 130 to faces 54 and 56.

The composition of primary substrate 130 is typically relatively uniform throughout its bulk, i.e., away from rough faces 54 and 56. The composition of the bulk of substrate 130 can, however, vary somewhat from place to place. The composition of the material that forms faces 54 and 56 may be largely the same as, or somewhat different from, the material that forms the bulk of substrate 130. The thickness of substrate 130 is normally 10–100 $\mu$m, typically 50 $\mu$m.

Primary substrate 130 has the general electrical characteristics prescribed above for main wall 46. That is, the sheet resistance of substrate 130 is normally $10^8$–$10^{16}$ ohms/sq., preferably $10^{10}$–$10^{14}$ ohms/sq., typically $10^{11}$–$10^{12}$ ohms/sq. The breakdown voltage of substrate 130 is normally at least 1 volt/$\mu$m, preferably more than 4 volts/$\mu$m, typically more than 6 volts/$\mu$m.

Primary substrate 130 typically consists of ceramic, including glass-like ceramic. Primary candidates for the material of substrate 130 are oxides and hydroxides of one or more non-carbon elements in Groups 2a, 3b, 4b, 5b, 6b, 7b, 8, 1b, 2b, 3a, and 4a of Periods 2–6 of the Periodic Table, including the lanthanides. Other candidates for the substrate material include nitrides of one or more non-carbon elements in Groups 3b, 4b, 5b, 6b, 7b, 8, 1b, 2b, 3a, and 4a of Periods 2–6 of the Periodic Table, again including the lanthanides. Further substrate material candidates are carbides of one or more non-carbon elements in Groups 3b, 4b, 5b, 6b, 7b, 8, 1b, 2b, 3a, and 4a of Periods 2–6 of the Periodic Table, again including the lanthanides. Multiple ones of these materials may be present in substrate 130. Particularly attractive oxide and hydroxide candidates for primary substrate 130 are those of beryllium, magnesium, aluminum, silicon, titanium, vanadium, chromium, manganese, iron, yttrium, niobium, molybdenum, lanthanum, cerium, praseodymium, neodymium, europium, and tungsten, including mixed oxide and/or hydroxide of two or more of these elements. In a typical implementation, substrate 130 consists largely of oxide of one or more of aluminum, titanium, and chromium. Other particularly attractive substrate candidates are aluminum nitride and silicon carbide.

Figure 11B:
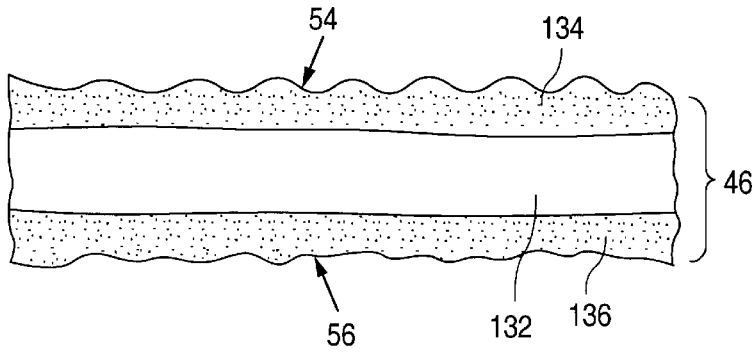

FIG. 11*b* illustrates an embodiment in which main wall 46 is a primary wall-shaped electrically non-conductive spacer body consisting of a wall-shaped electrically non-conductive core substrate 132, which provides mechanical strength, and a pair of rough-faced electrically non-conductive layers 134 and 136 respectively situated on the opposite faces of wall-shaped core substrate 132. Rough-faced layers 134 and 136, which are largely identical, may connect to each other around the ends and/or side edges of substrate 132. The outside faces of rough layers 134 and 136 respectively form rough faces 54 and 56. Substrate 132 may have, but need not have, significant facial roughness. Any facial roughness of substrate 132 is normally much less than the roughness of faces 54 and 56. The thickness of substrate 132 is normally 10–100 $\mu$m, typically 50 $\mu$m.

The roughness in faces 54 and 56 of layers 134 and 136 can be achieved in various ways, including all the ways shown in FIGS. 3*a*–3*l* and 4*a*–4*g*. Each of rough layers 134 and 136 is typically a porous layer in which the facial roughness is implemented primarily with pores such as those shown in FIGS. 3*a* and 4*a*, 3*b*, and 3*c* or/and with pore-like depressions such as three-dimensionally rounded recessions 66 of FIGS. 3*d* and 4*b*. The pores or/and pore-like depressions typically largely penetrate through each of layers 134 and 136, especially in the case of irregular pores 64 in FIG. 3*c* or rounded pore-like recessions 66 in FIGS. 3*d* and 4*b*. In any event, layers 134 and 136 each have the facial porosity characteristics described above for wall face 54.

Core substrate 132 normally has approximately the same general electrical characteristics as primary substrate 130. Accordingly, the sheet resistance of core substrate 130 is normally approximately $10^8$–$10^{16}$ ohms/sq., preferably approximately $10^{10}$–$10^{14}$ ohms/sq., typically approximately $10^{11}$–$10^{12}$ ohms/sq. The breakdown voltage of substrate 132 is normally at least approximately 1 volt/$\mu$m, preferably more than approximately 4 volts/$\mu$m, typically more than approximately 6 volts/$\mu$m.

Each of rough layers 134 and 136 is of much greater sheet resistance than core substrate 132. Specifically, the sheet resistance of layer 134 or 136 is normally at least ten times, preferably at least one hundred times, the sheet resistance of substrate 132. This corresponds to each of layers 134 and 136 normally being at least ten times, preferably being at least one hundred times, greater resistance per unit length than substrate 132, the length dimension for resistance being taken from end electrode 52 to end electrode 50 (or vice versa). Equivalently stated, for the situation in which layers 134 and 136 each extend fully along the length of substrate 132, the resistance of each of layers 134 and 136 is normally at least ten times, preferably at least one hundred times, the resistance of substrate 132. With layers 134 and 136 being much more electrically resistant than substrate 132, layers 134 and 136 determine the electron-emission characteristics of main wall 46 while substrate 132 determines other electrical characteristics of wall 46. This separation of electronic functions facilitates spacer design.

Each of rough layers 134 and 136 normally has an average electrical resistivity of $10^8$–$10^{14}$ ohm-cm at 25° C. The average electrical resistivity of layer 134 or 136 is preferably $10^9$–$10^{13}$ ohm-cm, more preferably $10^9$–$10^{12}$ ohm-cm, at 25° C. As mentioned above, electrically resistive materials have an electrical resistivity of 1–$10^{12}$ ohm-cm at 25° C., while electrically insulating materials have an electrical resistivity of greater than $10^{12}$ ohm-cm at 25° C. Consequently, layers 134 and 136 may be electrically resistive or electrically insulating. Substrate 132 is typically electrically resistive, but may be electrically insulating.

Each of rough layers 134 and 136 is normally no more than 20 $\mu$m thick. The minimum thickness of layer 134 or 136 is normally 20 nm. The average thickness of each of layers 134 and 136 is normally 20–1,000 nm, preferably 20–500 nm. These thickness specifications, along with the preceding specifications on sheet resistance, resistance, resistance per unit length, and electrical resistivity, apply especially to the situation in which layers 134 and 136 are porous layers.

Subject to meeting the preceding electrical characteristics, core substrate 132 typically consists of ceramic, including glass-like ceramic. The candidates for the ceramic in substrate 132 include all the materials described above for primary substrate 130. The particularly attractive candidates for substrate 130 are also particularly attractive for substrate 132.

Rough layers 134 and 136 likewise typically consist of ceramic, including glass-like ceramic. Candidate materials for layers 134 and 136 are (a) carbon, (b) compositions of carbon and one or more of silicon, nitrogen, and hydrogen, especially compositions of carbon and silicon, (c) compositions of boron and one or more of carbon, silicon, nitrogen, and hydrogen, especially compositions of boron and nitrogen, (d) compositions of silicon and nitrogen, (e) oxides of one or more elements in Groups 3b, 4b, 5b, 6b, 7b, 8, 1b, 2b, 3a, and 4a of Periods 2–6 of the Periodic Table, including the lanthanides, (f) hydroxides of one or more elements in Groups 3b, 4b, 5b, 6b, 7b, 8, 1b, 2b, 3a, and 4a of Periods 2–6 of the Periodic Table, including the lanthanides, (g) nitrides of one or more elements in Groups 3b, 4b, 5b, 6b, 7b, 8, 1b, 2b, 3a, and 4a of Periods 2–6 of the Periodic Table, including the lanthanides, and (h) carbides of one or more non-carbon elements in Groups 3b, 4b, 5b, 6b, 7b, 8, 1b, 2b, 3a, and 4a of Periods 2–6 of the Periodic Table, including the lanthanides.

Particularly attractive oxide and hydroxide candidates for rough layers 134 and 136 are those of carbon, aluminum, silicon, titanium, vanadium, chromium, manganese, iron, yttrium, niobium, molybdenum, lanthanum, cerium, praseodymium, neodymium, europium, and tungsten, including mixed oxide and/or hydroxide of two or more of these elements. In an example described further below in connection with FIGS. 16*a*–6*c*, layers 134 and 136 consist of porous metal oxide formed by anodically oxidizing metal such as aluminum. In another example, layers 134 and 136 are porous layers consisting largely of oxide of one or more of aluminum, silicon, titanium, chromium, manganese, iron, and neodymium. Other particularly attractive candidates for layers 134 and 136 are boron carbide, boron nitride, aluminum nitride, and silicon nitride.

Figure 11C:
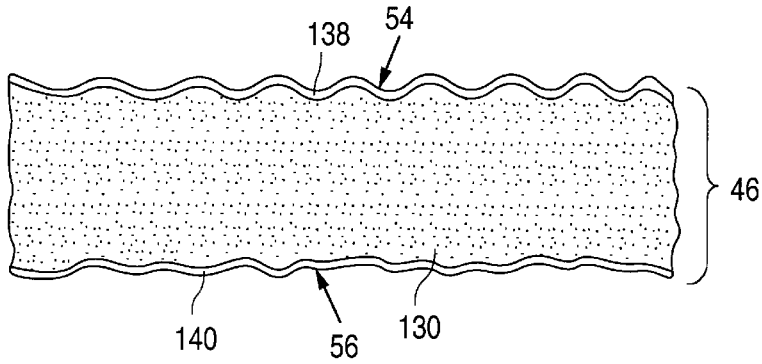
Figure 11D:
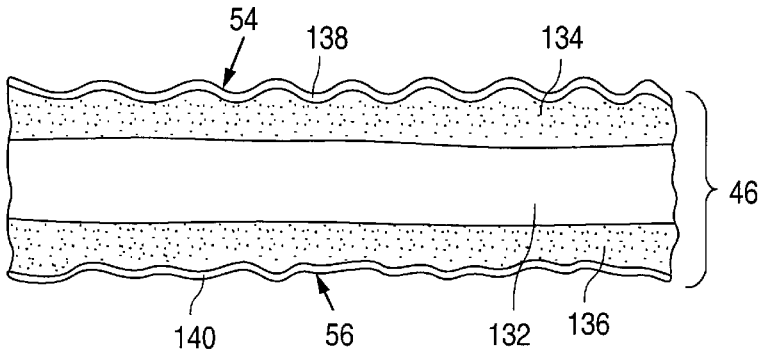

FIGS. 11*c* and 11*d* illustrate two embodiments in which a pair of generally conformal electrically non-insulating coatings 138 and 140 are respectively situated on opposite faces of a primary rough-faced wall-shaped electrically non-conductive body. The term "conformal" here means that coatings 138 and 140 approximately conform to the surface topology of the underlying primary wall and thus approximately replicate its facial roughness. The outside faces of conformal coatings 138 and 140 respectively form rough faces 54 and 56 of main wall 46. Coatings 138 and 140 consist of material whose total natural electron yield coefficient $\sigma$ is less than coefficient $\sigma$ of the underlying material of the primary wall. Total natural electron yield coefficient $\sigma$ of coatings 138 and 140 is normally no more than 2.5, preferably no more than 2.0 , more preferably no more than 1.6.

Two effects operate together in the embodiments of FIGS. 11*c* and 11*d* to reduce the total electron yield that arises when high-energy primary electrons strike conformal coatings 138 and 140 during FED operation. The roughness which is present along the opposite faces of the primary wall in the present FED and which is replicated in the contours of coatings 138 and 140 causes the total electron yield to decrease for the reasons discussed above. The material used to form coatings 138 and 140 leads to further reduction in the total electron yield. Total roughness-modified electron yield coefficient $\sigma^*$ in the embodiments of FIGS. 11*c* and 11*d* is thus lower than coefficient $\sigma^*$ that would arise solely from the roughness in the faces of the primary wall.

The primary wall in FIG. 11*c* is formed with primary rough-faced substrate 130 of FIG. 11*a*. In FIG. 11*c*, total natural electron yield coefficient $\sigma$ of conformal coatings 138 and 140 is less than coefficient $\sigma$ of substrate 130. In FIG. 11*d*, the primary wall consists of substrate 132 and overlying rough-faced layers 134 and 136. Since coatings 138 and 140 are situated respectively on rough layers 134 and 136, total natural electron yield coefficient $\sigma$ of coatings 138 and 140 is less than coefficient $\sigma$ of layers 134 and 136. Components 130, 132, 134, and 136 in FIGS. 11*c* and 11*d* may be formed with any of the materials respectively described above in connection with FIGS. 11*a* and 11*b* for these main-wall components.

The thickness of each of conformal coatings 138 and 140 is normally 1–100 nm, typically 5–50 nm. In the embodiment of FIG. 11*d*, the combination of rough layer 134 and coating 138 or rough layer 136 and coating 140 meets the various sheet resistance, resistance, resistance per unit length, and electrical resistivity specifications given above solely for rough layer 134 or 136 in the embodiment of FIG. 11*b*. These thickness specifications, along with the specifications on sheet resistance, resistance, resistance per unit length, and electrical resistivity, apply especially to the situation in which layers 134 and 136 are porous layers in the embodiment of FIG. 11*d*.

Subject to the specifications given above for total natural electron yield coefficient $\sigma$, conformal coatings 138 and 140 may be formed with various materials including (a) carbon, (b) compositions of carbon and one or more of silicon, nitrogen, and hydrogen, (c) compositions of boron and one or more of carbon, silicon, and nitrogen, (d) oxide of one or more of titanium, chromium, manganese, iron, yttrium, niobium, molybdenum, cerium, praseodymium, neodymium, europium, and tungsten, (e) hydroxide of one or more of titanium, chromium, manganese, iron, yttrium, niobium, molybdenum, cerium, praseodymium, neodymium, europium, and tungsten, and (f) nitrides of one or more of aluminum and titanium. Two or more of these materials, including oxide and/or hydroxide in mixed form, may be present in coatings 138 and 140.

Carbon, cerium oxide, chromium oxide, manganese oxide, and neodymium oxide are especially attractive for conformal coatings 138 and 140. In one implementation, coatings 138 and 140 consist of carbon in the form of one or more of graphite, amorphous carbon, and diamond-like carbon. The material, either rough-faced substrate 130 or rough layers 134 and 136, that directly underlies coatings 138 and 140 in this implementation consists of oxide of one or more of aluminum, silicon, titanium, chromium, and iron.

Figure 12A:
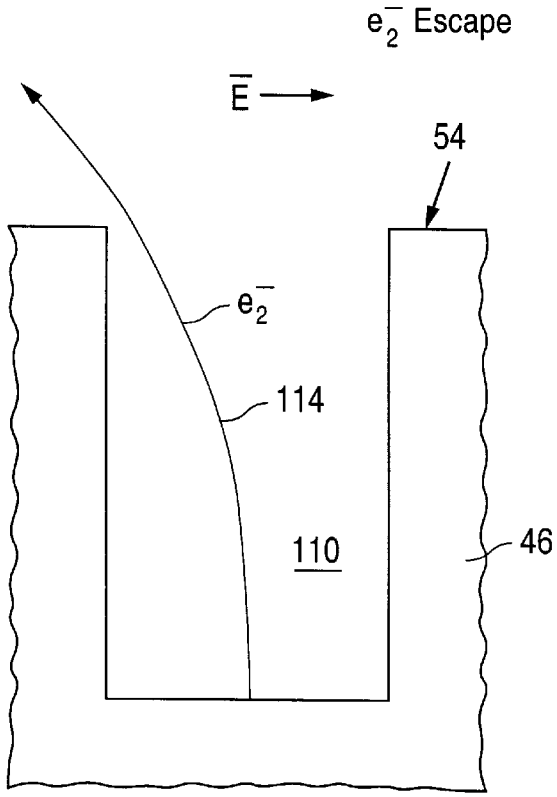
FIGS. 12*a* and 12*b* are cross-sectional views that form secondary electron emission models of a typical pore for the respective situations of magnetic material being absent and present along the pore.
Figure 12B:
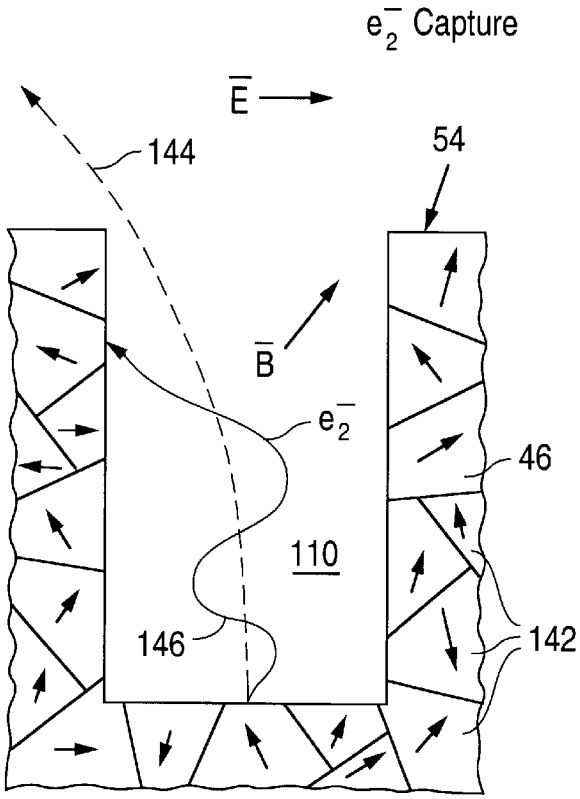

Main wall 46 may consist of magnetic material along rough faces 54 and 56. The magnetic material causes the number of secondary electrons that escape each spacer 24 to be further reduced. FIGS. 12*a* and 12*b* illustrate how the magnetic material operates to reduce total roughness-modified electron yield coefficient $\sigma^*$. In FIG. 12*a*, the material along a typical pore 110 in the model of FIG. 7 is non-magnetic. Similar to FIG. 8*b*, FIG. 12*a* illustrates trajectory 114 along which a secondary electron escapes illustrated pore 110.

In FIG. 12*b*, the material along a typical pore 110 in the model of FIG. 7 consists of magnetic material 142 divided into multiple magnetic domains. The arrow in each magnetic domain indicates the direction of the magnetic dipole in that magnetic domain. The directions of the magnetic dipoles are typically random. Consequently, the average magnetic field in the vicinity of pore 110 is close to zero. Nonetheless, a local magnetic field $\overline{B}$ which varies in direction and magnitude from point to point is present in pore 110.

For comparison purposes, dashed line 144 in FIG. 12*b* represents the location of trajectory 114 in FIG. 12*a*. Line 146 in FIG. 12*b* represents the trajectory of a secondary electron emitted from the same location, with the same departure energy $\epsilon_{2D}$, and in the same departure direction, as the secondary electron that follows trajectory 114 in FIG. 12*a*.

As the secondary electron leaves the magnetic pore surface in FIG. 12*b*, the secondary electron invariably encounters a magnetic field component that is not parallel to the electron's velocity. The vector cross product of this magnetic field component and the electron's velocity produces a force that acts on the secondary electron perpendicular to its velocity. Due to this sideways-directed magnetically produced force, the secondary electron moves in a curved manner as shown by trajectory 146. The curved nature of trajectory 146 leads to an increase in the likelihood that the secondary electron will impact the sidewall of pore 110 in FIG. 12*b*. Consequently, total roughness-modified electron yield coefficient $\sigma^*$ is further reduced.

The magnetic material typically consists of ceramic, including glass-like ceramic. Candidates for the magnetic ceramic typically include (a) oxides of one or more elements in Groups 3b, 4b, 5b, 6b, 7b, 8, 1b, 2b, 3a, and 4a of Periods 2–6 of the Periodic Table, including the lanthanides, and (b) hydroxides of one or more elements in Groups 3b, 4b, 5b, 6b, 7b, 8, 1b, 2b, 3a, and 4*a*, of Periods 2–6 of the Periodic Table, including the lanthanides. The magnetic material can be used to implement any of substrate 130, rough layers 134 and 136, and conformal coatings 138 and 140 in FIGS. 11*a*–11*c*. Provided that coatings 138 and 140 are sufficiently thin so as to not block the effect of the magnetic field, the magnetic material can also be used to implement layers 134 and 136 in FIG. 11*d*.

Fabrication of Flat-Panel Display, Including Spacer

The present FED is manufactured in the following manner. Backplate structure 20, faceplate structure 22, spacer walls 24, and the peripheral outer wall (not shown) are fabricated separately. Components 20, 22, and 24 and the outer wall are then assembled to form the FED in such a way that the pressure in sealed enclosure 26 is at a desired high vacuum level, typically $10^{-7}$ torr or less. During FED assembly, each spacer wall 24 is suitably positioned between plate structures 20 and 22 such that each of rough faces 54 and 56 extends approximately perpendicular to both of plate structures 20 and 22.

Spacer 24 can be fabricated in a variety of ways. In one general spacer fabrication process, the starting point is a flat structural substrate that serves as a precursor to core substrate 132 in FIG. 11*b* or 11*d*. The precursor structural substrate is typically large enough for at least four substrates 132 arranged rectangularly in multiple rows and multiple columns. The precursor substrate is bonded along one of its faces to a flat face of a support structure using suitable adhesive. A patterned layer of electrically non-insulating face-electrode material is formed on the other face of the precursor substrate. A blanket protective layer is provided over the patterned face-electrode layer and the exposed portions of the precursor substrate.

Using a suitable cutting device such as a saw, the resulting combination of the precursor substrate, the patterned face-electrode layer, and the protective layer is cut into multiple segments. Each segment of the precursor substrate in the combination constitutes one of core substrates 132. Although the cuts may extend partway into the support structure, the support structure remains intact. At this point, one or more face electrodes formed from the patterned face-electrode layer are situated on the upper face of each substrate 132.

A shadow mask is placed above core substrates 132 and the overlying material, including above the segments of the protective layer, at the intended locations for the side edges of substrates 132, i.e., the substrate edges that extend in the forward (or reverse) electron-travel direction and thus perpendicular to the ends of substrates 132. With the segments of the protective layer overlying substrates 132, electrically non-insulating end-electrode material is deposited on the ends of substrates 132 to form end electrodes 50 and 52 on opposite ends of each substrate 132. The shadow mask prevents the end-electrode material from being deposited on the side edges of substrates 132. The segments of the protective layer are removed. Substrates 132, along with the various electrodes, are removed from the support structure by dissolving the remainder of the adhesive.

Rough-faced layers 134 and 136 are subsequently formed on opposite faces of each core substrate 132 to produce main wall 46 of FIG. 11*b*. Since the patterned face-electrode material is situated on one face of each substrate 132, either rough layer 134 or rough layer 136 overlies the patterned face-electrode material. If desired, conformal coatings 138 and 140 can be respectively provided along layers 134 and 136 to produce main wall 46 of FIG. 11*d*. Techniques such as sputtering, evaporation, chemical vapor deposition, and deposition from a liquidous composition, e.g., a solution, colloidal mixture, or slurry, can be employed to form conformal coatings 138 and 140.

Various modifications can be made to the preceding spacer fabrication process. As one alternative, a pair of rough-faced layers that serve as precursors to rough layers 134 and 136 can be respectively provided on the opposite faces of the precursor substrate before the bonding operation at the beginning of the fabrication process. The resulting combination is then bonded along the rough face of one of layers 134 and 136 to the support structure. Subject to this change, further processing is performed as described above. In each final spacer wall 24, the patterned face-electrode material overlies one of rough layers 134 and 136. If conformal coatings 138 and 140 are present, one of them overlies the patterned face-electrode material.

As another alternative, both the formation of the rough-faced precursors to rough layers 134 and 136 and the formation of a pair of conformal coatings that serve as precursors to conformal coatings 138 and 140 can be performed before the bonding operation. The resulting structure at this point appears, in part, as shown in FIG. 11*d*. The combination of the precursor substrate, the two rough-faced precursor layers, and the two precursor conformal coatings is then bonded along the rough face of one of the precursor coatings to the support structure. Subject to this change, further processing is again conducted as described above. In each final spacer wall 24, the patterned face-electrode material overlies one of conformal coatings 138 and 140.

In the first-mentioned alternative, a rough-faced generally wall-shaped substrate that serves as a precursor to rough-faced substrate 130 can replace the combination of the precursor to core substrate 132 and the precursors to rough layers 134 and 136. Main wall 46 in resulting spacer wall 24 therefore appears as shown in FIG. 11*a* if conformal coatings 138 and 140 are absent or as shown in FIG. 11*c* if coatings 138 and 140 are present. When coatings 138 and 140 are present, one of them overlies the patterned face-electrode material. This replacement can also be performed in the second-mentioned alternative above. Since coatings 138 and 140 are present in this case, main wall 46 in final spacer wall 24 appears as shown in FIG. 11*c*. The patterned face-electrode material now overlies one of coatings 138 and 140.

The patterned face-electrode layer is typically formed by depositing a blanket layer of the desired face-electrode material and selectively removing undesired parts of the face-electrode material using a suitable mask to prevent the face-electrode material from being removed at the intended locations for the face electrodes. Alternatively, the patterned face-electrode layer can be selectively deposited using, for example, a shadow mask to prevent the face-electrode material from accumulating at undesired locations. When the patterned face-electrode material overlies one of conformal coatings 138 and 140 and/or one of rough layers 134 and 136, use of this alternative avoids possible contamination of rough faces 54 and 56 with material used in forming the face electrodes.

Other modifications can be made to the foregoing spacer fabrication process. For example, the support structure can be eliminated. End electrodes 50 and 52 can be formed in different ways than described above. Instead of cutting the precursor substrate into core substrates 132 and then using a shadow mask to prevent the end-electrode material from being deposited on the side edges of substrates 132, the precursor substrate and overlying material can be cut into strips that each contain a row (or column) of substrates 132 arranged side edge to side edge. After the end-electrode material is deposited, the strips are then cut into segments that each contain one substrate 132. In some cases, the formation of end electrodes 50 and 52 and/or the formation of face electrodes such as face electrodes 48 can be eliminated. The spacer fabrication process is then simplified accordingly.

All of the steps involved in the formation of the patterned face-electrode material, end electrodes 50 and 52, rough layers 134 and 136, and conformal coatings 138 and 140, to the extent that these components are present, can be performed directly on each substrate 130 or 132 rather than on a larger precursor to each substrate 130 or 132. In the general spacer fabrication process first mentioned above and in the variations, the end result is that spacers 24, each containing at least a segment of the material that variously forms substrate 130 or 132, layers 134 and 136, when present, and coatings 138 and 140, when present, are positioned between plate structures 20 and 22.

Fabrication of Main Wall of Spacer

FIGS. 13*a*–13*d* (collectively "FIG. 13"), FIGS. 14*a*–14*e* (collectively "FIG. 14"), FIGS. 15*a*–15*f* (collectively "FIG. 15"), FIGS. 16*a*–16*c* (collectively "FIG. 16"), FIGS. 17*a*–17*d* (collectively "FIG. 17") illustrate process sequences for respectively manufacturing five variations of main spacer wall 46 according to the invention. The roughness in wall 46 is produced by depressions in the process sequences of FIGS. 13–17. When fabricated according to the process sequence of FIG. 13, wall 46 appears generally as shown in FIG. 3*c* and either FIG. 11*b* or FIG. 11*d*. Upon being fabricated according to the process sequence of FIG. 14 or 15, wall 46 appears generally as shown in FIGS. 3*d* and 4*b* and either FIG. 11*b* or FIG. 11*d*. When fabricated according to the process sequence of FIG. 16, wall 46 appears generally as shown in FIG. 3*f* and one of FIGS. 11*a*–11*d*. Upon being fabricated according to the process sequence of FIG. 17, wall 46 appears generally as shown in FIGS. 3*a* and 4*a* and either FIG. 11*b* or FIG. 11*d*.

Figure 19A:
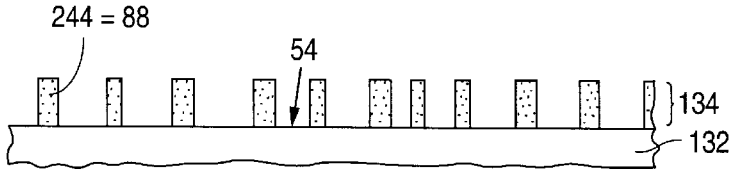
FIGS. 19*a* and 19*b* are cross-sectional side views representing a pair of steps that can be performed on the structure of FIG. 18*d* in manufacturing a main wall, again such as that of FIGS. 3*k* and 4*g*, for a spacer according to the invention.
Figure 19B:
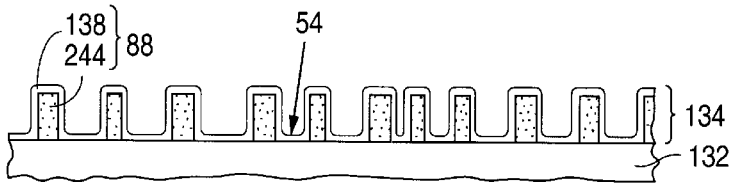
Figure 20A:
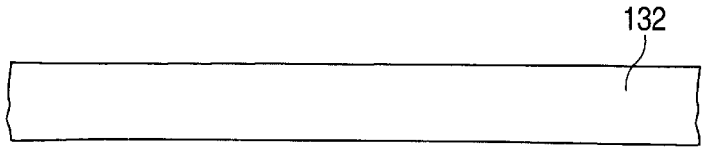
FIGS. 20*a*–20*c* are cross-sectional side views representing a seventh set of steps in manufacturing a main wall, such as that of FIG. 3*l*, for a spacer according to the invention.
Figure 20B:
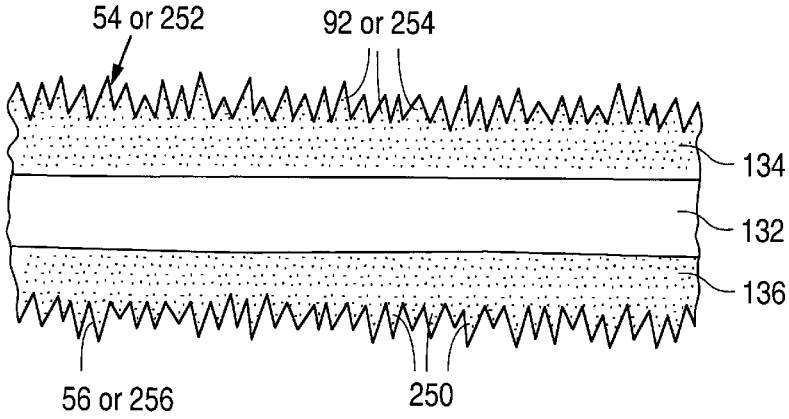
Figure 20C:
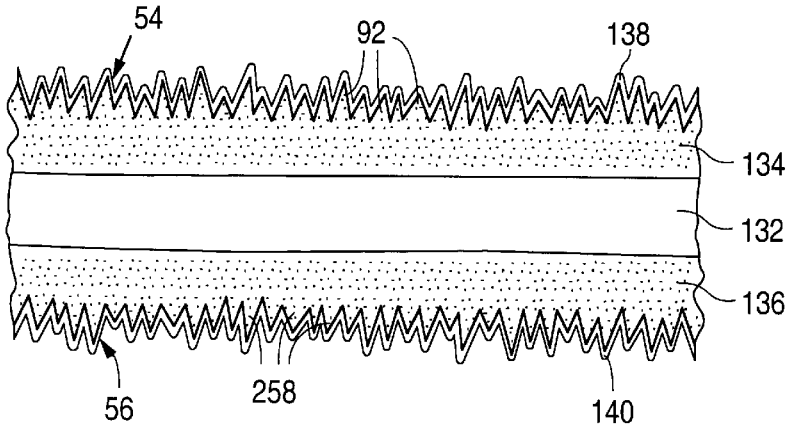

FIGS. 18*a*–18*e* (collectively "FIG. 18") illustrate a process sequence for manufacturing a sixth variation of main wall 46 according to the invention. FIGS. 19*a* and 19*b* (collectively "FIG. 19") depict steps that can alternatively be performed on the structure of FIG. 18*d* to produce wall 46 according to the invention. FIGS. 20*a*–20*c* (collectively "FIG. 20") illustrate a process sequence for manufacturing a seventh variation of wall 46 according to the invention. The roughness in wall 46 is produced by protuberances in the process sequences of FIGS. 18–20. When fabricated according to the process sequence of FIG. 18, including the alternative of FIG. 19, wall 46 appears generally as shown in FIGS. 3*k* and 4*g* and either FIG. 11*b* or FIG. 11*d*. Upon being fabricated according to the process sequence of FIG. 20, wall 46 appears generally as shown in FIG. 31 and either FIG. 11*b* or FIG. 11*d*. The manufacturing steps illustrated in FIGS. 13–20 are appropriately employed in the above-described process and process variations for fabricating spacer walls 24.

The starting point for the process sequence of FIG. 13 is either core substrate 132 or a larger wall-shaped precursor substrate from which two or more of substrates 132 can be made. To simplify the description, both substrate 132 and the larger precursor substrate are referred to here as the "core substrate" and are identified with reference symbol "132". See FIG. 13*a*. A pair of thin-film composites 150 and 152 are respectively formed on the two opposing faces of core substrate 132 as shown in FIG. 13*b*. Each of thin-film composites 150 and 152 is a layer consisting of support material and further material interspersed with each other. The support material is solid. The further material may be solid or liquid. Consequently, composites 150 and 152 may be solid or liquidous.

Various techniques can be utilized to form thin-film composites 150 and 152 on core substrate 132. If the further material is liquid, part of a liquidous composition of the support material and the further material can be deposited on both faces of core substrate 132. Spinning may be utilized to ensure that composites 150 and 152 are of relatively uniform thickness. Alternatively, core substrate 132 can be dipped in the liquidous composition.

If the further material is solid, a liquidous composition of the support material, the further material, and a suitable liquid is prepared. Layers of the liquidous composition are respectively formed on both faces of core substrate 132. Either a deposition step, typically including a spinning step, or a dipping step of the type described in the previous paragraph can be utilized to form the liquidous layers. A drying operation is performed to remove at least part of the liquid, thereby creating thin-film composites 150 and 152.

At least part of the further material in thin-film composites 150 and 152 is removed to convert them into solid porous layers that respectively implement rough-faced layers 134 and 136. FIG. 13*c* illustrates the structure at this point. If conformal coatings 138 and 140 are not to be provided over rough layers 134 and 136, main wall 46 appears as shown in FIG. 13*c*. Irregular pores 64 extend into layer 134 along rough face 54. Irregular pores 154 extend into layer 136 along rough face 56. Wall 46 in FIG. 13*c* implements FIGS. 3*c* and 11*b*.

If conformal coatings 138 and 140 are to be provided over rough layers 134 and 136, the combination of core substrate 132 and layers 134 and 136 in FIG. 13*c* forms a wall-shaped primary body 156. Layer 134 has a rough face 158 along which there are irregular pores 160. Layer 136 has a rough face 162 along which irregular pores 154 are present. Main wall 46 appears as depicted in FIG. 13*d* upon forming coatings 138 and 140 respectively on rough faces 158 and 162. Irregular pores 64 extend into coating 138 and layer 134 along rough face 54, pores 160 having been converted into pores 64. Irregular pores 164 extend into coating 140 and layer 136 along rough face 56, pores 154 having been converted into pores 164. Wall 46 in FIG. 13*d* implements FIGS. 3*c* and 11*d*.

Depending on various factors, pores 154 and either pores 64 or pores 160 in FIG. 13*c* may, or may not, be distributed largely throughout through layers 134 and 136. Likewise, there may, or may not, be pores 154 and either pores 64 or pores 160 located fully below rough faces 54 and 56 or rough faces 158 and 162 at the stage of FIG. 13*c*. In either case, if conformal coatings 138 and 140 are provided, they largely extend only into pores 160 and 154 situated along rough faces 158 and 162.

Figure 13A:
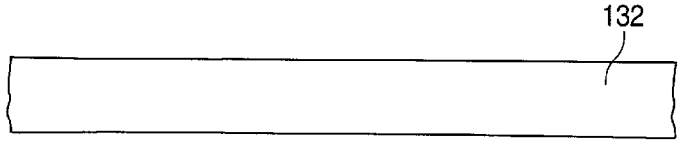
FIGS. 13*a*–13*d* are cross-sectional side views representing a first set of steps in manufacturing a main wall, such as that of FIG. 3*c*, for a spacer according to the invention.
Figure 13B:
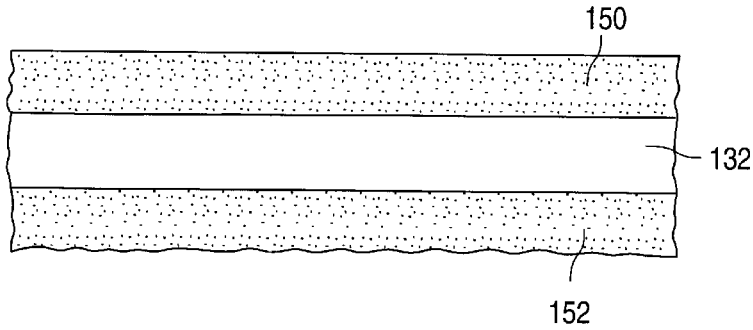
Figure 13C:
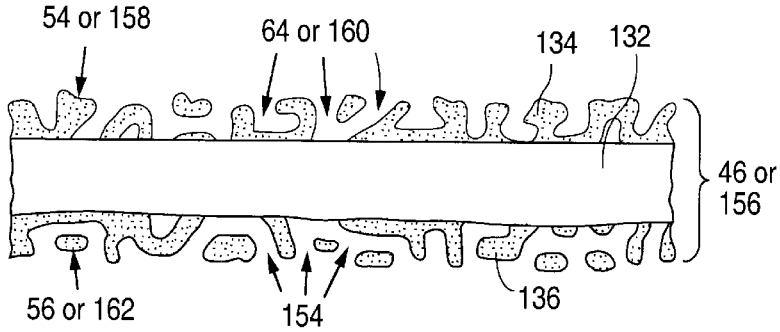
Figure 13D:
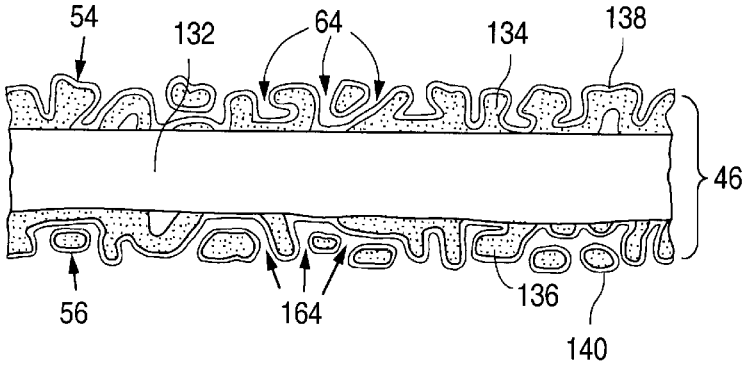

Various procedures may be utilized to go from the stage of FIG. 13*a* to the stage of FIG. 13*c*. In one procedure, the support material of thin-film composites 150 and 152 consists of ceramic, while the further material consists of carbon-containing material, typically organic material such as polymeric organic material. Parts of a composition containing the carbon-containing material and particles of the ceramic are provided over the two faces of core substrate 132 to form composites 150 and 152 as depicted in FIG. 13*b*.

The carbon-containing material may be liquid or solid. If the carbon-containing material is liquid, pyrolysis in an oxidizing environment is normally employed to remove the carbon-containing material. The pyrolysis typically entails subjecting the structure consisting of core substrate 132 and composites 150 and 152 to a temperature of 200–900° C., typically 400–600° C., in air or oxygen. The structure of FIG. 13*c* is thereby produced. Other oxidants such as ozone or nitrous oxide can be used in place of air or oxygen to form the oxidizing environment. The pyrolysis temperature can then typically be reduced. Also, the pyrolysis temperature can readily be reduced to 250° C. when the thickness of each of composites 150 and 152 is in the vicinity of 1 $\mu$m or less. If the carbon-containing material is solid, the carbon-containing material is removed by pyrolysis as described above or by subjecting composites 150 and 152 to a suitable plasma, e.g., an oxygen-containing plasma. The structure of FIG. 13*c* is again produced. The average diameter of pores 154 and either pores 64 or pores 160 is typically 5–1,000 nm.

The carbon-containing material may be, or may include, a polymeric precursor. If so, polymerization of the polymeric precursor may occur in going from the point at which the precursor is initially provided over core substrate 132 to the stage of FIG. 13*c*.

In another process for going from the stage of FIG. 13*a* to the stage of FIG. 13*c*, thin-film composites 150 and 152 are provided over core substrate 132 as gels, i.e. semi-solid structures, or as liquid-filled open networks of solid material. If composites 150 and 152 are gels, the support material largely defines the shape of each gel. The further material consists of liquid distributed largely throughout the gels. If composites 150 and 152 are open networks of solid material, the support material forms the shape-defining solid networks while the further material consists of liquid occupying interstices in the solid network.

The gels or liquid-filled open solid networks are created from a ceramic polymeric precursor or from ceramic particles. Thin-film solid composites 150 and 152 in this procedure can be generally formed according to the porous-ceramic preparation techniques described in Saggio-Woyansky et al, "Processing of Porous Ceramics," *Technology,* November 1992, pages 1674–1682, or the sol-gel techniques described in Hench et al, "The Sol-Gel Process," *Chem. Rev.,* Vol. 90, No. 1, pages 33–72, and Brinker et al, "Sol-Gel Thin Film Formation," *J. Cer. Soc. Japan, Cent. Mem. Iss.,* Vol. 99, No. 10, 1991, pages 862–877. The contents of Saggio-Woyansky et al, Hench et al, and Brinker et al are incorporated by reference herein.

When composites 150 and 152 are polymeric gels, the support material in the gels typically consists of polymerized alkoxide. The ceramic cations in the gels are typically silicon and/or one or more other non-carbon elements in Groups 3b, 4b, 5b, 6b, 7b, 8, 1b, 2b, 3a, and 4a of Periods 2–6 of the Periodic Table, including the lanthanides. At least part of the liquid in each gel is typically a byproduct of the gel processing.

Rough layers 134 and 136 are created as porous layers by removing at least part of the liquid in the gels or liquid-filled open solid networks without causing the support material to fully collapse and complete fill the space previously occupied by the removed liquid. Heat is normally applied to the porous layers to reduce their porosity to a desired level. Further polymerization or other cross-linking may occur in the course of removing the liquid, especially during the heat treatment. In FIG. 13*c*, the support material of porous layers 134 and 136 typically consists of oxide, and possible hydroxide, of one or more non-carbon elements in Groups 3b, 4b, 5b, 6b, 7b, 8, 1b, 2b, 3a, and 4a of Periods 2–6 of the Periodic Table, including the lanthanides. The average diameter of pores 154 and either pores 64 or pores 160 is again typically 5–1,000 nm.

A third procedure for going from the stage of FIG. 13*a* to that of FIG. 13*c* entails creating thin-film composites 150 and 152 as slurries of a powder of metal hydroxide. The support material is the metal hydroxide powder, while the further material is a liquid, typically water, in the slurries. The metal in the metal hydroxide powder is typically one or more of aluminum, titanium, chromium, manganese, and neodymium. Rough layers 134 and 136 are created as porous layers of ceramic green tape by firing the slurries so as to remove only part of the liquid.

In a general fourth procedure for going from the stage of FIG. 13*a* to the stage of FIG. 13*c*, thin-film composites 150 and 152 are created as solid composites, typically by providing suitable liquidous material over core substrate 132 and then removing the liquid. The further material in composites 150 and 152 is then removed by an etching operation to form rough layers 134 and 136. The etching operation can be performed according to a plasma, reactive-ion, chemical, or electrochemical technique, or according to a combination of two or more of these etching techniques. In some cases, ion bombardment can be utilized in the etching operation.

Turning to the process sequence of FIG. 14, the starting point again is "core substrate 132" as specified for the process sequence of FIG. 13. That is, the process sequence of FIG. 14 begins either with core substrate 132 or with a larger wall-shaped precursor substrate from which multiple substrates 132 can be made, both substrate 132 and the larger precursor substrate being referred to as the "core substrate" and being identified by reference symbol "132". See FIG. 14*a*.

A liquidous composition, or slurry, is prepared from a liquid, particles of a support material, and further particles of different chemical composition than the support material. The chemical nature of the support material is normally chosen such that, in final spacer wall 24, total natural electron yield coefficient a of the support material is relatively low, normally no more than 2.0, preferably no more than 1.6. For this purpose, the support material is typically an oxide of metal such as chromium or/and neodymium. The further particles typically consist of organic material such as latex or/and polystyrene.

The further particles are normally rounded. Preferably, the further particles are roughly spherical so they have roughly constant radius of curvature. The further particles have an average diameter in the range of 50–500 nm. The average diameter of the further particles is typically relatively uniform from particle to particle but can vary significantly from one particle to another.

Figure 14A:
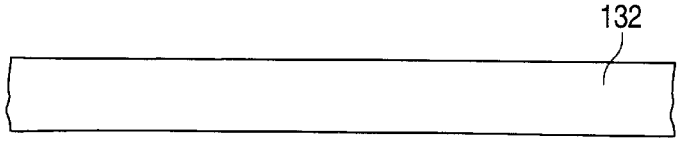
FIGS. 14*a*–14*e* are cross-sectional side views representing a second set of steps in manufacturing a main wall, such as that of FIGS. 3*d* and 4*b*, for a spacer according to the invention.
Figure 14B:
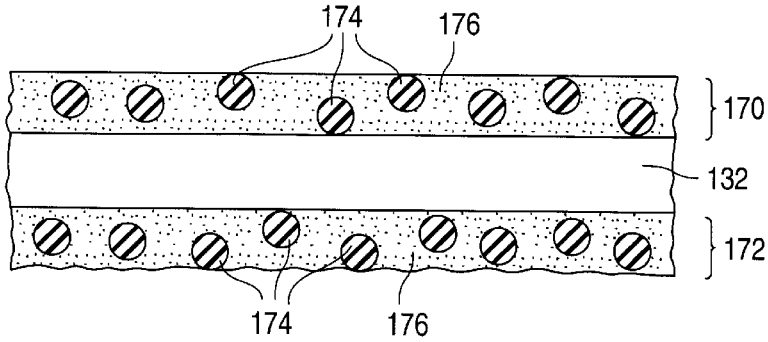

Portions of the liquidous composition are provided on the two faces of core substrate 132 to respectively form thin liquidous bodies, or films, 170 and 172. See FIG. 14*b*. Items 174 in FIG. 14*b* are the rounded further particles present in liquidous films 170 and 172. Items 176 indicate the combination of the liquid and the support-material particles in films 170 and 172.

Liquidous films 170 and 172 can be formed by depositing parts of the liquidous composition on the opposite faces of core substrate 132. A spinning step can be performed to ensure that the thickness of each of films 170 and 172 is relatively uniform. Alternatively, core substrate 132 can be dipped in the liquidous composition to form films 170 and 172. FIG. 14*b* illustrates an example which the formation of films 170 and 172 is performed in such a manner that no more than a monolayer of rounded particles 174 overlies each face of core substrate 132. It is often preferably that more than a monolayer of particles 174 overlie each substrate face.

Figure 14C:
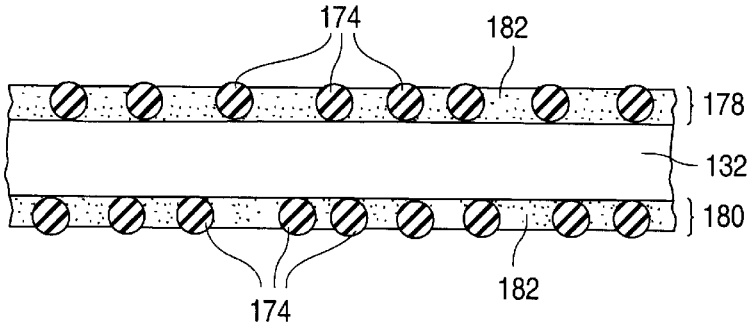

The liquid in thin films 170 and 172 is removed to produce the structure shown in FIG. 14*c*. The liquid-removal step can be performed by allowing films 170 and 172 to dry and/or subjecting them to elevated temperature. Items 178 and 180 in FIG. 14*c* are the respective remainders of films 170 and 172. During the liquid-removal step, the particles of the support material bond together to form solid support material 182. Each of films 178 and 180 is a thin solid composite in which rounded particles 174 are distributed in a largely random manner throughout solid support material 182.

In the illustrated example, no more than a monolayer of rounded particles 174 is present in each of thin-film composites 178 and 180. The formation of liquidous films 170 and 172 and the removal of the liquid in films 170 and 172 is done in such a manner that particles 174 protrude out of support material 182 in composites 178 and 180. FIG. 14*c* illustrates an example in which less than half of each particle 174 protrudes out of support material 182. Alternatively, more than half of each particle 174 can protrude out of support material 182.

If liquidous films 170 and 172 each consist of more than a monolayer of rounded particles 174, more than a monolayer of particles 174 is present in each of thin-film composites 178 and 180. In that case, parts of those particles 174 most distant from core substrate 132 protrude out of support material 182. Other particles 174 are fully covered by material 182.

Figure 14D:
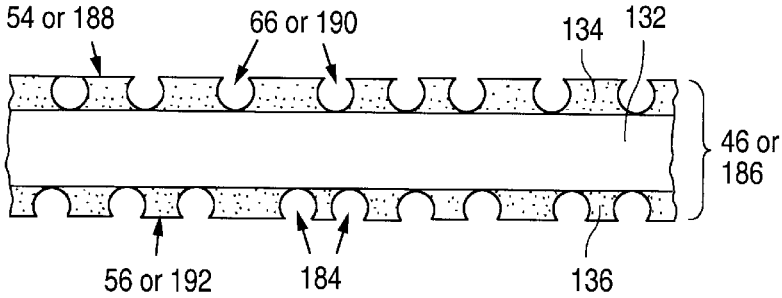

When no more than a monolayer of rounded particles 174 is present in each of thin-film composites 178 and 180, all (or largely all) of rounded particles 174 are removed from composites 178 and 180 to produce the structure shown in FIG. 14*d*. If more than a monolayer of particles 174 is present in each composite 178 or 180, particles 174 that protrude out of support material 182 are removed along with particles 174 coupled to protruding particles 174 directly or by way of one or more intervening particles 174. Particles 174 exposed to the external environment through openings such as pores and cracks are also removed during the particle removal. In this case, some particles 174 that do not protrude out of material 182 may not be removed during the particle-removal operation. These particles 174 are typically present in final spacer wall 46 and do not significantly affect FED performance.

The removal of part or (largely) all of particles 174 from thin-film composites 178 and 180 acts to roughen their exterior faces, thereby converting composites 178 and 180 respectively into rough layers 134 and 136. An etching operation is typically employed to perform the particle removal. The etching operation can be done with a plasma, according to a reactive-ion etch technique, chemically, electrochemically, or using two or more of these etching techniques. Depending on the characteristics of particles 174 relative to support material 182, particles 174 may also be removed by bombarding them with an ion beam. When particles 174 consist of organic material, pyrolysis may be performed in an oxidizing environment to remove particles 174. The pyrolysis temperature is 200–900° C., typically 400° C.–600° C. Should the thickness of each of composites 178 and 180 be in the vicinity of 1 $\mu$m or less, the pyrolysis temperature can readily be lowered to as little as 250° C.

If conformal coatings 138 and 140 are not to be provided over rough layers 134 and 136 in the process sequence of FIG. 14, main wall 46 appears as shown in FIG. 14*d*. Three-dimensionally rounded recessions 66 extend into layer 134 along rough face 54. Three-dimensionally rounded recessions 184 extend into layer 136 along rough face 156. Wall 46 in FIG. 14*d* implements FIGS. 3*d*, 4*b*, and 11*b*. Recessions 66 and 184 are situated at the locations of removed particles 174.

Figure 14E:
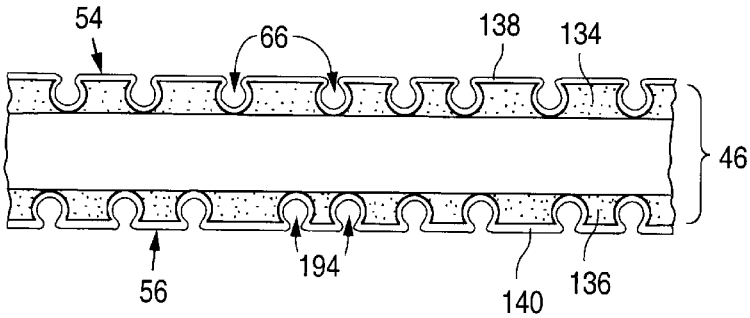

If conformal coatings 138 and 140 are to be provided over rough layers 134 and 136, the combination of core substrate 132 and layers 134 and 136 in FIG. 14*d* forms a wall-shaped primary body 186. Layer 134 has a rough face 188 along which there are three-dimensionally rounded recessions 190. Layer 136 has a rough face 192 along which rounded recessions 184 are present. Recessions 190 and 184 are situated at the locations of removed particles 174. The structure appears as shown in FIG. 14*e* upon forming coatings 138 and 140 respectively on rough faces 188 and 192. Rounded recessions 190 are converted into rounded recessions 66 that extend into coating 138 and layer 134 along rough face 54. Rounded recessions 184 are similarly converted into three-dimensionally rounded recessions 194 that extend into coating 140 and layer 136 along rough face 156. Main wall 46 in FIG. 14*e* implements FIGS. 3*d*, 4*b*, and 11*d*.

Instead of providing portions of the above-mentioned liquidous composition on the two faces of core substrate 132, portions of a liquidous composition of the support-material particles, the generally rounded particles, and the liquid can be provided on a generally flat surface of an auxiliary body to a thickness greater than that needed for primary substrate 130 in FIG. 11*a*. Considerably more than a monolayer of the rounded particles is present in the resulting liquidous layer. Further processing of the liquidous layer is conducted in the manner described above for processing liquidous films 170 and 172 in order to produce a flat, relatively thin solid composite in which the rounded particles are distributed throughout the solid support material.

The rounded particles are then removed along the two faces of the flat-solid composite to form primary substrate 130 or a larger wall-shaped precursor substrates from which multiple substrates 130 can be made. For convenience, both substrate 130 and the larger precursor substrate are referred to as the "primary substrate" and are identified by reference symbol "130". If conformal coatings 138 and 140 are not to be provided on the two faces of primary substrate 130, the resulting structure implements main wall 46 of FIGS. 3*d*, 4*b*, and 11*a*. If coatings 138 and 140 are provided on primary substrate 130, the resulting structure implements wall 46 of FIGS. 3*d*, 4*b*, and 11*c*.

The process sequence of FIG. 14 can be modified in additional ways. Before creating liquidous films 170 and 172, each of the faces of core substrate 132 can be provided with an underlayer of support material that adheres well to substrate 132 and to support material 182. The underlayer prevents substrate 132 from being exposed during the removal of rounded particles 174. By choosing the support material of the underlayer to be of lower total natural electron yield coefficient $\sigma$ than substrate 132 and by making the underlayer sufficiently thick, the underlayer blocks, i.e., masks out, the less desirable a characteristic of substrate 132. The support material of the underlayer can, for example, be the same as support material 182.

The further particles, such as rounded particles 174, can be replaced with further material that is dispersed throughout the support material on a microscopic, e.g., atomic or molecular, scale. For example, a wall-shaped electrically non-conductive primary body that serves as a precursor to primary substrate 130, or to the combination of core substrate 130 and rough layers 134 and 136, may contain silicon and carbon, at least along the two opposite faces of the primary body. An operation is performed to roughen both faces of the primary body by preferentially removing silicon from the faces. The resultant rough faces of the primary body consist primarily of carbon. This variation of the process sequence of FIG. 14 is advantageous because the carbon provides a surface facial roughness that reduces the total electron yield and also has a relatively low total natural electron yield coefficient a so as to further reduce the total electron yield.

In the preceding variation, material other than silicon may be present with carbon along the primary body's initial face. This other material is preferentially removed during the above-mentioned removal step so as to roughen both of the primary body's faces in such a way that they consist primarily of carbon. The removal of the silicon and/or other material can be performed in various ways such as etching. The etching can be done chemically, electrochemically, with a plasma, by reactive-ion etching, or by ion bombardment.

Only part of material of rounded particles 174 may be removed. The remainder of the particle material then coats the insides of pores 190 and 184. For example, when particles 174 consist of organic material, pyrolysis can be performed on particles 174 to largely remove their non-carbon material. The carbon that was in particles 174 then coats the insides of pores 190 and 184. The pyrolysis is done in a non-oxidizing (or non-reactive) environment at a temperature sufficient to cause the organic material to decompose into carbon material and non-carbon material. Most of the pyrolized non-carbon material normally becomes volatile during the pyrolysis and separates from the structure. The pyrolysis temperature is normally 200–900° C., typically 400–600° C.

FIG. 15 illustrates another variation of the process sequence of FIG. 14. The process sequence of FIG. 15 begins with core substrate 132 as specified for the process sequence of FIG. 13. FIG. 15*a* depicts an upper-face portion of core substrate 132. Although the lower face of core substrate 132 is not shown in FIG. 15, steps largely identical to those performed along the upper face of core substrate 132 are performed along its lower face.

Figure 15A:
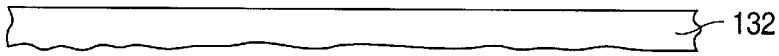
FIGS. 15*a*–15*f* are cross-sectional side views representing a third set of steps in manufacturing a main wall, again such as that of FIGS. 3*d* and 4*b*, for a spacer according to the invention.
Figure 15B:
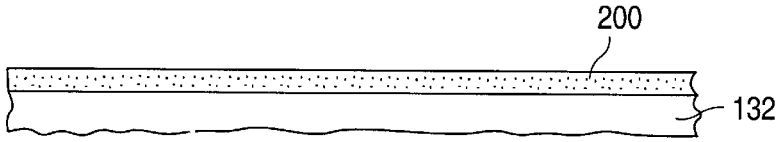
Figure 15C:
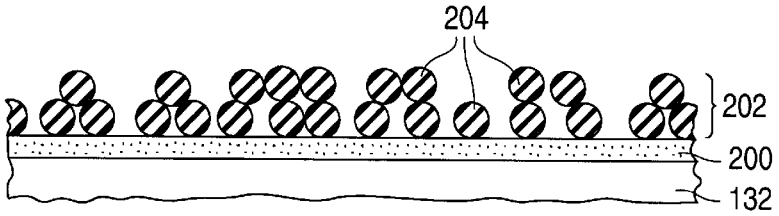

With the foregoing in mind, a lower layer 200 of support material is formed on the upper face of core substrate 132 as shown in FIG. 15*b*. Lower support layer 200 is typically created by (a) forming a liquidous composition, typically a slurry, of the support material and a suitable liquid, (b) providing a portion of the liquidous composition on the upper face of core substrate 132 typically by depositing the liquidous portion on core substrate 132 or dipping core substrate 132 into the liquidous composition, and (c) removing the liquid from the so-provided portion of the liquidous composition. The thickness of support layer 200 is normally 5–200 nm, typically 20 nm. The upper surface of layer 200 is typically relatively smooth but can be somewhat rough.

Lower support layer 200 serves two basic purposes. Firstly, support layer 200 acts as an adhesive (or adhesion) layer. That is, layer 200 adheres well to core substrate 132 and to additional material deposited on layer 200. Secondly, layer 200 is of lower total natural electron yield coefficient a than core substrate 132 and, in final spacer wall 24, is sufficiently thick to block the less desirable σ characteristics of core substrate 132. In final wall 24, coefficient σ of the support material in layer 200 is normally no more than 2.0, preferably no more than 1.6. The foregoing purposes are typically achieved by creating layer 200 as an oxide of metal such as chromium or neodymium.

A layer 202 of further particles 204 is deposited on lower support layer 200 to a thickness of one or more particle diameters. That is, the thickness of particle layer 202 is a monolayer or more of further particles 204. See FIG. 15*c* in which, for exemplary purposes, particle layer 200 is approximately two particle diameters in thickness and thus is more than a monolayer of particles 204 in thickness. Further particles 204 typically consist of organic material, preferably polymeric organic material such as latex. Alternative candidates for the organic material in particles 200 are polystyrene, styrene/divinylbenzene copolymer, polymethylmethacrylate, polyvinyltoluene, and styrene/butadiene copolymer. These alternative candidates typically have sulfate surface groups. Particles 204 are normally rounded, preferably having the geometrical and dimensional characteristics prescribed above for rounded particles 174.

Figure 15D:
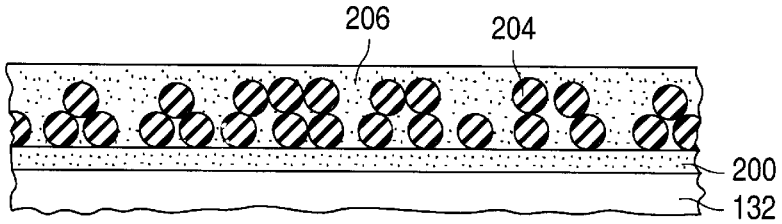

An upper layer 206 of support material is formed in the space between rounded particles 204 as shown in FIG. 15*d*. Upper support layer 206 is normally thick enough to cover at least the lower halves (lower hemispheres) of the bottom-most level (of diameters) of particles 204. Support layer 206 typically covers the lower halves of the topmost level of particles 206. Part of support layer 206 may fully cover the topmost level of particles 204 provided that the thickness of the support material on the tops of particles 204 in the topmost level is not so great as to hinder later removal of particles 204. Layer 206 is typically created in largely the same manner as lower support layer 200. Support layers 200 and 206 and particles 204 form a solid composite in which particles 204 are dispersed in a largely random manner relative to one another.

The chemical nature of the support material in upper layer 206 is chosen such that, in final spacer wall 24, total natural electron yield coefficient σ of the support material in layer 206 is relatively low, normally no more than 2.0, preferably no more than 1.6. The support material in layer 206 is thus normally of lower coefficient a than core substrate 132. Upper layer 206 typically consists of the same support material as lower layer 200. Hence, layer 206 is typically formed as an oxide of metal such as chromium or neodymium.

Rounded particles 204 in the topmost level and any underlying particles 204 that substantially touch topmost particles 204 or are substantially coupled to topmost particles 204 through one or more intervening particles 204 are removed. Also, particles 204 exposed to the external environment through various openings in support layer 206 are simultaneously removed. See FIG. 15*e*. The removal of the preceding particles 204 causes support layers 200 and 206 to be converted into rough layer 134. To the extent that layer 206 does not reach some of particles 204 such as those in the topmost particle level, no segments of rounded recessions are produced in layer 134 due to those particular particles 206.

Figure 15E:
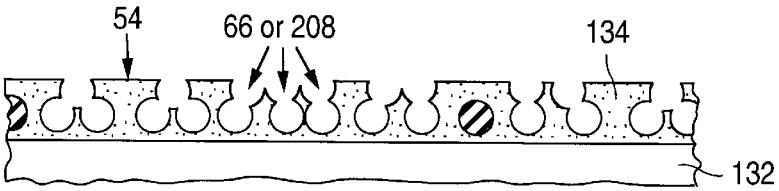
Figure 15F:
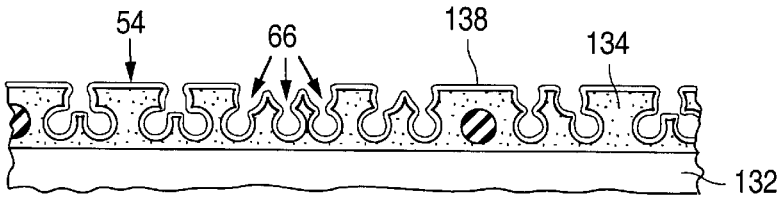

Depending on how the particle-removal operation is performed, some particles 204, or combinations of particles 204, that are fully surrounded by layer 134 may not be fully removed. The unremoved material of these particles 204, two examples of which are illustrated in FIG. 15*e*, forms part of layer 134 in final spacer wall 24. The presence of these unremoved particles 204 does not significantly affect FED operation.

The particle-removal operation can be performed in various ways. When rounded particles 204 consist of organic material, the particle-removal operation is typically done by pyrolysis in an oxidizing environment. The pyrolysis temperature is 200–900° C., typically 400–600° C. when the oxidizing environment is air or oxygen. By using ozone or nitrous oxide as the oxidizing environment, the pyrolysis temperature can be reduced. If the composite thickness of support layers 200 and 206 is in the vicinity of 1 μm or less, the pyrolyis temperature can be readily be as low 250° C. When support layers 200 and 206 consist primarily of chromium oxide, the pyrolysis causes the chromium oxide to densify. Alternatively, particles 204 can be removed by any of the etching techniques utilized to remove rounded particles 174 in the process sequence of FIG. 14.

When rough layer 134 consists primarily of chromium oxide in the process sequence of FIG. 15, it is typically not necessary to form conformal coating 138 over layer 134. In the absence of coating 138, the rough face of layer 134 then constitutes wall face 54. Three-dimensionally rounded recessions 66 extend into layer 134 along face 54. Recessions 66 are situated at the locations of removed particles 204. The structure of FIG. 15*e* then implements main wall 46 in FIGS. 3*d,* 4*b,* and 11*b.*

If desired, conformal coating 138 can be formed over rough layer 134 in the process sequence of FIG. 15. In this case, three-dimensionally rounded recessions 208 extend into rough layer 134 at the locations of removed particles 204 in FIG. 15*e.* Upon forming coating 138 over layer 134, the structure appears as shown in FIG. 15*f.* Rounded recessions 208 become rounded recessions 66 that extend into coating 138 and layer 134 along rough face 54. The structure of FIG. 15*f* implements main wall 46 in FIGS. 3*d,* 4*b,* and 11*d.*

The process sequence of FIG. 15 can generally be modified in the ways described above for the process sequence of FIG. 14. Specifically, the process sequence of FIG. 15 can be utilized to form primary substrate 130 or a larger precursor substrate from which multiple substrates 130 can be made. If conformal coating 138 is not provided, this modification implements main wall 46 in FIGS. 3*d,* 4*b,* and 11*a.* If coating 138 is provided, the modification implements wall 46 in FIGS. 3*d,* 4*b* and 11*c.* By using pyrolysis in a non-oxidizing environment, only the non-carbon material of rounded particles 204 can be removed so that carbon coats the inside of the three-dimensionally rounded recessions along rough face 54.

Figure 16A:
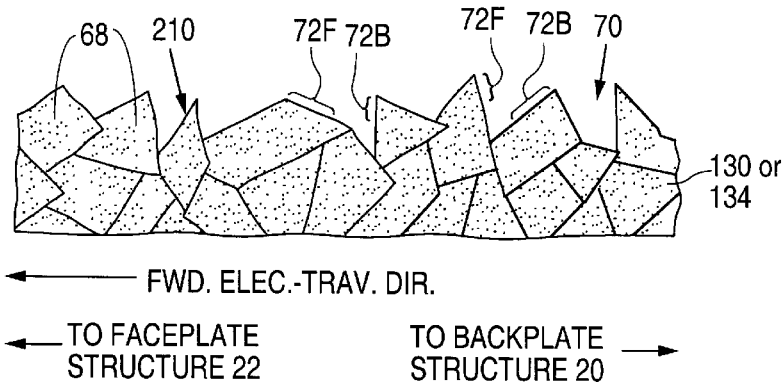

The starting point for the process sequence of FIG. 16 is one of the following: (a) primary substrate 130, (b) a larger precursor substrate from which multiple substrates 130 can be made, (c) a wall-shaped primary spacer body in which rough layer 134 overlies core substrate 132, and (d) a larger wall-shaped precursor body from which multiple substrates 132 and overlying rough layers 134 can be made. For convenience, both substrate 130 and the larger precursor to substrate 130 are referred to here as the "primary substrate" and are identified with reference symbol "130". Similarly, both layer 134 and the portion of the larger primary body used to make multiple layers 134 are referred to here as the "rough layer" and are identified with reference symbol "134". See FIG. 16*a.* Neither substrate 132 nor the portion of the larger wall-shaped primary body corresponding to multiple substrates 132 appears in FIG. 16*a.*

Primary substrate 130 or rough layer 134 has a rough face 210 defined by grains 68. Adjoining ones of grains 68 form valleys 70 along rough face 210. As described above, each valley 70 has a pair of outer-grain upper-half surfaces 72B and 72F that are continuous with each other. For each valley 70, outer-grain upper-half surface 72B is closest to backplate structure 20, while outer-grain upper-half surface 72F is closest to faceplate structure 22. At the stage of FIG. 16*a,* surfaces 72B and 72F of all valleys 70 are, on the average, normally of approximately the same steepness.

Figure 16B:
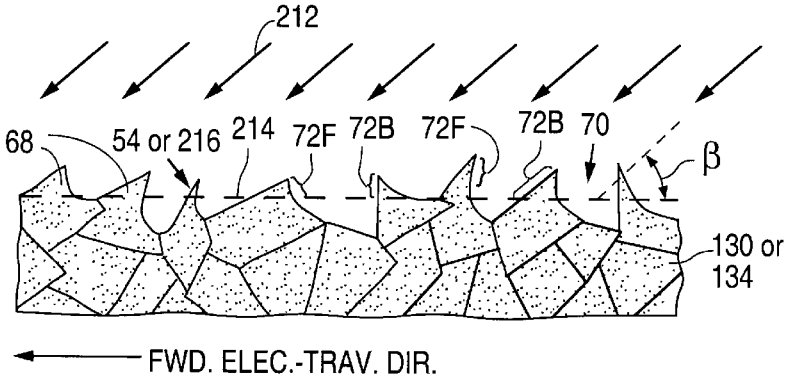

Referring to FIG. 16*b,* primary substrate 130 or rough layer 134 is etched with a beam of ions 212 that impinge on the rough face, originally face 210, of primary substrate 130 or rough layer 134 substantially non-perpendicular to most of an imaginary plane 214 that macroscopically approximates the rough face. Plane 214 is illustrated in dashed line in FIG. 16*b.* Relative to how primary substrate 130 or rough layer 134 is eventually positioned in the FED, ions 212 have a substantial etch component in the forward electron-travel direction. Ions 212 have substantially no etch component in the reverse electron-travel direction. In particular, ions 212 impinge on the rough face of primary substrate 130 or rough layer 134 at an average angle β to plane 214 and thus at average angle β to the forward electron-travel direction. Impingement angle β is normally 20–50°, typically 40°.

Part of the material along the rough face of primary substrate 130 or rough layer 134 is removed during the etching step. Because ions 212 impinge on the rough face at average angle β relative to the forward electron-travel direction, more material is removed from the half of each valley 70 closest to faceplate structure 22 than from the half of each valley 70 closest to backplate structure 20. Consequently, the average steepness of outer-grain upper-half surfaces 72F is now greater than the average steepness of outer-grain upper-half surfaces 72B. Using the terminology employed above in connection with FIG. 3*f,* this difference in average steepness provides the rough face of primary substrate 130 or rough layer 134 with a directional roughness characteristic in which, along upper-half surfaces 72B and 72F, the outer grain surfaces generally visible from backplate structure 20 are of greater average steepness than the outer grain surfaces generally visible from faceplate structure 22.

Ions 212 are normally particles that physically erode the rough face of primary substrate 130 or rough layer 134 but do not otherwise significantly interact with grains 68. For example, no significant chemical activity normally occurs between ions 212 and grains 68. Ions 212 are typically inert gas ions such as argon ions. Instead of ions 212, the etch operation can be performed with other particles, such as ionized atom clusters or/and abrasive powders, that directly erode the rough surface of primary substrate 130 or rough layer 134 in the preceding manner without otherwise significantly interacting with grains 68. Alternatively, ions 212 or these other particles may chemically react with grains 68 in addition to physically eroding grains 68 in the directional manner described above. The chemical reaction serves to enhance the erosion caused by the ion bombardment.

Figure 16C:
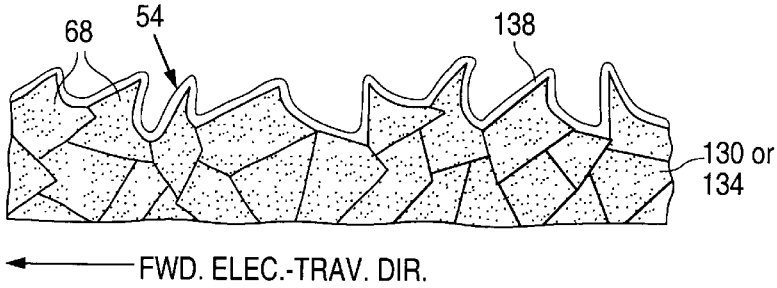

If conformal coating 138 is not to be provided over primary substrate 130 or rough layer 134, the etch with ions 212 transforms initial rough face 210 into further roughened face 54. The structure in FIG. 16*b* then implements FIG. 3*f* and either FIG. 11*a* (primary substrate 130) or FIG. 11*c* (rough layer 134). If coating 138 is to be provided over primary substrate 130 or rough layer 134, initial rough face 210 is transformed into further roughened face 216. Upon providing coating 138 on rough face 216, the resultant structure appears as shown in FIG. 16*c* and implements FIG. 3*f* and either FIG. 11*b* (primary substrate 130) or FIG. 11*d* (rough layer 134).

Moving to the process sequence of FIG. 17, the starting point is "core substrate 132" as specified for the process sequence of FIG. 13. See FIG. 17*a*. A pair of layers 220 and 222 of metal capable of being anodically oxidized to form porous films are respectively formed on the two opposing faces of core substrate 132 as shown in FIG. 17*b*. The metal is typically aluminum.

Metal layers 220 and 222 are then anodically oxidized to convert them into porous layers that respectively implement rough layers 134 and 136. See FIGS. 17*c*. With the metal being aluminum, techniques for performing the anodic oxidation are described in Furneaux et al, "The formation of controlled-porosity membranes from anodically oxidized aluminum," *Letters to Nature,* Vol. 337, Jan. 12, 1989, pages 147–149. The contents of Furneaux et al are incorporated by reference herein.

Figure 17A:
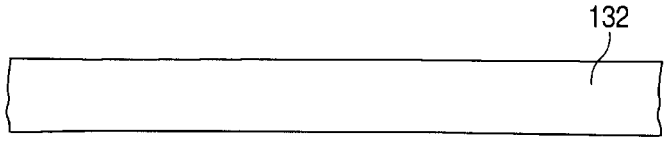
FIGS. 17*a*–17*d* are cross-sectional side views representing a fifth set of steps in manufacturing a main wall, such as that of FIGS. 3*a* and 4*a*, for a spacer according to the invention.
Figure 17B:
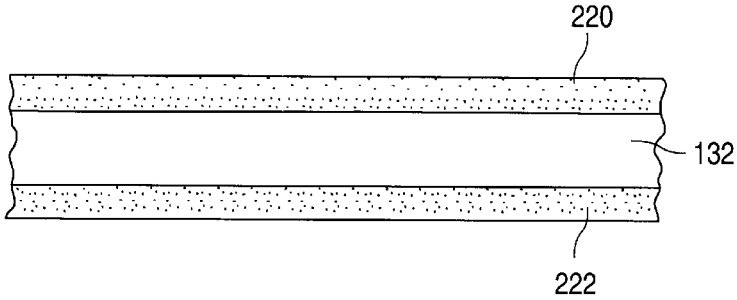
Figure 17C:
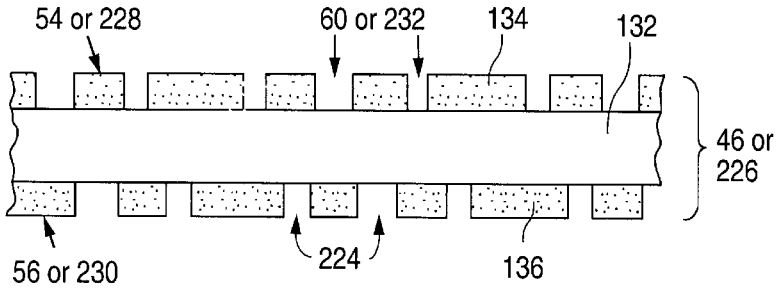

If conformal coatings 138 and 140 are not to be provided on rough layers 134 and 136, main wall 46 appears as shown in FIG. 17*c*. Generally straight pores 60 and 224 are respectively situated along rough faces 54 and 56, and respectively extend substantially through layers 134 and 136 down to core substrate 132. Wall 46 in FIG. 17*c* implements FIGS. 3*a,* 4*a,* and 11*b*.

Figure 17D:
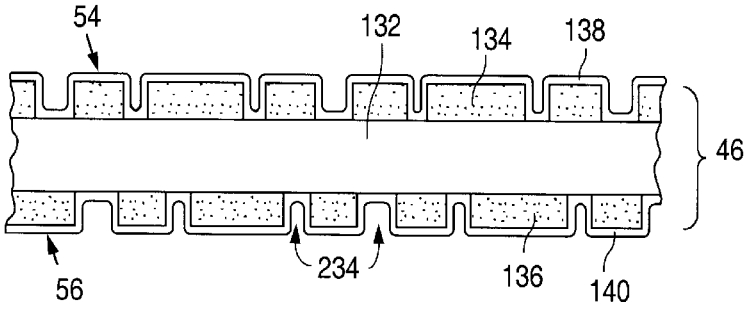

If conformal coatings 138 and 140 are to be provided over rough layers 134 and 136, the combination of core substrate 132 and layers 134 and 136 in FIG. 17*c* forms a wall-shaped primary body 226. Layers 134 and 136 respectively have rough faces 228 and 230. Pores 232 and 224 are situated respectively along rough faces 218 and 220, and extend respectively through layers 134 and 136 down to core substrate 132. Main wall 46 appears as depicted in FIG. 17*d* after forming coatings 138 and 140 respectively on faces 228 and 230. Wall 46 in FIG. 17*d* implements FIGS. 3*a,* 4*a,* and 11*d*.

The techniques employed in FIGS. 13–17 basically entail providing roughness in a pair of opposing faces of a wall-shaped primary body formed with primary substrate 130 or with a combination of core substrate 132 and layers 134 and 136. Another way to accomplish such roughening is to provide trenches in the faces of the primary body. The trenches, an example of which consists of trenches 80 in FIG. 3*h,* can be created by a selective etching technique using a mask to prevent the primary body from being etched in the regions between the trenches.

The trenches can be formed directly in primary substrate 130 or in rough layers 134 and 136 that overlie core substrate 132. The so-trenched structure forms main wall 46 or can be cut up to form multiple main walls 46. Conformal coatings 138 and 140 can also be added to the trenched structure that implements each wall 46.

Alternatively, starting with a wall-shaped primary body having a pair of opposing generally smooth faces, protuberances can be formed on both smooth faces to convert them into rough faces. The protuberances can be in a regular pattern as exemplified by ridges 82 in FIG. 3*i,* or in random locations as exemplified by protuberances 84 in FIG. 3*j*. In fabricating main wall 46 in FIG. 3*i,* ridges 82 can be formed in a desired pattern by selectively depositing ridge material on an otherwise flat portion of wall 46. Alternatively, a blanket layer of the ridge material can be deposited on the flat portion of wall 46 after which ridges 82 are formed in a selected pattern by selectively removing portions of the ridge material, typically using a suitable mask.

Similar to the trenches, the ridges can be formed directly on primary substrate 130 or on rough layers 134 and 136. The so-ridged structure forms main wall 46 or can be cut up to form multiple walls 46. Conformal coatings 138 and 140 can also be added to the ridged structure that implements each wall 46.

The process sequence of FIG. 18 begins with "core substrate 132" as specified for the process sequence of FIG. 13. An upper-face portion of core substrate 132 is depicted in FIG. 18*a*. Although the lower face of core substrate 132 is not shown in FIG. 18, steps largely identical to those performed along the upper face of core substrate 132 are performed along its lower face.

Figure 18A:
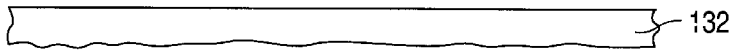
FIGS. 18*a*–18*e* are cross-sectional side views representing a sixth set of steps in manufacturing a main wall, such as that of FIGS. 3*k* and 4*g*, for a spacer according to the invention.
Figure 18B:
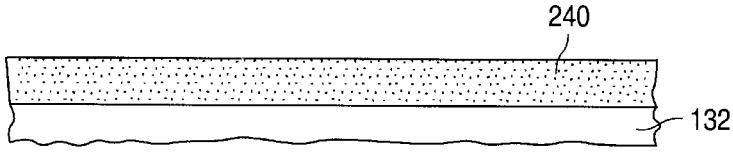
Figure 18C:
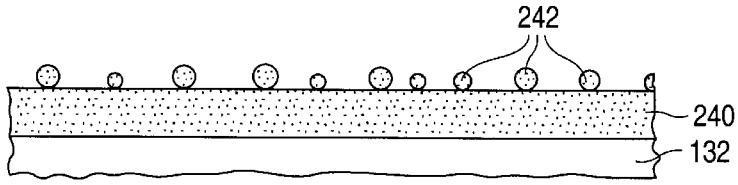

A precursor layer 240 of pedestal material is deposited on the upper face of core substrate 132 as depicted in FIG. 18*b*. The upper face of precursor pedestal layer 240 is quite smooth. Precursor layer 240 typically consists of electrically resistive material.

Particles 242 are provided at largely random locations on the upper face of precursor pedestal layer 240. See FIG. 18*c*. Particles 242 typically consist of electrically conductive material such as metal but can be formed with electrically non-conductive material. When particles 242 consists of metal, they can be provided on precursor layer 240 by depositing a thin layer of the metal on layer 240 and then heating the metal layer to cause it to break up into particles 242. Particles 242 can also be formed on layer 240 by, for example, providing a liquidous composition of the particles and a suitable liquid on layer 240 and then removing the liquid. Particles 242 can also be sprayed on layer 240. Particles 242 can have various shapes and sizes, depending on how they are provided on layer 240.

Figure 18D:
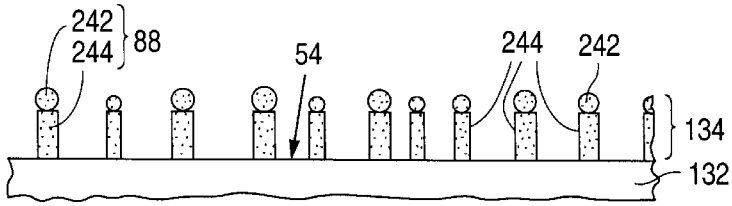

Using particles 242 as etch masks, the pedestal material not covered by particles 242 is removed with a suitable etchant. FIG. 18*d* depicts the resultant structure in which the remainder of precursor pedestal layer 240 consists of pedestals 244 that respectively underlie particles 242. The etch step is typically performed in a largely anisotropic manner so that each pedestal 244 is largely cylindrical in shape. That is, each pedestal 244 is of largely uniform cross section as viewed vertically. Each pedestal 244 and overlying particle 242 constitute a pillar 242/244. Pillars 242/244 form rough layer 134.

Figure 18E:
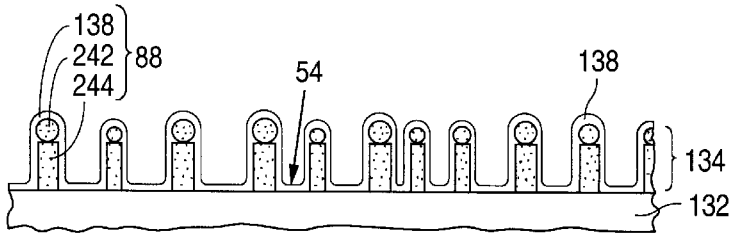

Particles 242 may, or may not, be removed. If particles 242 remain in place and if conformal coating 138 is not to be provided over rough layer 134 in the process sequence of FIG. 18, each pillar 242/244 constitutes one of pillars 88. The structure of FIG. 18*d* implements main wall 46 in FIGS. 3*k,* 4*g,* and 11*b*. If coating 138 is to be provided over layer 134 with particles 242 remaining in place, the structure appears as shown in FIG. 18*e* after providing coating 138. Each pillar 242/244 and the overlying part of coating 138 form one of pillars 88. The structure of FIG. 18*e* implements wall 46 in FIGS. 3*k,* 4*g,* and 11*d*.

Turning to the process variation of FIG. 19, particles 242 can be removed at the stage shown in FIG. 18*d*. The resultant structure appears as shown in FIG. 19*a*. Pedestals 244 form rough layer 134. If conformal coating 138 is not to be provided over layer 134 in the process variation of FIG. 19, each pedestal 244 constitutes one of pillars 88. The structure of FIG. 19*a* implements main wall 46 in FIGS. 3*k,* 4*g,* and 11*b*. If coating 138 is to be provided over layer 134 in the process variation of FIG. 19, the structure appears as depicted in FIG. 19*b* after coating 138 is so provided. Each pedestal 244 and the overlying part of coating 138 form one of pillars 88. The structure of FIG. 19*b* implements wall 46 in FIGS. 3*k,* 4*g,* and 11*d*.

The starting point for the process sequence of FIG. 20 again is "core substrate 132" as specified for the process sequence of FIG. 13. See FIG. 20*a*. Rough layers 134 and 136 are formed on the opposite faces of core substrate 132. The formation of layers 134 and 136 is done in such a way that the outer face of each of layers 134 and 136 is shaped as multiple spires adjoining one another along their bottoms but otherwise situated randomly relative to one another. FIG. 20*b* illustrates the resultant spired structure. Techniques such as sputtering and chemical vapor deposition can be employed to form layers 134 and 136 in this manner.

If conformal coatings 138 and 140 are not to be provided over rough layers 134 and 136 in the process sequence of FIG. 20, spires 92 are present along face 54 of rough layer 134. Spires 250 are present along face 56 of rough layer 136. The structure in FIG. 20*b* implements main wall 46 of FIGS. 3*l* and 11*b*.

If conformal coatings 138 and 140 are to be provided over rough layers 134 and 136 in the process sequence of FIG. 20, layer 134 has a rough face 252 along which spires 254 are present. Layer 136 has a rough face 256 along which spires 250 are present. Upon providing coatings 138 and 140, spires 252 are converted into spires 92 as shown in FIG. 20*c*. Spires 250 are similarly converted into spires 258. The structure in FIG. 20*c* implements main wall 46 of FIGS. 3*l* and 11*d*.

When conformal coatings 138 and 140 consist of carbon, one technique for creating coatings 138 and 140 of carbon is to chemically vapor deposit carbon on primary substrate 130 or on a larger wall-shaped primary body from which multiple substrates 130 can be made. Similarly, carbon can be chemically vapor deposited on rough walls 134 and 136 or on a larger wall-shaped primary body from which multiple main walls 46 containing components 132, 134, and 136 can be made.

Another technique for creating conformal coatings 138 and 140 of carbon is to thermally decompose carbon-containing material over primary substrate 130 or on a larger wall-shaped primary body from which multiple substrates 130 can be made. Likewise, coatings 138 and 140 can be formed as carbon by thermally decomposing carbon-containing material over the exterior faces of rough layers 134 and 136 or over the exterior faces of a larger wall-shaped primary body from which multiple main walls 46 containing components 132, 134, and 136 can be made. The carbon containing material is typically a hydrocarbon such as ethyne (acetylene). When primary substrate 130 or rough layers 134 and 136 consist of porous silicon oxide, typically of the aerogel-type, the thermal decomposition of ethyne to form carbon is typically done at 500–800° C.

An anneal operation is conducted in the course of forming primary substrate 130 as porous silicon oxide of the aerogel-type or in forming a porous aerogel-type silicon-oxide wall-shaped primary body from which multiple substrates 130 can be made. An anneal operation is likewise conducted in forming porous silicon oxide of the aerogel type on core substrate 132 to create rough layers 134 and 136 or in forming a pair of thin porous aerogel-type silicon-oxide layers on a wall-shaped substrate to create a structure from which multiple main walls 46 containing components 132, 134, and 136 can be made. Thermal decomposition of carbon-containing material to form conformal coatings 138 and 140 as carbon can be done during these anneal operations. Again, the carbon-containing material is typically a hydrocarbon such as ethyne.

Additional Variations

Directional terms such as "lateral", "above", and "below" have been employed in describing the present invention to establish a frame of reference by which the reader can more easily understand how the various parts of the invention fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, the spacers in the spacer system can be formed as posts or as combinations of walls. The cross-section of a spacer post, as viewed along the length of the post, can be shaped in various ways such a circle, an oval, or a rectangle. As viewed along the length of a spacer consisting of a combination of walls, the spacer can be shaped as a "T", an "H", or a cross.

The sheet resistance $R_{\square}$ of a spacer of arbitrary shape is approximately:

$$R_{\square} = \frac{RP_{DAV}}{2L} \tag{15}$$

where R is the spacer's resistance between plate structures 20 and 22, $P_{DAV}$ is the average dimension of the perimeter of the spacer as viewed in the forward (or reverse) electron-travel direction, and L is the length of the spacer in the forward (or reverse) electron-travel direction. Ignoring the thickness of a wall-shaped spacer (including a spacer shaped like a curved wall), perimeter $P_{DAV}$ of a wall-shaped spacer is twice its average width $W_{AV}$ as viewed in the forward electron-travel direction. For a wall-shaped spacer, Eq. 15 simplifies to:

$$R_{\square} = \frac{RW_{AV}}{L} \tag{16}$$

By using Eqs. 15 and 16, the sheet resistance information specified above for main wall 46 in wall-shaped spacer 24 can be correlated to that appropriate to a spacer shaped as a post, as a combination of walls, or in another configuration besides a single wall.

Field emission includes the phenomenon generally termed surface conduction emission. Backplate structure 20 that operates in field-emission mode can be replaced with an electron emitter that operates according to thermionic emission or photoemission. Rather than using control electrodes to selectively extract electrons from the electron-emissive elements, the electron emitter can be provided with electrodes that selectively collect electrons from electron-emissive elements which continuously emit electrons during display operation. Various modifications and applications may thus be made by those skilled in the art without departing from the true scope and spirit of the invention as defined in the appended claims.

We claim:

1. A flat-panel display comprising:

a first plate structure for emitting electrons;

a second plate structure, situated opposite the first plate structure, for emitting light to produce an image upon receiving electrons emitted by the first plate structure, an electric field of average strength $E_{AV}$ being directed from the second plate structure to the first plate structure during operation of the display; and a spacer situated between the plate structures, the spacer comprising a spacer wall having a face that extends at least partway from either plate structure to the other plate structure, the wall's face having roughness which, as approximated by identical parallel cylindrical pores of pore diameter $d_P$, corresponds to a wall porosity of at least 10% along the wall's face and a pore height $h_P$ of at least 15% of pore height parameter $h_{MD}$ that equals $\sqrt{2d_P\epsilon_{2DMD}/eE_{AV}}$, where e is the electron charge, and $\epsilon_{2DMD}$ is the median departure energy of secondary electrons emitted by the wall, the roughness in the wall's face comprising depressions or/and protuberances in the wall's face, each depression or protuberance extending only partway across the wall's face.

2. A display as in claim 1 wherein the roughness in the wall's face inhibits secondary electrons emitted by the wall from escaping the wall.

3. A display as in claim 1 wherein the representation of the roughness in the wall's face by the cylindrical pores ideally has the same total roughness-modified electron yield coefficient as actually occurs with the roughness in the wall's face.

4. A display as in claim 1 wherein median departure energy $\epsilon_{2DMD}$ is 5–15 eV.

5. A display as in claim 1 wherein pore height $h_P$ is at least 50% of pore height parameter $h_{MD}$.

6. A display as in claim 5 wherein pore height $h_P$ is at least 90% of pore height parameter $h_{MD}$.

7. A display as in claim 1 wherein the wall porosity is at least 20% along the wall's face.

8. A display as in claim 1 wherein the wall porosity is at least 40% along the wall's face.

9. A display as in claim 1 wherein the roughness approximated by the cylindrical pores is present along largely all of the wall's face.

10. A display as in claim 1 wherein the depressions are situated at locations generally random relative to one another.

11. A display as in claim 1 wherein the depressions comprise pores.

12. A display as in claim 11 wherein the pores have an average diameter of 1–1,000 nm.

13. A display as in claim 1 wherein the depressions comprise three-dimensionally rounded recessions.

14. A display as in claim 13 wherein most of the rounded recessions have portions of roughly constant radius of curvature.

15. A display as in claim 1 wherein the wall comprises multiple grains having outer grain surfaces that at least partially define the wall's face, the depressions comprising valleys generally formed by the outer grain surfaces of adjoining ones of the grains.

16. A display as in claim 15 wherein, along the upper halves of the heights of the outer grain surfaces, the outer grain surfaces generally visible from the first plate structure are of greater average steepness than the outer grain surfaces generally visible from the second plate structure.

17. A display as in claim 1 where in the depressions comprise recessions generally shaped like notches, each extending partway across the wall's face and defined by first and second notch surfaces that intersect each other.

18. A display as in claim 17 wherein the notches extend generally parallel to one another, the second notch surface of each notch being steeper than, and closer to the second plate structure than, the first notch surface of that notch along a plane extending generally parallel to either plate structure and to the wall.

19. A display as in claim 1 wherein the depressions comprise trenches, each extending partway across the wall's face.

20. A display as in any of claim 1 wherein the protuberances are situated at locations generally random relative to one another.

21. A display as in claim 1 wherein the protuberances overlie a generally smooth portion of the wall's face.

22. A display as in claim 1 where the protuberances comprise ridges.

23. A display as in claim 1 wherein the protuberances comprise spires.

24. A display as in claim 1 wherein the protuberances comprise material of different chemical composition than material of the wall directly below the protuberances.

25. A display as in claim 1 wherein the protuberances comprise particles.

26. A display as in claim 1 wherein the protuberances comprise pillars.

27. A display as in claim 1 wherein the wall comprises at least one of the following materials generally along the wall's face: (a) carbon; (b) a composition of carbon and at least one of silicon, nitrogen, and hydrogen; (c) a composition of boron and at least one of carbon, silicon, nitrogen, and hydrogen; (d) a composition of silicon and nitrogen; (e) oxide of at least one element in Groups 2a, 3b, 4b, 5b, 6b, 7b, 8, 1b, 2b, 3a, and 4a of Periods 2–6 of the Periodic Table including the lanthanides; (f) hydroxide of at least one element in Groups 2a, 3b, 4b, 5b, 6b, 7b, 8, 1b, 2b, 3a, and 4a of Periods 2–6 of the Periodic Table including the lanthanides; (g) nitride of at least one element in Groups 3b, 4b, 5b, 6b, 7b, 8, 1b, 2b, 3a, and 4a of Periods 2–6 of the Periodic Table including the lanthanides; and (h) carbide of at least one non-carbon element in Groups 3b, 4b, 5b, 6b, 7b, 8, 1b, 2b, 3a, and 4a of Periods 2–6 of the Periodic Table including the lanthanides.

28. A display as in claim 1 wherein the wall comprises at least one of the following materials along the wall's face: (a) carbon; (b) a composition of carbon and silicon; (c) a composition of boron and nitrogen; (d) oxide of at least one of beryllium, carbon, magnesium, aluminum, silicon, titanium, vanadium, chromium, manganese, iron, yttrium, niobium, molybdenum, lanthanum, cerium, praseodymium, neodymium, europium, and tungsten; (e) hydroxide of at least one of beryllium, carbon, magnesium, aluminum, silicon, titanium, vanadium, chromium, manganese, iron, yttrium, niobium, molybdenum, lanthanum, cerium, praseodymium, neodymium, europium, and tungsten; (f) nitride of at least one of aluminum, silicon, and titanium; and (g) boron carbide.

29. A display as in claim 1 wherein the wall comprises a wall-shaped electrically non-conductive substrate having a rough face that largely forms the wall's face.

30. A display as in claim 1 wherein the wall comprises:

a wall-shaped substrate; and a rough layer overlying the substrate and having a rough face that largely forms the wall's face.

31. A display as in claim 30 wherein the rough layer has an average electrical resistivity of $10^8$–$10^{14}$ ohm-cm at 25° C.

32. A display as in claim 31 wherein the rough layer is of at least ten times greater resistance per unit length than the substrate.

33. A display as in claim 30 wherein the rough layer comprises at least one of: (a) carbon; (b) a composition of carbon and at least one of silicon, nitrogen, and hydrogen; (c) a composition of boron and at least one of carbon, silicon, nitrogen, and hydrogen; (d) a composition of silicon and nitrogen; (e) oxide of at least one element in Groups 3b, 4b, 5b, 6b, 7b, 8, 1b, 2b, 3a, and 4a of Periods 2–6 of the Periodic Table including the lanthanides; (f) hydroxide of at least one element in Groups 3b, 4b, 5b, 6b, 7b, 8, 1b, 2b, 3a, and 4a of Periods 2–6 of the Periodic Table including the lanthanides; (g) nitride of at least one element in Groups 3b, 4b, 5b, 6b, 7b, 8, 1b, 2b, 3a, and 4a of Periods 2–6 of the Periodic Table including the lanthanides; and (h) carbide of at least one non-carbon element in Groups 3b, 4b, 5b, 6b, 7b, 8, 1b, 2b, 3a, and 4a of Periods 2–6 of the Periodic Table including the lanthanides.

34. A display as in claim 30 wherein the rough layer comprises at least one of: (a) carbon; (b) a composition of carbon and silicon; (c) a composition of boron and nitrogen; (d) oxide of at least one of carbon, aluminum, silicon, titanium, vanadium, chromium, manganese, iron, yttrium, niobium, molybdenum, lanthanum, cerium, praseodymium, neodymium, europium, and tungsten; (e) hydroxide of at least one of carbon, aluminum, silicon, titanium, vanadium, chromium, manganese, iron, yttrium, niobium, molybdenum, lanthanum, cerium, praseodymium, neodymium, europium, and tungsten; (f) nitride of at least one of aluminum and silicon; and (g) boron carbide.

35. A display as in claim 1 wherein the wall comprises:

a wall-shaped substrate having a face along which there is roughness; and a coating overlying the substrate's face and having a face that largely forms the wall's face, the roughness in the wall's face generally conforming to the roughness in the substrate's face.

36. A display as in claim 35 wherein the coating has a total natural electron yield coefficient of no more than 2.5.

37. A display as in claim 35 wherein the coating comprises at least one of: (a) carbon; (b) a composition of carbon and at least one of silicon, nitrogen, and hydrogen; (c) a composition of boron and at least one of carbon, silicon, and nitrogen; (d) oxide of at least one of titanium, chromium, manganese, iron, yttrium, niobium, molybdenum, cerium, praseodymium, neodymium, europium, and tungsten; (e) hydroxide of at least one of titanium, chromium, manganese, iron, yttrium, niobium, molybdenum, cerium, praseodymium, neodymium, europium, and tungsten; and (f) nitride of at least one of aluminum and titanium.

38. A display as in claim 1 wherein the wall comprises:

a wall-shaped substrate;

a rough layer overlying the substrate and having a face along which there is roughness; and a coating overlying the rough layer's face and having a face that largely forms the wall's face, the roughness in the wall's face generally conforming to the roughness in the rough layer's face.

39. A display as in claim 38 wherein the coating has a total natural electron yield coefficient of no more than 2.5.

40. A display as in claim 38 wherein the coating comprises at least one of: (a) carbon; (b) a composition of carbon and at least one of silicon, nitrogen, and hydrogen; (c) a composition of boron and at least one of carbon, silicon, and nitrogen; (d) oxide of at least one of titanium, chromium, manganese, iron, yttrium, niobium, molybdenum, cerium, praseodymium, neodymium, europium, and tungsten; (e) hydroxide of at least one of titanium, chromium, manganese, iron, yttrium, niobium, molybdenum, cerium, praseodymium, neodymium, europium, and tungsten; and (f) nitride of at least one of aluminum and titanium.

41. A display as in claim 38 wherein the rough layer and coating have a composite average electrical resistivity of $10^8$–$10^{14}$ ohm-cm at 25° C.

42. A display as in claim 41 wherein the rough layer and coating are together of at least ten times greater resistance per unit length than the substrate.

43. A display as in claim 1 wherein the spacer further includes at least one face electrode overlying the wall's face.

44. A display as in claim 1 wherein the wall comprises magnetic material at least along the wall's face.

45. A display as in claim 44 wherein:

the roughness in the wall's face inhibits secondary electrons emitted by the wall from escaping the wall; and the magnetic material of the wall further inhibits secondary electrons emitted by the wall from escaping the wall.

46. A flat-panel display comprising:

a first plate structure for emitting electrons;

a second plate structure, situated opposite the first plate structure, for emitting light to produce an image upon receiving electrons emitted by the first plate structure; and a spacer situated between the plate structures, the spacer comprising a main spacer body having a face that extends at least partway from either plate structure to the other plate structure, multiple pores extending into the main body along its face such that the main body has a porosity of at least 10% along the main body's face, the pores having an average diameter of 1–1,000 nm and averagely extending deeper into the main body than their average diameter, each pore laterally surrounded by material of the main body where that pore reaches the main body's face.

47. A display as in claim 46 wherein the pores inhibit secondary electrons emitted by the spacer from escaping the spacer.

48. A display as in claim 46 wherein the porosity of the main body is at least 20% along the main body's face.

49. A display as in claim 46 wherein the porosity of the main body is at least 40% along the main body's face.

50. A display as in claim 46 wherein the pores are present along largely all of the main body's face.

51. A display as in claim 46 wherein the average diameter of the pores is 5–1,000,nm.

52. A display as in claim 46 wherein the average diameter of the pores is 1–20 nm.

53. A display as in claim 46 wherein the pores extend approximately perpendicular to the main body's face.

54. A display as in claim 46 wherein the main body comprises a porous electrically non-conductive substrate.

55. A display as in claim 54 wherein the substrate comprises at least one of: (a) oxide of at least one non-carbon element in Groups 2a, 3b, 4b, 5b, 6b, 7b, 8, 1b, 2b, 3a, and 4a of Periods 2–6 of the Periodic Table including the lanthanides; (b) hydroxide of at least one non-carbon element in Groups 2a, 3b, 4b, 5b, 6b, 7b, 8, 1b, 2b, 3a, and 4a of Periods 2–6 of the Periodic Table including the lanthanides; (c) nitride of at least one non-carbon element in Groups 3b, 4b, 5b, 6b, 7b, 8, 1b, 2b, 3a, and 4a of Periods 2–6 of the Periodic Table including the lanthanides; and (d) carbide of at least one non-carbon element in Groups 3b, 4b, 5b, 6b, 7b, 8, 1b, 2b, 3a, and 4a of Periods 2–6 of the Periodic Table including the lanthanides.

56. A display as in claim 54 wherein the substrate comprises at least one of: (a) oxide of at least one of beryllium, magnesium, aluminum, silicon, titanium, vanadium, chromium, manganese, iron, yttrium, niobium, molybdenum, lanthanum, cerium, praseodymium, neodymium, europium, and tungsten; (b) hydroxide of at least one of beryllium, magnesium, aluminum, silicon, titanium, vanadium, chromium, manganese, iron, yttrium, niobium, molybdenum, lanthanum, cerium, praseodymium, neodymium, europium, and tungsten; (c) aluminum nitride; and (d) silicon carbide.

57. A display as in claim 54 wherein the substrate is shaped generally like a wall.

58. A display as in claim 54 wherein the main body further includes a coating overlying the substrate in a generally conformal manner.

59. A display as in claim 58 wherein the coating is of lower total natural electron yield coefficient than the substrate.

60. A display as in claim 58 wherein the coating has a total natural electron yield coefficient of no more than 2.5.

61. A display as in claim 58 wherein the coating comprises at least one of: (a) carbon; (b) a composition of carbon and at least one of silicon, nitrogen, and hydrogen; (c) a composition of boron and at least one of carbon, silicon, and nitrogen; (d) oxide of at least one of titanium, chromium, manganese, iron, yttrium, niobium, molybdenum, cerium, praseodymium, neodymium, europium, and tungsten; (e) hydroxide of at least one of titanium, chromium, manganese, iron, yttrium, niobium, molybdenum, cerium, praseodymium, neodymium, europium, and tungsten; and (f) nitride of at least one of aluminum and titanium.

62. A display as in claim 58 wherein:

the coating comprises carbon; and the substrate comprises oxide of at least one of aluminum, titanium, and chromium.

63. A display as in claim 62 wherein the carbon comprises at least one of graphite, amorphous carbon, and diamond-like carbon.

64. A display as in claim 46 wherein the main body comprises:

a substrate; and a porous electrically non-conductive layer overlying the substrate.

65. A display as in claim 64 wherein the porous layer has an average electrical resistivity of $10^8$–$10^{14}$ ohm-cm at 25° C.

66. A display as in claim 65 wherein the average electrical resistivity of the porous layer is $10^9$–$10^{13}$ ohm-cm at 25° C.

67. A display as in claim 65 wherein the porous layer is of at least ten times greater resistance per unit length than the substrate.

68. A display as in claim 65 wherein the porous layer has an average thickness of no more than 20 $\mu$m.

69. A display as in claim 68 wherein the average thickness of the porous layer is at least 20 nm.

70. A display as in claim 64 wherein the porous layer has a porosity of at least 20% along a face thereof spaced apart from the substrate.

71. A display as in claim 70 wherein the porosity of the porous layer is at least 40% along the porous layer's face.

72. A display as in claim 64 wherein the porous layer comprises at least one of: (a) carbon; (b) a composition of carbon and at least one of silicon, nitrogen, and hydrogen; (c) a composition of boron and at least one of carbon, silicon, nitrogen, and hydrogen; (d) a composition of silicon and nitrogen; (e) oxide of at least one element in Groups 3b, 4b, 5b, 6b, 7b, 8, 1b, 2b, 3a, and 4a of Periods 2–6 of the Periodic Table including the lanthanides; (f) hydroxide of at least one element in Groups 3b, 4b, 5b, 6b, 7b, 8, 1b, 2b, 3a, and 4a of Periods 2–6 of the Periodic Table including the lanthanides; (g) nitride of at least one element in Groups 3b, 4b, 5b, 6b, 7b, 8, 1b, 2b, 3a, and 4a of Periods 2–6 of the Periodic Table including the lanthanides; and (h) carbide of at least one non-carbon element in Groups 3b, 4b, 5b, 6b, 7b, 8, 1b, 2b, 3a, and 4a of Periods 2–6 of the Periodic Table including the lanthanides.

73. A display as in claim 64 wherein the porous layer comprises at least one of: (a) carbon; (b) a composition of carbon and silicon; (c) a composition of boron and nitrogen; (d) oxide of at least one of carbon, aluminum, silicon, titanium, vanadium, chromium, manganese, iron, yttrium, niobium, molybdenum, lanthanum, cerium, praseodymium, neodymium, europium, and tungsten; (e) hydroxide of at least one of carbon, aluminum, silicon, titanium, vanadium, chromium, manganese, iron, yttrium, niobium, molybdenum, lanthanum, cerium, praseodymium, neodymium, europium, and tungsten; (f) nitride of at least one of aluminum and silicon; and (g) boron carbide.

74. A display as in claim 64 wherein the substrate is generally shaped like a wall.

75. A display as in claim 64 wherein the main body further includes a coating overlying the porous layer in a generally conformal manner.

76. A display as in claim 75 wherein the coating is of lower total natural electron yield coefficient than the porous layer.

77. A display as in claim 75 wherein the coating has a total natural electron yield coefficient of no more than 2.5.

78. A display as in claim 75 wherein the porous layer and coating have a composite average electrical resistivity of $10^8$–$10^{14}$ ohm-cm at 25° C.

79. A display as in claim 75 wherein the porous layer and coating together are of at least ten times greater resistance per unit length than the substrate.

80. A display as in claim 75 wherein the coating comprises at least one of: (a) carbon; (b) a composition of carbon and at least one of silicon, nitrogen, and hydrogen; (c) a composition of boron and at least one of carbon, silicon, and nitrogen; (d) oxide of at least one of titanium, chromium, manganese, iron, yttrium, niobium, molybdenum, cerium, praseodymium, neodymium, europium, and tungsten; (e) hydroxide of at least one of titanium, chromium, manganese, iron, yttrium, niobium, molybdenum, cerium, praseodymium, neodymium, europium, and tungsten; and (f) nitride of at least one of aluminum and titanium.

81. A display as in claim 75 wherein the porous layer comprises at least one of: (a) carbon; (b) a composition of carbon and at least one of silicon, nitrogen, and hydrogen; (c) a composition of boron and at least one of carbon, silicon, nitrogen, and hydrogen; (d) a composition of silicon and nitrogen; (e) oxide of at least one element in Groups 3b, 4b, 5b, 6b, 7b, 8, 1b, 2b, 3a, and 4a of Periods 2–6 of the Periodic Table including the lanthanides; (f) hydroxide of at least one element in Groups 3b, 4b, 5b, 6b, 7b, 8, 1b, 2b, 3a, and 4a of Periods 2–6 of the Periodic Table including the lanthanides; (g) nitride of at least one element in Groups 3b, 4b, 5b, 6b, 7b, 8, 1b, 2b, 3a, and 4a of Periods 2–6 of the Periodic Table including the lanthanides; and (h) carbide of at least one non-carbon element in Groups 3b, 4b, 5b, 6b, 7b, 8, 1b, 2b, 3a, and 4a of Periods 2–6 of the Periodic Table including the lanthanides.

82. A display as in claim 75 wherein the porous layer comprises at least one of: (a) carbon; (b) a composition of carbon and silicon; (c) a composition of boron and nitrogen; (d) oxide of at least one of carbon, aluminum, silicon, titanium, vanadium, chromium, manganese, iron, yttrium, niobium, molybdenum, lanthanum, cerium, praseodymium, neodymium, europium, and tungsten; (e) hydroxide of at least one of carbon, aluminum, silicon, titanium, vanadium, chromium, manganese, iron, yttrium, niobium, molybdenum, lanthanum, cerium, praseodymium, neodymium, europium, and tungsten; (f) nitride of at least one of aluminum and silicon; and (g) boron carbide.

83. A display as in claim 75 wherein:

the coating comprises carbon; and the porous layer comprises oxide of at least one of aluminum, silicon, titanium, chromium, iron, and neodymium.

84. A display as in claim 83 wherein the carbon comprises at least one of graphite, amorphous carbon, and diamond-like carbon.

85. A display as in claim 75 wherein the substrate is shaped generally like a wall.

86. A display as in claim 46 wherein the main body comprises magnetic material at least along the main body's face.

87. A display as in claim 86 wherein:

the roughness in the main body's face inhibits secondary electrons emitted by the main body from escaping the main body; and the magnetic material of the main body further inhibits secondary electrons emitted by the main body from escaping the main body.

88. A display as in claim 86 wherein the main body is shaped generally like a wall.

89. A flat-panel display comprising:

a first plate structure for emitting electrons;

a second plate structure, situated opposite the first plate structure, for producing an image upon receiving electrons emitted by the first plate structure; and a spacer comprising (a) a primary spacer body having a face that extends at least partway from either plate structure to the other plate structure, multiple pores extending into the primary body along its face such that the primary body has a porosity of at least 10% along the primary body's face, each pore laterally surrounded by material of the primary body where that pore reaches the primary body's face, and (b) a coating overlying the primary body's face in a generally conformal manner such that the coating has a rough face.

90. A display as in claim 89 wherein:

the pores inhibit secondary electrons emitted by the spacer from escaping the spacer; and the coating is of lower total natural electron yield coefficient than the primary body.

91. A display as in claim 89 wherein the primary body comprises:

an electrically non-conductive substrate; and a porous layer overlying the substrate.

92. A flat-panel display comprising:

a first plate structure for emitting electrons;

a second plate structure, situated opposite the first plate structure, for producing an image upon receiving electrons emitted by the first plate structure; and a spacer situated between the plate structures, the spacer comprising (a) a spacer substrate and (b) a porous layer that overlies the substrate and has a face spaced apart from the substrate, the porous layer having an average electrical resistivity of $10^8$–$10^{14}$ ohm-cm at 25° C., an average thickness of no more than 20 $\mu$m, and a porosity of at least 10% along the porous layer's face.

93. A display as in claim 92 wherein pores extending into the porous layer along its primary face inhibit electrons emitted by the spacer from escaping the spacer, each pore laterally surrounded by material of the porous layer where that pore reached the porous layer's face.

94. A flat-panel display comprising:

a first plate structure for emitting electrons;

a second plate structure, situated opposite the first plate structure, for producing an image upon receiving electrons emitted by the first plate structure; and a spacer situated between the plate structures, the spacer comprising a main spacer body in which multiple grains have outer grain surfaces that at least partially define a rough face of the main body, the outer grain surfaces being shaped to provide the main body's rough face with a directional roughness characteristic in which, along the upper halves of the heights of the outer grain surfaces, the outer grain surfaces generally visible from the first plate structure are of greater average steepness than the outer grain surfaces generally visible from the second plate structure.

95. A display as in claim 94 wherein:

general roughness in the main body's rough face inhibits secondary electrons emitted by the spacer from escaping the spacer; and the directional roughness characteristic further inhibits secondary electrons emitted by the spacer from escaping the spacer.

96. A flat-panel display comprising:

a first plate structure for emitting electrons;

a second plate structure, situated opposite the first plate structure, for producing an image upon receiving electrons emitted by the first plate structure; and a spacer situated between the plate structures, the spacer comprising a main spacer body having a rough face in which there are multiple depressions generally shaped as notches, each extending only partway across the wall's face.

97. A display as in claim 96 wherein the main body is generally shaped like a wall, each notch comprising first and second notch surfaces that intersect each other, the second notch surface being steeper than, and closer to the second plate structure than, the first notch surface along a plane extending generally perpendicular to either plate structure and to the main body so as to provide the main body's rough face with a directional roughness characteristic.

98. A display as in claim 97 wherein:

the notches generally inhibit secondary electrons emitted by the spacer from escaping the spacer; and the directional roughness characteristic further inhibits secondary electrons emitted by the spacer from escaping the spacer.

99. A display as in claim 97 wherein the notches extend generally parallel to either plate structure.

100. A flat-panel display comprising:

a first plate structure for emitting electrons;

a second plate structure, situated opposite the first plate structure, for producing an image upon receiving electrons emitted by the first plate structure; and a spacer situated between the plate structures, the spacer comprising a main spacer body having a rough face in which there are multiple three-dimensionally rounded recessions, most of the rounded recessions having portions of roughly constant radius of curvature, each rounded recession laterally surrounded by material of the main body where that rounded recession reached the main body's face.

101. A display as in claim 100 wherein the rounded recessions inhibit secondary electrons emitted by the spacer from escaping the spacer.

102. A flat-panel display comprising:

a first plate structure for emitting electrons;

a second plate structure, situated opposite the first plate structure, for producing an image upon receiving electrons emitted by the first plate structure; and a spacer situated between the plate structures, the spacer comprising an electrically non-insulating main spacer wall having a rough face in which there are (a) depressions generally shaped as trenches or/and (b) protuberances generally shaped as ridges, each trench or ridge extending only partway across the wall's face.

103. A display as in claim 102 wherein the trenches or/and ridges inhibit secondary electrons emitted by the spacer from escaping the spacer.

104. A display as in claim 102 wherein the trenches or/and ridges extend generally parallel to one another.

105. A display as in claim 104 wherein the trenches or/and ridges extend generally parallel to either plate structure.

106. A flat-panel display comprising:

a first plate structure for emitting electrons;

a second plate structure, situated opposite the first plate structure, for producing an image upon receiving electrons emitted by the first plate structure; and a spacer situated between the plate structures, the spacer comprising an electrically non-insulating main spacer body having a rough face in which there are protuberances generally shaped as pillars or/and spires, each pillar or spire extending only partway across the main body's face.

107. A display as in claim 106 wherein the pillars or/and spires inhibit secondary electrons emitted by the spacer from escaping the spacer.

108. A display as in claim 11 wherein the pores averagely extend deeper into the spacer wall than their average diameter.

109. A display as in claim 89 wherein the pores averagely extend deeper into the primary body than their average diameter.

110. A display as in claim 89 wherein the porosity of the primary body is at least 20% along the primary body's face.

111. A display as in claim 89 wherein the porosity of the primary body is at least 40% along the primary body's face.

112. A display as in claim 89 wherein the pores are present along largely all of the primary body's face.

113. A display as in claim 89 wherein the average diameter of the pores is 5–1,000 nm.

114. A display as in claim 89 wherein the pores extend approximately perpendicular to the primary body's face.

115. A display as in claim 89 wherein the primary body comprises at least one of: (a) oxide of at least one non-carbon element in Groups 2a, 3b, 4b, 5b, 6b, 7b, 8, 1b, 2b, 3a, and 4a of Periods 2–6 of the Periodic Table including the lanthanides; (b) hydroxide of at least one non-carbon element in Groups 2a, 3b, 4b, 5b, 6b, 7b, 8, 1b, 2b, 3a, and 4a of Periods 2–6 of the Periodic Table including the lanthanides; (c) nitride of at least one non-carbon element in Groups 3b, 4b, 5b, 6b, 7b, 8, 1b, 2b, 3a, and 4a of Periods 2–6 of the Periodic Table including the lanthanides; and (d) carbide of at least one non-carbon element in Groups 3b, 4b, 5b, 6b, 7b, 8, 1b, 2b, 3a, and 4a of Periods 2–6 of the Periodic Table including the lanthanides.

116. A display as in claim 89 wherein the primary body comprises at least one of: (a) oxide of at least one of beryllium, magnesium, aluminum, silicon, titanium, vanadium, chromium, manganese, iron, yttrium, niobium, molybdenum, lanthanum, cerium, praseodymium, neodymium, europium, and tungsten; (b) hydroxide of at least one of beryllium, magnesium, aluminum, silicon, titanium, vanadium, chromium, manganese, iron, yttrium, niobium, molybdenum, lanthanum, cerium, praseodymium, neodymium, europium, and tungsten; (c) aluminum nitride; and (d) silicon carbide.

117. A display as in claim 89 wherein the primary body is shaped generally like a wall.

118. A display as in claim 89 wherein the coating has a total natural electron yield coefficient of no more than 2.5.

119. A display as in claim 89 wherein the coating comprises at least one of: (a) carbon; (b) a composition of carbon and at least one of silicon, nitrogen, and hydrogen; (c) a composition of boron and at least one of carbon, silicon, and nitrogen; (d) oxide of at least one of titanium, chromium, manganese, iron, yttrium, niobium, molybdenum, cerium, praseodymium, neodymium, europium, and tungsten; (e) hydroxide of at least one of titanium, chromium, manganese, iron, yttrium, niobium, molybdenum, cerium, praseodymium, neodymium, europium, and tungsten; and (f) nitride of at least one of aluminum and titanium.

120. A display as in claim 89 wherein:

the coating comprises carbon; and the substrate comprises oxide of at least one of aluminum, titanium, and chromium.

121. A display as in claim 120 wherein the carbon comprises at least one of graphite, amorphous carbon, and diamond-like carbon.

122. A display as in claim 89 wherein the primary body comprises magnetic material at least along the primary body's face.

123. A display as in claim 122, wherein, the roughness in the primary body's face inhibits secondary electrons emitted by the primary body from escaping the primary body; and the magnetic material of the primary body further inhibits secondary electrons emitted by the primary body from escaping the primary body.

124. A display as in claim 122 wherein the primary body is shaped generally like a wall.

125. A display as in claim 91 wherein the pores are present in the porous layer and averagely extend deeper into the porous layer than their average diameter.

126. A display as in claim 91 wherein the porous layer has an average electrical resistivity of $10^8$–$10^{14}$ ohm-cm at 25° C.

127. A display as in claim 126 wherein the average electrical resistivity of the porous layer is $10^9$–$10^{13}$ ohm-cm at 25° C.

128. A display as in claim 91 wherein the porous layer is of at least ten times greater resistance per unit length than the substrate.

129. A display as in claim 91 wherein the porous layer has an average thickness of no more than 20 $\mu$m.

130. A display as in claim 129 wherein the average thickness of the porous layer is at least 20 nm.

131. A display as in claim 91 wherein the porous layer has a porosity of at least 20% along a face thereof spaced apart from the substrate.

132. A display as in claim 91 wherein the porosity of the porous layer is at least 40% along the porous layer's face.

133. A display as in claim 91 wherein the porous layer comprises at least one of: (a) carbon; (b) a composition of carbon and at least one of silicon, nitrogen, and hydrogen; (c) a composition of boron and at least one of carbon, silicon, nitrogen, and hydrogen; (d) a composition of silicon and nitrogen; (e) oxide of at least one element in Groups 3b, 4b, 5b, 6b, 7b, 8, 1b, 2b, 3a, and 4a of Periods 2–6 of the Periodic Table including the lanthanides; (f) hydroxide of at least one element in Groups 3b, 4b, 5b, 6b, 7b, 8, 1b, 2b, 3a, and 4a of Periods 2–6 of the Periodic Table including the lanthanides; (g) nitride of at least one element in Groups 3b, 4b, 5b, 6b, 7b, 8, I b, 2b, 3a, and 4a of Periods 2–6 of the Periodic Table including the lanthanides, and (h) carbide of at least one non-carbon element in Groups 3b, 4b, 5b, 6b, 7b, 8, 1b, 2b, 3a, and 4a of Periods 2–6 of the Periodic Table including the lanthanides.

134. A display as in claim 91 wherein the porous layer comprises at least one of: (a) carbon; (b) a composition of carbon and silicon; (c) a composition of boron and nitrogen;

(d) oxide of at least one of carbon, aluminum, silicon, titanium, vanadium, chromium, manganese, iron, yttrium, niobium, molybdenum, lanthanum, cerium, praseodymium, neodymium, europium, and tungsten; (e) hydroxide of at least one of carbon, aluminum, silicon, titanium, vanadium, chromium, manganese, iron, yttrium, niobium, molybdenum, lanthanum, cerium, praseodymium, neodymium, europium, and tungsten; (f) nitride of at least one of aluminum and silicon; and (g) boron carbide.

135. A display as in claim 91 wherein the substrate is generally shaped like a wall.

136. A display as in claim 91 wherein the coating is of lower total natural electron yield coefficient than the porous layer.

137. A display as in claim 91 wherein the coating has a total natural electron yield coefficient of no more than 2.5.

138. A display as in claim 91 wherein the porous layer and coating have a composite average electrical resistivity of $10^8$–$10^{14}$ ohm-cm at 25° C.

139. A display as in claim 91 wherein the porous layer and coating together are of at least ten times greater resistance per unit length than the substrate.

140. A display as in claim 91 wherein:

the coating comprises carbon; and the porous layer comprises oxide of at least one of aluminum, silicon, titanium, chromium, iron, and neodymium.

141. A display as in claim 140 wherein the carbon comprises at least one of graphite, amorphous carbon, and diamond-like carbon.

142. A display as in claim 92 wherein the porosity of the porous layer is at least 20% along the porous layer's face.

143. A display as in claim 92 wherein the porosity of the porous layer is at least 40% along the porous layer's face.

144. A display as in claim 92 wherein the substrate comprises at least one of: (a) oxide of at least one non-carbon element in Groups 2a, 3b, 4b, 5b, 6b, 7b, 8, 1b, 2b, 3a, and 4a of Periods 2–6 of the Periodic Table including the lanthanides; (b) hydroxide of at least one non-carbon element in Groups 2a, 3b, 4b, 5b, 6b, 7b, 8, 1b, 2b, 3a, and 4a of Periods 2–6 of the Periodic Table including the lanthanides; (c) nitride of at least one non-carbon element in Groups 3b, 4b, 5b, 6b, 7b, 8, 1b, 2b, 3a, and 4a of Periods 2–6 of the Periodic Table including the lanthanides; and (d) carbide of at least one non-carbon element in Groups 3b, 4b, 5b, 6b, 7b, 8, 1b, 2b, 3a, and 4a of Periods 2–6 of the Periodic Table including the lanthanides.

145. A display as in claim 92 wherein the substrate comprises at least one of: (a) oxide of at least one of beryllium, magnesium, aluminum, silicon, titanium, vanadium, chromium, manganese, iron, yttrium, niobium, molybdenum, lanthanum, cerium, praseodymium, neodymium, europium, and tungsten; (b) hydroxide of at least one of beryllium, magnesium, aluminum, silicon, titanium, vanadium, chromium, manganese, iron, yttrium, niobium, molybdenum, lanthanum, cerium, praseodymium, neodymium, europium, and tungsten; (c) aluminum nitride; and (d) silicon carbide.

146. A display as in claim 92 wherein the substrate is shaped generally like a wall.

147. A display as in claim 92 wherein the average electrical resistivity of the porous layer is $10^9$–$10^{13}$ ohm-cm at 25° C.

148. A display as in claim 92 wherein the porous layer is of at least ten times greater resistance per unit length than the substrate.

149. A display as in claim 92 wherein the porous layer comprises at least one of: (a) carbon; (b) a composition of carbon and at least one of silicon, nitrogen, and hydrogen; (c) a composition of boron and at least one of carbon, silicon, nitrogen, and hydrogen; (d) a composition of silicon and nitrogen; (e) oxide of at least one element in Groups 3b, 4b, 5b, 6b, 7b, 8, 1b, 2b, 3a, and 4a of Periods 2–6 of the Periodic Table including the lanthanides; (f) hydroxide of at least one element in Groups 3b, 4b, 5b, 6b, 7b, 8, I b, 2b, 3a, and 4a of Periods 2–6 of the Periodic Table including the lanthanides; (g) nitride of at least one element in Groups 3b, 4b, 5b, 6b, 7b, 8, 1b, 2b, 3a, and 4a of Periods 2–6 of the Periodic Table including the lanthanides; and (h) carbide of at least one non-carbon element in Groups 3b, 4b, 5b, 6b, 7b, 8, 1b, 2b, 3a, and 4a of Periods 2–6 of the Periodic Table including the lanthanides.

150. A display as in claim 92 wherein the porous layer comprises at least one of: (a) carbon; (b) a composition of carbon and silicon; (c) a composition of boron and nitrogen; (d) oxide of at least one of carbon, aluminum, silicon, titanium, vanadium, chromium, manganese, iron, yttrium, niobium, molybdenum, lanthanum, cerium, praseodymium, neodymium, europium, and tungsten; (e) hydroxide of at least one of carbon, aluminum, silicon, titanium, vanadium, chromium, manganese, iron, yttrium, niobium, molybdenum, lanthanum, cerium, praseodymium, neodymium, europium, and tungsten; (f) nitride of at least one of aluminum and silicon; and (g) boron carbide.

151. A display as in claim 92 wherein the spacer further includes a coating overlying the porous layer in a generally conformal manner.

152. A display as in claim 151 wherein the coating is of lower total natural electron yield coefficient than the porous layer.

153. A display as in claim 151 wherein the coating has a total natural electron yield coefficient of no more than 2.5.

154. A display as in claim 151 wherein the porous layer and coating together are of at least ten times greater resistance per unit length than the substrate.

155. A display as in claim 151 wherein the coating comprises at least one of: (a) carbon; (b) a composition of carbon and at least one of silicon, nitrogen, and hydrogen; (c) a composition of boron and at least one of carbon, silicon, and nitrogen; (d) oxide of at least one of titanium, chromium, manganese, iron, yttrium, niobium, molybdenum, cerium, praseodymium, neodymium, europium, and tungsten; (e) hydroxide of at least one of titanium, chromium, manganese, iron, yttrium, niobium, molybdenum, cerium, praseodymium, neodymium, europium, and tungsten; and (f) nitride of at least one of aluminum and titanium.

156. A display as in claim 151 wherein the porous layer comprises at least one of: (a) carbon; (b) a composition of carbon and at least one of silicon, nitrogen, and hydrogen;

(c) a composition of boron and at least one of carbon, silicon, nitrogen, and hydrogen; (d) a composition of silicon and nitrogen; (e) oxide of at least one element in Groups 3b, 4b, 5b, 6b, 7b, 8, 1b, 2b, 3a, and 4a of Periods 2–6 of the Periodic Table including the lanthanides; (f) hydroxide of at least one element in Groups 3b, 4b, 5b, 6b, 7b, 8, 1b, 2b, 3a, and 4a of Periods 2–6 of the Periodic Table including the lanthanides; (g) nitride of at least one element in Groups 3b, 4b, 5b, 6b, 7b, 8, 1b, 2b, 3a, and 4a of Periods 2–6 of the Periodic Table including the lanthanides; and (h) carbide of at least one non-carbon element in Groups 3b, 4b, 5b, 6b, 7b, 8, 1b, 2b, 3a, and 4a of Periods 2–6 of the Periodic Table including the lanthanides.

157. A display as in claim 151 wherein the porous layer comprises at least one of: (a) carbon; (b) a composition of carbon and silicon; (c) a composition of boron and nitrogen; (d) oxide of at least one of carbon, aluminum, silicon, titanium, vanadium, chromium, manganese, iron, yttrium, niobium, molybdenum, lanthanum, cerium, praseodymium, neodymium, europium, and tungsten; (e) hydroxide of at least one of carbon, aluminum, silicon, titanium, vanadium, chromium, manganese, iron, yttrium, niobium, molybdenum, lanthanum, cerium, praseodymium, neodymium, europium, and tungsten; (f) nitride of at least one of aluminum and silicon; and (g) boron carbide.

158. A display as in claim 151 wherein:

the coating comprises carbon; and the porous layer comprises oxide of at least one of aluminum, silicon, titanium, chromium, iron, and neodymium.

159. A display as in claim 151 wherein the substrate is shaped generally like a wall.

160. A display as in claim 92 wherein the porous layer comprises magnetic material at least along the porous layer's face.

161. A display as in claim 160 wherein:

the roughness in the porous layer's face inhibits secondary electrons emitted by the porous layer from escaping the porous layer; and the magnetic material of the porous layer further inhibits secondary electrons emitted by the porous layer from escaping the porous layer.

162. A display as in claim 160 wherein the substrate is shaped generally like a wall.

163. A display as in claim 93 wherein the pores averagely extend deeper into the porous layer than their average diameter.

164. A display as in claim 93 wherein the pores are present along largely all of the porous layer's face.

165. A display as in claim 93 wherein the pores have an average diameter of 5–1,000 nm.

166. A display as in claim 93 wherein the pores have an average diameter of 1–20 nm.

167. A display as in claim 93 wherein the pores extend approximately perpendicular to the porous layer's face.

168. A display as in claim 94 wherein the main body has a porosity of at least 10% along the main body's face.

169. A display as in claim 168 wherein the porosity of the main body is at least 20% along the main body's face.

170. A display as in claim 168 wherein the porosity of the main body is at least 40% along the main body's face.

171. A display as in claim 96 wherein the main body has a porosity of at least 10% along the main body's face.

172. A display as in claim 171 wherein the porosity of the main body is at least 20% along the main body's face.

173. A display as in claim 171 wherein the porosity of the main body is at least 40% along the main body's face.

174. A display as in claim 100 wherein the main body has a porosity of at least 10% along the main body's face.

175. A display as in claim 174 wherein the porosity of the main body is at least 20% along the main body's face.

176. A display as in claim 174 wherein the porosity of the main body is at least 40% along the main body's face.

177. A display as in claim 102 wherein the spacer wall has a porosity of at least 10% along the main wall's face.

178. A display as in claim 177 wherein the porosity of the main wall is at least 20% along the main wall's face.

179. A display as in claim 177 wherein the porosity of the main wall is at least 40% along the main wall's face.

180. A display as in claim 106 wherein the main body has a porosity of at least 10% along the main body's face.

181. A display as in claim 180 wherein the porosity of the main body is at least 20% along the main body's face.

182. A display as in claim 180 wherein the porosity of the main body is at least 40% along the main body's face.

* * * * *

UNITED STATES PATENT AND TRADEMARK OFFICE

CERTIFICATE OF CORRECTION

PATENT NO. : 6,617,772 B1
DATED : September 9, 2003
INVENTOR(S) : Roger W. Barton et al.

It is certified that error appears in the above-identified patent and that said Letters Patent is hereby corrected as shown below:

Column 1,
Line 5, insert the following text:
-- GOVERNMENT RIGHTS IN INVENTION
This invention was made with the support of the U.S. Government under Contract No. N00014-96-C-0266 awarded by the Office of Naval Research. The Government has certain rights in this invention. --

Signed and Sealed this

Sixth Day of April, 2004

JON W. DUDAS
*Acting Director of the United States Patent and Trademark Office*